US010465377B2

(12) United States Patent
Konduc et al.

(10) Patent No.: US 10,465,377 B2
(45) Date of Patent: Nov. 5, 2019

(54) DRILLING RIG WITH SELF-ELEVATING DRILL FLOOR

(71) Applicant: National Oilwell Varco, L.P., Houston, TX (US)

(72) Inventors: Kameron Wayne Konduc, Edmonton (CA); Elijah Jakobsohn, Spring, TX (US); Brian Daniel Winter, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 15/947,342

(22) Filed: Apr. 6, 2018

(65) Prior Publication Data

US 2018/0251970 A1 Sep. 6, 2018

Related U.S. Application Data

(62) Division of application No. 15/051,800, filed on Feb. 24, 2016, now Pat. No. 9,988,807.

(51) Int. Cl.
*E04H 12/34* (2006.01)
*E04B 1/35* (2006.01)
(Continued)

(52) U.S. Cl.
CPC ..... *E04B 1/3522* (2013.01); *B66F 3/46* (2013.01); *E04B 1/3511* (2013.01); *E21B 15/00* (2013.01); *E21B 41/00* (2013.01)

(58) Field of Classification Search
CPC ..... E21B 15/00; E21B 7/023; E21B 15/04; E21B 15/003
See application file for complete search history.

(56) References Cited

U.S. PATENT DOCUMENTS 1,557,070 A 10/1925 Logue
2,420,803 A 5/1947 Tobin
(Continued)

FOREIGN PATENT DOCUMENTS

CN 101476312 A 7/2009
CN 102536267 A 7/2012
(Continued)

OTHER PUBLICATIONS

"U.S. Appl. No. 15/051,800, Corrected Notice of Allowability dated May 10, 2018", 2 pgs.
(Continued)

*Primary Examiner* — Gisele D Ford
(74) *Attorney, Agent, or Firm* — Schwegman Lundberg & Woessner, P.A.

(57) ABSTRACT

The present disclosure, in one or more embodiments, relates to a drilling rig with a self-elevating drill floor. The drilling rig may have one or more jacking systems that may operate to raise the drill floor. The one or more jacking systems may raise the drill floor to a height sufficient to accommodate a substructure such as a substructure box. A substructure box may be placed, and the one or more jacking systems may lower the drill floor onto the substructure box. Substructure boxes may be placed beneath the drill floor, using the one or more jacking systems, until a desired drill floor height is reached. In some embodiments, the one or more jacking systems may additionally operate to move the drilling rig, for example between adjacent wells on a pad drilling site. The jacking systems may operate to move the drilling rig using walking feet or another mechanism.

14 Claims, 46 Drawing Sheets

(51) Int. Cl.

| | |
|---|---|
| ***B66F 3/46*** | (2006.01) |
| ***E21B 41/00*** | (2006.01) |
| ***E21B 15/00*** | (2006.01) |

(56) References Cited

U.S. PATENT DOCUMENTS

| | | | | |
|---|---|---|---|---|
| 2,657,017 | A | 10/1953 | Curtis | |
| 2,663,375 | A | 12/1953 | Caldwell | |
| 2,781,108 | A | 2/1957 | Selberg et al. | |
| 3,063,509 | A | 11/1962 | Guier | |
| 3,099,323 | A | 7/1963 | Kelley | |
| 3,228,151 | A | 1/1966 | Woolslayer et al. | |
| 3,271,915 | A | 9/1966 | Woolslayer et al. | |
| 3,327,997 | A | 6/1967 | Howard | |
| 3,333,377 | A | 8/1967 | Woolslayer et al. | |
| 3,477,235 | A | 11/1969 | Branham et al. | |
| 3,483,933 | A | 12/1969 | Dyer et al. | |
| 3,774,780 | A | 11/1973 | Buffington | |
| 3,807,109 | A | 4/1974 | Jenkins et al. | |
| 3,828,513 | A | 8/1974 | Vanderklaauw | |
| 3,922,825 | A | 12/1975 | Eddy et al. | |
| 3,942,593 | A | 3/1976 | Reeve, Jr. et al. | |
| 3,949,818 | A | 4/1976 | Russell | |
| 3,977,542 | A | 8/1976 | Stolzer | |
| 4,068,487 | A * | 1/1978 | Pease | B63B 35/4413 104/35 |
| 4,081,932 | A | 4/1978 | Armstrong | |
| 4,128,229 | A | 12/1978 | Elliston | |
| 4,135,340 | A | 1/1979 | Cox et al. | |
| 4,269,395 | A | 5/1981 | Newman et al. | |
| 4,290,495 | A | 9/1981 | Elliston | |
| 4,366,650 | A | 1/1983 | Patterson | |
| 4,375,241 | A | 3/1983 | Gallon | |
| 4,375,892 | A | 3/1983 | Jenkins et al. | |
| 4,421,447 | A | 12/1983 | Gudgel et al. | |
| 4,587,778 | A | 5/1986 | Woolslayer et al. | |
| 4,823,870 | A | 4/1989 | Sorokan | |
| 4,831,795 | A | 5/1989 | Sorokan | |
| 4,837,992 | A | 6/1989 | Hashimoto | |
| 4,885,893 | A | 12/1989 | Wasterval, Jr. et al. | |
| 5,216,867 | A | 6/1993 | Wasterval, Jr. et al. | |
| 5,407,302 | A | 4/1995 | Springett et al. | |
| 5,492,436 | A | 2/1996 | Suksumake | |
| 5,954,453 | A | 9/1999 | Thomas | |
| 5,997,217 | A | 12/1999 | Verret | |
| 6,045,297 | A | 4/2000 | Voorhees et al. | |
| 6,141,870 | A | 11/2000 | Mcdermott et al. | |
| 6,171,027 | B1 | 1/2001 | Blankestijin | |
| 6,412,576 | B1 | 7/2002 | Meiners | |
| 6,634,436 | B1 | 10/2003 | Desai | |
| 6,729,804 | B1 | 5/2004 | Roodenburg et al. | |
| 6,994,171 | B2 | 2/2006 | Orr et al. | |
| 6,997,647 | B2 | 2/2006 | Bennett, Jr. et al. | |
| 7,360,589 | B2 | 4/2008 | Moncus et al. | |
| 7,410,326 | B2 | 8/2008 | Morrison et al. | |
| 7,584,809 | B1 | 9/2009 | Flud | |
| 7,765,749 | B2 | 8/2010 | Palidis | |
| 7,931,076 | B2 | 4/2011 | Ditta et al. | |
| 8,047,303 | B2 | 11/2011 | Donnally et al. | |
| 8,287,212 | B2 | 10/2012 | Roper | |
| 8,468,753 | B2 | 6/2013 | Donnally et al. | |
| 8,516,751 | B2 | 8/2013 | Konduc et al. | |
| 8,549,815 | B2 | 10/2013 | Donnally et al. | |
| 8,555,564 | B2 * | 10/2013 | Wasterval | E21B 15/00 52/111 |
| 8,556,003 | B2 | 10/2013 | Souchek | |
| 9,091,126 | B2 | 7/2015 | Thiessen et al. | |
| 9,109,399 | B2 | 8/2015 | Murr et al. | |
| 9,212,778 | B2 | 12/2015 | Winter | |
| 9,988,807 | B2 | 6/2018 | Konduc et al. | |
| 2002/0185319 | A1 | 12/2002 | Smith | |
| 2003/0102166 | A1 | 6/2003 | Jortveit | |
| 2003/0147726 | A1 | 8/2003 | Tolmon et al. | |
| 2003/0172599 | A1 | 9/2003 | Frink | |
| 2004/0151549 | A1 | 8/2004 | Roodenburg et al. | |
| 2004/0211572 | A1 | 10/2004 | Orr et al. | |
| 2004/0211598 | A1 | 10/2004 | Palidis | |
| 2004/0240973 | A1 | 12/2004 | Andrews et al. | |
| 2006/0180564 | A1 | 8/2006 | Keppel | |
| 2007/0272762 | A1 | 11/2007 | Click et al. | |
| 2008/0257607 | A1 | 10/2008 | Winter | |
| 2009/0000218 | A1 | 1/2009 | Lee et al. | |
| 2009/0087311 | A1 * | 4/2009 | Wyborn | E04H 12/08 416/9 |
| 2009/0188677 | A1 | 7/2009 | Ditta et al. | |
| 2009/0283324 | A1 | 11/2009 | Konduc et al. | |
| 2009/0321135 | A1 | 12/2009 | Vora | |
| 2010/0150660 | A1 | 6/2010 | Nadarajah et al. | |
| 2010/0260555 | A1 | 10/2010 | Foo et al. | |
| 2010/0303586 | A1 | 12/2010 | Hankins et al. | |
| 2011/0072737 | A1 | 3/2011 | Wasterval | |
| 2011/0114386 | A1 | 5/2011 | Souchek | |
| 2011/0280104 | A1 | 11/2011 | Mcclung, III | |
| 2012/0047820 | A1 | 3/2012 | Donnally et al. | |
| 2012/0138327 | A1 | 6/2012 | Sorokan et al. | |
| 2012/0201632 | A1 | 8/2012 | Yater et al. | |
| 2012/0304553 | A1 | 12/2012 | Konduc et al. | |
| 2012/0304588 | A1 * | 12/2012 | von Ahn | E04H 12/344 52/745.17 |
| 2013/0168516 | A1 | 7/2013 | Winter | |
| 2013/0180186 | A1 | 7/2013 | Konduc et al. | |
| 2013/0269268 | A1 * | 10/2013 | Thiessen | E21B 15/00 52/118 |
| 2013/0305632 | A1 | 11/2013 | Rivera, Sr. et al. | |
| 2013/0340572 | A1 | 12/2013 | Flusche | |
| 2013/0340998 | A1 | 12/2013 | Flusche | |
| 2013/0341036 | A1 | 12/2013 | Flusche | |
| 2014/0041855 | A1 | 2/2014 | Rodgers | |
| 2014/0090333 | A1 | 4/2014 | Vogt | |
| 2014/0158342 | A1 | 6/2014 | Smith et al. | |
| 2014/0259985 | A1 * | 9/2014 | Petrello | E04H 12/344 52/115 |
| 2014/0262518 | A1 | 9/2014 | Reddy et al. | |
| 2014/0262519 | A1 | 9/2014 | Petrello et al. | |
| 2014/0262520 | A1 | 9/2014 | Petrello et al. | |
| 2014/0263685 | A1 | 9/2014 | Yustus et al. | |
| 2014/0270974 | A1 | 9/2014 | Seng et al. | |
| 2014/0270975 | A1 | 9/2014 | Seng et al. | |
| 2015/0090450 | A1 | 4/2015 | Thiessen | |
| 2015/0152690 | A1 | 6/2015 | Sorokan et al. | |
| 2015/0184466 | A1 | 7/2015 | Rivera, Sr. et al. | |
| 2015/0218891 | A1 | 8/2015 | Padira et al. | |
| 2016/0010323 | A1 | 1/2016 | Konduc et al. | |
| 2016/0052441 | A1 | 2/2016 | Korach | |
| 2016/0369523 | A1 | 12/2016 | Konduc et al. | |
| 2017/0241126 | A1 | 8/2017 | Konduc et al. | |

FOREIGN PATENT DOCUMENTS

| | | | |
|---|---|---|---|
| RU | 1770509 | A1 | 10/1992 |
| RU | 81516 | U1 | 3/2009 |
| RU | 96904 | U1 | 8/2010 |
| RU | 137053 | U1 | 1/2014 |
| SU | 1461858 | A1 | 2/1989 |
| SU | 1686052 | A1 | 10/1991 |
| WO | WO-2004094762 | A2 | 11/2004 |
| WO | WO-2009002189 | A1 | 12/2008 |
| WO | WO-2010132174 | A1 | 11/2010 |

OTHER PUBLICATIONS

"U.S. Appl. No. 15/051,800, Non-Final Office Action dated Jan. 30, 2017", 16 pgs.

"U.S. Appl. No. 15/051,800, Non-Final Office Action dated Oct. 13, 2017", 5 pgs.

"U.S. Appl. No. 15/051,800, Notice of Allowance dated Jan. 22, 2018", 5 pgs.

"U.S. Appl. No. 15/051,800, Notice of Allowance dated Jun. 28, 2017", 10 pgs.

"U.S. Appl. No. 15/051,800, Preliminary Amendment filed Mar. 17, 2016", 6 pgs.

(56) References Cited

OTHER PUBLICATIONS

"U.S. Appl. No. 15/051,800, Response filed May 1, 2017 to Non-Final Office Action dated Jan. 30, 2017", 10 pgs.
"U.S. Appl. No. 15/051,800, Response filed Dec. 11, 2017 to Non-Final Office Action dated Oct. 13, 2017", 6 pgs.
"U.S. Appl. No. 15/051,800, Response filed Dec. 12, 2016 to Restriction Requirement dated Oct. 12, 2016", 7 pgs.
"U.S. Appl. No. 15/051,800, Restriction Requirement dated Oct. 12, 2016", 8 pgs.
"U.S. Appl. No. 15/051,800, Supplemental Amendment filed Sep. 28, 2017", 7 pgs.
"Blue Calypso", *LLC* v. *Groupon, Inc.* CAFC, (Mar. 1, 2016), 46 pgs.
"European Application Serial No. 12791970.2, Extended European Search Report dated Sep. 2, 2015", 8 pgs.
"European Application Serial No. 12791970.2, Response filed Mar. 9, 2016 to Extended European Search Report dated Sep. 2, 2015", 32 pgs.
"In re Wolfensperger", 302 F.2d 950 (CCPA 1962), (May 18, 1962), 8 pgs.
"International Application Serial No. PCT/CA2012/000510, Response filed Mar. 14, 2013 to Written Opinion dated Aug. 24, 2012".
"International Application Serial No. PCT/CA2012/000510, Written Opinion dated Aug. 24, 2012", 3 pgs.
"International Application Serial No. PCT/CA2015/000432, International Search Report dated Sep. 24, 2015", 3 pgs.
"International Application Serial No. PCT/CA2015/000432, Written Opinion dated Sep. 24, 2015", 5 pgs.
"International Application Serial No. PCT/CA2016/000229, International Search Report dated Oct. 26, 2016", 3 pgs.
"International Application Serial No. PCT/CA2016/000229, Written Opinion dated Oct. 26, 2016", 5 pgs.
"International Application Serial No. PCT/US2014/037431, International Search Report dated Oct. 7, 2014", 2 pgs.
"International Application Serial No. PCT/US2014/037431, Written Opinion dated Oct. 7, 2014", 6 pgs.
"International Application Serial No. PCT/US2016/019507, International Search Report dated Dec. 21, 2016", 6 pgs.
"International Application Serial No. PCT/US2016/019507, Written Opinion dated Dec. 21, 2016", 9 pgs.
"International Application Serial No. PCT/US2017/021095, International Search Report dated Jun. 12, 2017", 5 pgs.
"International Application Serial No. PCT/US2017/021095, Written Opinion dated Jun. 12, 2017", 9 pgs.
"National Oilwell Varco Elevator/Substructure/Setback Cross-Section drawing", (Jul. 24, 1979), 1 pg.
"National Oilwell Varco Mast & Substructure Erection Sequence drawing", (Sep. 15, 1979), 1 pg.
"Photograph of Uralresh rig", (Jul. 2014), 1 pg.
"Photographs of typical Uralmesh train rig", (Sep. 2012), 2 pgs.

* cited by examiner

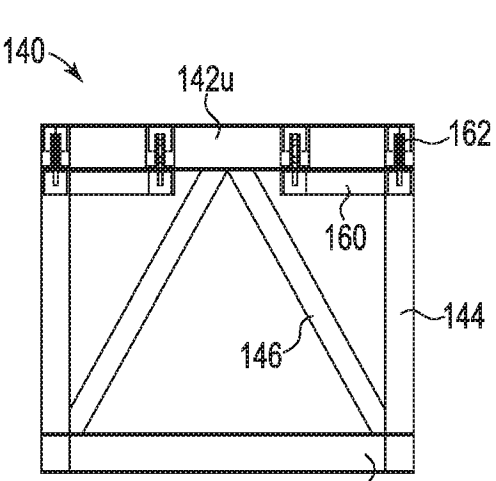
FIG. 4A
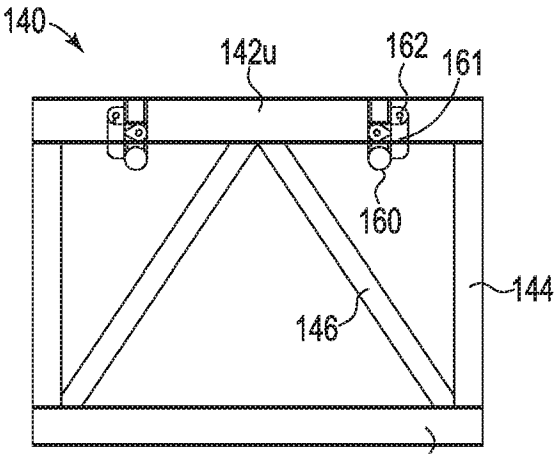
FIG. 4B
FIG. 4C

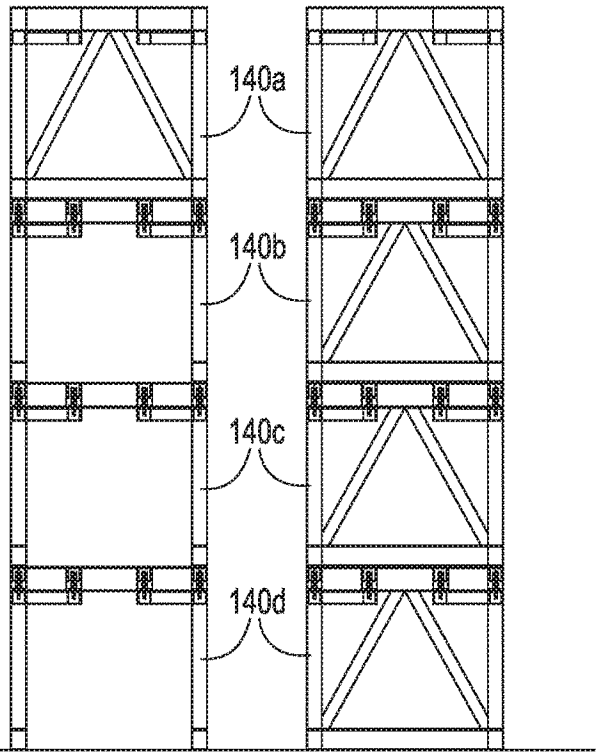
FIG. 35A
FIG. 35B
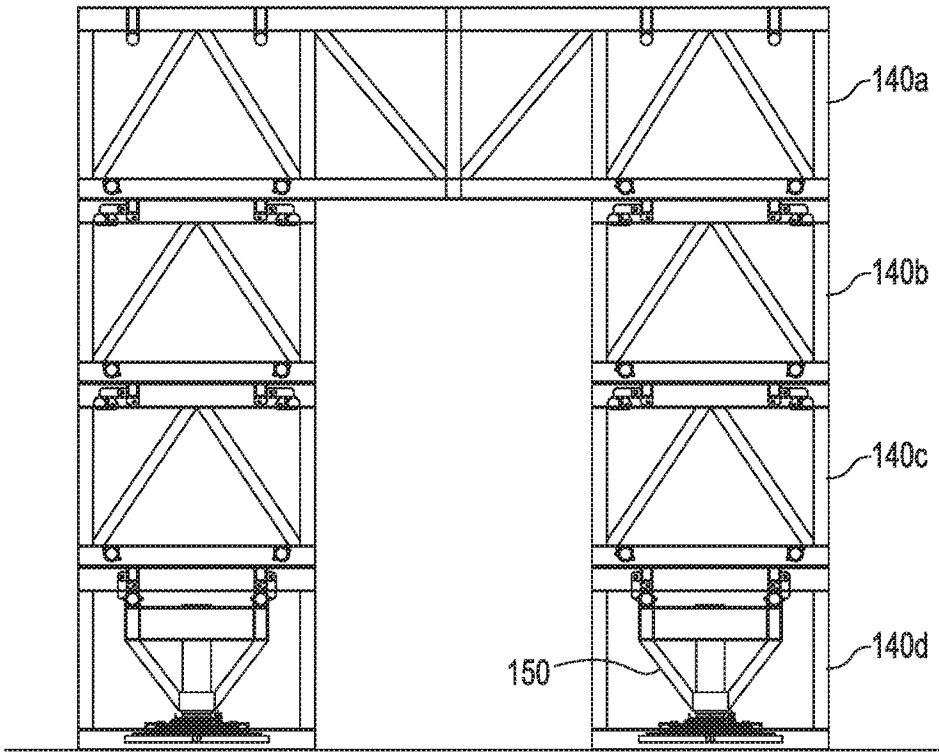
FIG. 34

DRILLING RIG WITH SELF-ELEVATING DRILL FLOOR

CROSS-REFERENCE TO RELATED APPLICATIONS

The present application is a divisional of U.S. application Ser. No. 15/051,800 filed Feb. 24, 2016, which application is hereby incorporated by reference herein in its entirety.

FIELD OF THE INVENTION

The present application is generally directed to drilling rig assemblies. Particularly, the present application relates to elevated platforms, tables, decks, floors, or other elevated surfaces and constructing, installing, erecting, or building such surfaces. More particularly, the present application relates to a drilling rig having a self-elevating drill floor.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In many land-based oil and gas drilling operations, drilling rigs may be delivered to an oilfield drilling site by transporting various components of the drilling rig over roads, highways, and/or railroads. The various drilling rig components may be transported to a drilling site on one or more truck/trailer combinations, rail cars, or other modes of transportation, the number of which may depend on the size, weight, and complexity of the rig. Once at the drilling site, the drilling rig components may be assembled, and the drilling rig assembly may be raised to an operating position so as to perform drilling operations. After the completion of drilling operations, the drilling rig may be lowered, disassembled, loaded back onto truck/trailer combinations, rail cars, or other modes of transportation, and transported to a different oilfield drilling site for new drilling operations. Accordingly, the ease with which the various drilling rig components can be transported, assembled and disassembled, and raised and lowered can be a substantial factor in the drilling rig design, as well as the rig's overall operational capabilities and cost effectiveness.

Moreover, in particular parts of the world, access to cranes or other equipment for assembling and disassembling operations may be relatively limited and, in particular, the availability of large, high lifting cranes may be limited. Where a large drilling rig with a high floor height is desired to provide for deep drill depths and high drilling capacities, the absence of large crane availability may create difficulties or impasses in assembly and disassembly of drilling rigs.

In some applications, drilling operations at a given oilfield drilling site may involve drilling a plurality of relatively closely spaced wellbores, sometimes referred to as "pad" drilling. In pad drilling, the distance between adjacent wellbores may be as little as 20-30 feet or less in some applications. The plurality of wellbores are often arranged in a two-dimensional grid pattern, such that rows and columns of wellbores may be disposed along lines running substantially parallel to an x-axis and a y-axis, respectively. In such pad drilling applications, after drilling has been completed at one wellbore, the drilling rig may be moved to an adjacent wellbore. Often, after drilling operations have been completed at the pad site, the drilling rig may be relocated to a different drill site, which may also be a pad site.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a method for elevating a drill floor of a drilling rig. The method may include: (a) using at least one jacking system, raising the drill floor such that the dead load of the drilling rig is transferred to the at least one jacking system; (b) inserting a layer of substructure boxes beneath the drill floor; (c) using the at least one jacking system, lowering the drill floor onto the layer of substructure boxes, such that the dead load of the drilling rig is transferred from the at least one jacking system to the layer of substructure boxes; and (d) coupling the layer of substructure boxes to the drill floor. In some embodiments, the method may include repeating steps (a) through (d) until a desired drill floor height is reached. In some embodiments, the jacking system may be a telescoping jacking system. Further, in some embodiments, the jacking system may have a skid foot movement mechanism. The skid foot movement mechanism may allow the drilling rig to be moved in each of a latitudinal and a longitudinal direction. In some embodiments, inserting a layer of substructure boxes may include arranging a substructure box around a jacking system, such that the jacking system is at least partially housed within the substructure box. In some embodiments, four jacking systems may be used to raise and lower the drill floor, and inserting a layer of substructure boxes may include arranging the layer of substructure boxes into at least one tower configuration. In some embodiments, the drill floor may include a first layer of substructure boxes, and raising the drill floor may include coupling the jacking system to the first layer of substructure boxes and raising the drill floor and first layer of substructure boxes a distance off the ground surface. In some embodiments, the at least one substructure box may include a first layer of substructure boxes, and the method may further include: (e) using the at least one jacking system, raising the drill floor and the first layer of substructure boxes such that the dead load of the drilling rig is transferred to the at least one jacking system; (f) inserting a second layer of substructure boxes beneath the first layer of substructure boxes, the second layer comprising at least one substructure box; (g) using the at least one jacking system, lowering the drill floor and the first layer of substructure boxes onto the second layer of substructure boxes, such that the dead load of the drilling rig is transferred from the at least one jacking system to the second layer of substructure boxes; (h) and coupling the second layer of substructure boxes. Additionally, the method may include repeating steps (e) through (h) until a desired drill floor height is reached.

Additionally, the present disclosure, in one or more embodiments, relates to a method for elevating a drill floor of a drilling rig, wherein the drill floor is supported by at least one substructure column. The method may include (a) using a jacking system, raising the drill floor and the substructure column a distance off of the ground surface; (b) inserting a substructure box beneath the column, such that the substructure box is arranged about the jacking system; (c) using the jacking system, lowering the drill floor and substructure column onto the substructure box; (d) coupling the substructure box to the column; and (e) repeating steps (a) through (d) until a desired drill floor height is achieved. In some embodiments, the substructure box may be a C-shaped substructure box. Raising the drill floor may include coupling the jacking system to the substructure column, and raising the drill floor and substructure column a distance off of the ground surface. In some embodiments, the jacking system may be a telescoping jacking system. The jacking system may additionally or alternatively include a skid foot movement mechanism. The skid foot movement mechanism may allow the drilling rig to be moved in each of a longitudinal and a latitudinal direction.

Additionally, the present disclosure, in one or more embodiments, relates to a drilling rig with a self-elevating drill floor. The drilling rig may include a mast, a drill floor supporting the mast, a substructure comprising one or more columns of substructure boxes, and a jacking system comprising a telescoping cylinder and a skid movement mechanism. The jacking system may be configured to use the telescoping cylinder to raise the drill floor such that one or more substructure boxes may be inserted beneath the drill floor, and use the skid movement mechanism to skid the drilling rig in each of a latitudinal and longitudinal directions. In some embodiments, the one or more substructure boxes may be a C-shaped substructure box. Further, the jacking system may be configured to raise the drill floor by coupling to the substructure and raising the drill floor and substructure a distance off of the ground surface.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

FIG. 4A is a left side view of a substructure box according to one or more embodiments.

FIG. 4B is front side view of the substructure box of FIG. 4A, according to one or more embodiments.

FIG. 4C is a right side view of the substructure box of FIG. 4A, according to one or more embodiments.

FIG. 34 is a side view of first, second, third, and fourth layers of substructure boxes with jacking systems secured to the fourth layer of substructure boxes, according to one or more embodiments.

FIG. 35A is a side view of a vertical stack of substructure boxes, according to one or more embodiments.

FIG. 35B is an opposing side view of the vertical stack of substructure boxes of FIG. 35A, according to one or more embodiments.

DETAILED DESCRIPTION

The present disclosure, in one or more embodiments, relates to a drilling rig with a self-elevating drill floor. The drilling rig may have one or more jacking systems that may operate to raise the drill floor. The one or more jacking systems may raise the drill floor to a height sufficient to accommodate a substructure such as a substructure box. A substructure box may be placed, and the one or more jacking systems may lower the drill floor onto the substructure box. Substructure boxes may be placed beneath the drill floor, using the one or more jacking systems, until a desired drill floor height is reached.

A self-elevating drill floor of the present disclosure may allow a drilling rig to be erected or partially erected at a drilling site, for example, using relatively low capacity trucks, bull dozers, cranes, such as rubber tire cranes, and/or other relatively low capacity vehicles. In this way, the use of high lift cranes to erect the drilling rig, or at least a portion of the drilling rig, may be avoided. In some embodiments, the one or more jacking systems may additionally operate to move the drilling rig, for example between adjacent wells on a pad drilling site. The jacking systems may operate the move the drilling rig using walking feet or another movement mechanism. This may allow the drilling rig to be moved, such as between adjacent wells on a pad drilling site, without the need for disassembly of the rig between wells.

Figure 1:
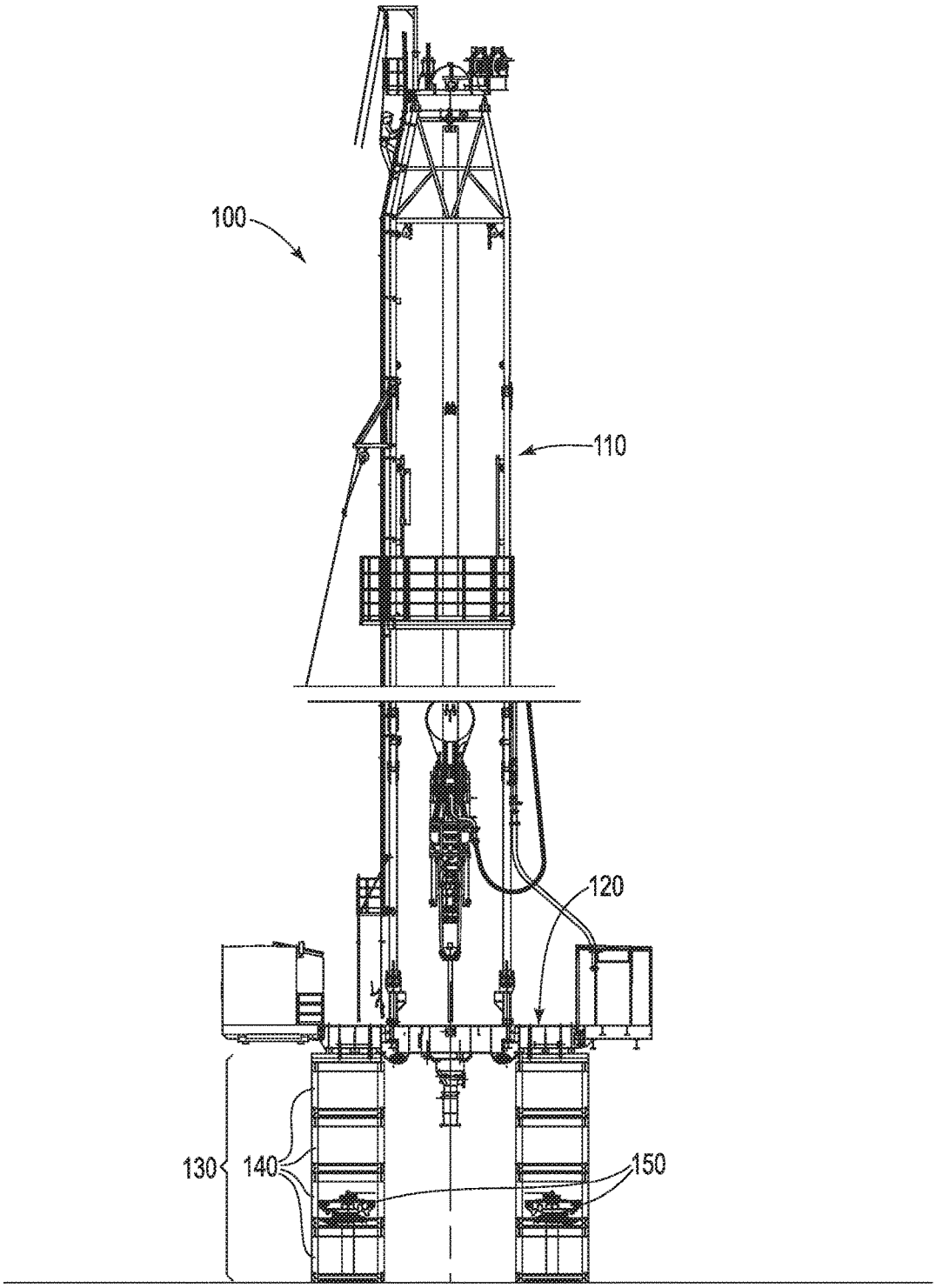
FIG. 1 is a side view of a drilling rig, according to one or more embodiments.

A drilling rig 100 with a mast 110, a drill floor 120, and a substructure 130 is shown in FIG. 1. The mast 110 and drill floor 120 may be supported, at least in part, by the substructure 130. The substructure 130 may have one or more substructure boxes 140. Substructure boxes 140 may be vertically stacked on one another, as shown in FIG. 1. The substructure boxes 140 may be arranged so as to distribute the weight of the rig 100. For example, the rig 100 may be supported by a vertical stack of substructure boxes 140 at each corner of the drill floor 120. In other embodiments, more or fewer stacks of substructure boxes 140 at different locations may support the drilling rig 100. The drilling rig 100 may have one or more jacking systems 150. For example, a jacking system 150 may be housed within each vertical stack of substructure boxes 140. Each jacking system 150 may operate to raise the drilling rig 100 vertically, and in some cases off of the ground. The jacking systems 150 may be used to raise the rig 100 so as to add a substructure box 140 to each vertical stack, or to remove a substructure box from each stack. Additionally or alternatively, the jacking systems 150 may operate as walking feet to facilitate horizontal movement of the rig 100 along the ground surface.

Figure 3A:
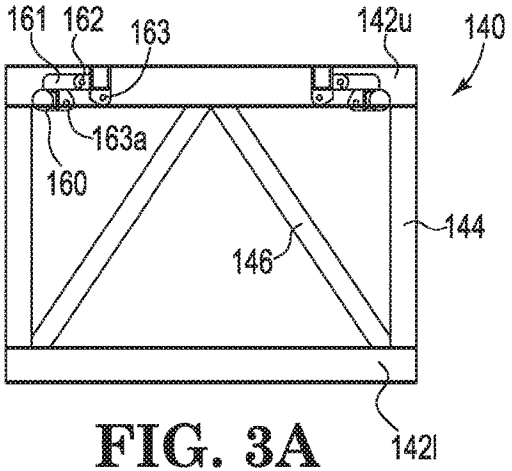
FIG. 3A is a side view of a substructure box with support bars in a clearance position, according to one or more embodiments.
Figure 2A:
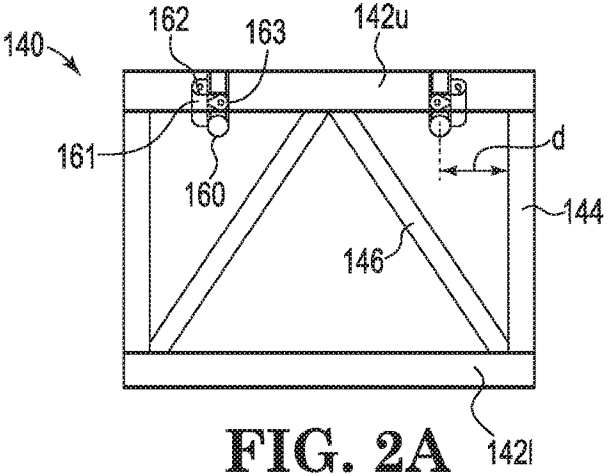
FIG. 2A is a side view of a substructure box with support bars in a lifting position, according to one or more embodiments.

Each substructure box 140 may have generally any suitable size and shape. In some embodiments, a substructure box 140 may have a rectangular shape, as shown in FIGS. 2-3. In some embodiments, the substructure box 140 may have a height, depth, and width of approximately 6 feet. In other embodiments, a substructure box 140 may have any suitable height, depth, and width, or other dimensions. In some embodiments, substructure boxes 140 of differing shapes and/or sizes may be used. A substructure box 140 is shown from a side view in FIGS. 2A and 3A. Each substructure box 140 may include a plurality of horizontal 142, vertical 144, and cross 146 members. For example, in some embodiments, a substructure box 140 may have four upper horizontal members 142*u* defining a face, such as an upper face of the box, and four lower horizontal members 142*l*, defining an opposing face, such as a lower face of the box. From the side views of FIGS. 2A and 3A, one horizontal member 142 at each of the upper and lower faces is shown. Upper and lower horizontal members may have wide flange shapes, as shown in FIGS. 2A and 3A, tube shapes, angle shapes, channel shapes, or any other structural steel shape or design. A substructure box 140 may additionally, in some embodiments, have a plurality of vertical members 144 between the upper and lower faces defined by the horizontal members 142. For example, a substructure box 140 may have a vertical member 144 connecting each of four opposing corners of the upper and lower faces. From the side views of FIGS. 2A and 3A, two such vertical members 144 are shown. Vertical members may have wide flange shapes, tube shapes, angle shapes, channel shapes, or any other structural steel shape or design. Additionally, in some embodiments, a substructure box 140 may have at least two cross members 146 on one or more faces of the rectangular box. From the side views of FIGS. 2A and 3A, two cross members are shown. Cross members may have wide flange shapes, tube shapes, angle shapes, channel shapes, or any other structural steel shape or design. The horizontal 142, vertical 144, and cross 146 members may generally define a hollow space within the substructure box 140. In other embodiments, a substructure box 140 may have any suitable number of horizontal 142, vertical 144, and cross 146 members.

A substructure box 140, including horizontal 142, vertical 144, and cross 146 members, may be composed of any suitable material. In some embodiments, a substructure box may be composed of steel, aluminum, or any suitable metal or metal composite. In other embodiments, a substructure box 140 may be composed of wood, plastic, concrete, or any other suitable material. In some embodiments, some of the horizontal 142, vertical 144, and/or cross 146 members may be composed of a different material than other members. In some embodiments, a substructure box 140 may have panels or siding on one or more sides of the box. For example, a rectangular substructure box 140 having four vertical sides and two horizontal sides may have panels or siding on three vertical sides, thus partially enclosing the box. In other embodiments, a substructure box 140 may have a more open box design, such that the box is defined by members 142, 144, 146 with little or no siding or other substantial structural elements. In some embodiments, a substructure box 140 may have forklift pockets or other means to facilitate lifting or moving the box.

In some embodiments, a substructure box may have at least one face with limited cross members and limited upper and lower horizontal members or siding. For example, as seen from the top views of FIGS. 2B and 3B, at least one side of the substructure box 140 may have a gap in an upper horizontal member 142*u*. That is, the top of at least one vertical side face may be defined by an upper horizontal member 142*u* having first and second portions separated by a gap. Each portion of the upper horizontal member 142*u* may extend from a perpendicular upper horizontal member on a connecting side face to an intermediate member 164 in some embodiments. FIGS. 4A, 4B, and 4C illustrate the substructure box 140 from three different side views, respectively. While FIGS. 4B and 4C illustrate first and second vertical faces having horizontal 142, vertical 144, and cross members 146, FIG. 4A shows a third vertical side face without cross members or a lower horizontal member 142*u*. In this way, it may be appreciated that the substructure box 140 may have a squared C-shape defined by the horizontal 142 and cross 146 members of three vertical side faces and an open fourth vertical side face.

Figure 3B:
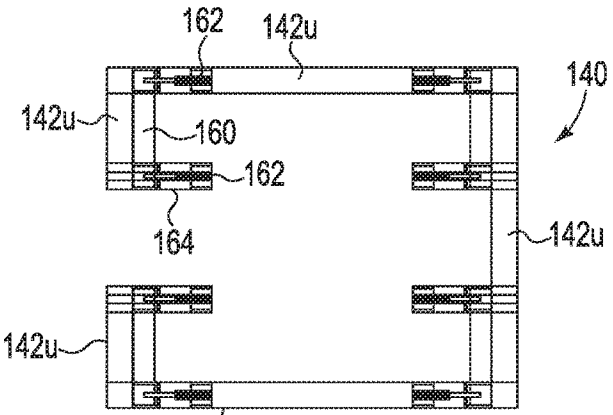
FIG. 3B is a top down view of the substructure box of FIG. 3A.
Figure 2B:
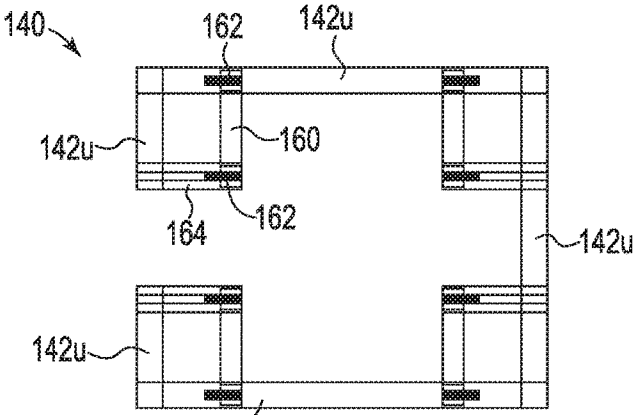
FIG. 2B is a top down view of the substructure box of FIG. 2A.

As shown in FIG. 2A, a substructure box 140 may have one or more support bars 160 coupled to the substructure box. A support bar 160 may be generally configured for providing a support or a lift point for engagement by a jacking system 150 to raise or lower the box 140. A support bar 160 may be positioned at or near one surface of the substructure box 140, such as the upper end defined by the four upper horizontal members 142*u*, in some embodiments. As shown in FIG. 2B, a support bar 160 may be positioned generally parallel to two upper horizontal members 142*u* and perpendicular to two upper horizontal members. A support bar 160 may have any suitable length. In some embodiments, a support bar 160 may span the depth or width of the substructure box 140, connecting to the box at each of two horizontal members 142, for example. In other embodiments, a support bar 160 may span less than the full depth or width of the substructure box 140, as shown in FIG. 2B. A support bar 160 may have any suitable cross sectional shape. For example, in some embodiments, a support bar 160 may have a round, rectangular, or other cross sectional shape. Further, a support bar 160 may have any suitable cross sectional size. Generally, the size and shape of the cross section of the support bar 160 may be configured to operate in conjunction with a jacking system 150, as discussed more fully below, where the support bar is shaped for seating within a saddle of the jacking system. A support bar 160 may be a steel, aluminum, wood, plastic, or other material bar.

Where a support bar 160 spans less than the full width or depth of the substructure box 140, the support bar may be coupled to a horizontal member 142 at or near one end of the bar, and to an intermediate member 164 at or near an opposing end of the bar. An intermediate member 164 may be a cantilevered member extending from a horizontal member 142 within the substructure box 140. In some embodiments, an intermediate member 164 may have one or more gussets or brackets configured to stiffen the member against upward rotation. An intermediate member 164 may have generally any suitable size and cross sectional shape. Further, an intermediate member 164 may be a steel, aluminum, wood, plastic, or other material member. In other embodiments, a support bar 160 may connect at or near both ends to intermediate members 164. In still other embodiments, a support bar 160 may connect to the substructure box 140 at other locations along the bar and to various points of the box. A substructure box 140 may have any suitable number of support bars 160. In some embodiments, a substructure box 140 may have four support bars 160, as shown in FIGS. 2B and 3B.

A support bar 160 may connect to the substructure box 140 using one or more hinged connections 162. For example, a support bar 160 may have a hinged connection 162 at or near each end of the support bar, connecting the support bar to the box. For example, as shown in FIG. 2B, each support bar 160 may connect to a horizontal member 142 with a first hinged connection 162 and an intermediate member 164 with a second hinged connection. The hinged connections 162 may use any suitable hinge mechanism. In other embodiments, one or more support bars 160 may couple to the substructure box 140 using a fixed connection or any other type of connection or coupling mechanism. In some embodiments, a hinged connection 162 may include a swing arm 161 and a stopping element 163.

In some embodiments, a support bar 160 may couple to the hinged connection 162 via a swing arm 161. A swing arm 161 may be a connector extending from the hinged connection 162 and configured to rotate with the support bar 160 and position the support bar a distance away from the hinge. The swing arm 161 may generally be positioned perpendicular to the support bar 160. As with the support bar 160, a swing arm 161 may have a lifting position, as shown in FIG. 2A, and a clearance position, as shown in FIG. 2B. In the clearance position, a swing arm 161 may generally be positioned adjacent to a face, such as an upper face of the substructure box. The swing arm 161 may be configured to rotate downward into a lifting position. The swing arm 161 may generally have any suitable size and shape configured to position the support bar 160. The swing arm 161 may be constructed of steel, aluminum, wood, plastic, or any suitable material.

A stopping element 163 may be configured to provide a stopping point for the hinged mechanism 162. For example, in some embodiments, the stopping element 163 may stop the swinging action of the hinged mechanism 162 such that swing arm 161 and support bar 160 are positioned in the lifting position. That is, the stopping element 163 may prevent the swing arm 161 and support bar 160 from swinging further inward than the lifting position. The stopping element 163 may be a stationary element extending from a member of the substructure box 140, such as an upper horizontal member 142*u*, as shown in FIGS. 2A and 3A. In some embodiments, a stopping element 163 may be configured to operate in conjunction with an secondary stopping element 163*a*. For example, the secondary stopping element 163*a* may be positioned on or near the support bar 160 and/or swing arm 161, as shown in FIG. 3A, such that the element may rotate with the swing arm and support bar. The secondary stopping element 163*a* may be configured to couple to, fit within, receive, join with, or generally be positioned adjacent to the stopping element 163. In this way, as the support bar 160 and swing arm 161 swing downward on the hinged mechanism 162 into the lifting position, the stopping element 163 and secondary stopping element 163*a* may connect to prevent the support bar and swing arm from rotating further inward.

The hinges 162 may be configured such that the support bars 160 may move radially upward and outward, away from the center of the substructure box 140. The hinges 162 may be configured to move the support bars 160 approximately 90 degrees from a lifting position to a clearance position. FIGS. 2A and 2B illustrate the support bars 160 in a lifting position, according to some embodiments, while FIGS. 3A and 3B illustrate the support bars in a clearance position, according to some embodiments.

As described more fully below, support bars 160 may be configured for providing a lift point for engagement by a jacking system 150 to raise and lower the substructure box 140. It may be appreciated that providing two aligned support bars 160, each configured between a horizontal member 142 and an intermediate member 164, rather than a continuous support bar spanning between the horizontal members 142 may distribute the lifting load of the box 140 members of all four side faces of the box.

Each support bar 160 may be configured to rotate from a lifting position, as shown in FIGS. 2A and 2B to a clearance position, as shown in FIGS. 3A and 3B. As shown, the support bars 160 may be positioned generally perpendicular to two upper horizontal members 142*u* of the substructure box 140, and generally parallel to two upper horizontal members of the substructure box. It may be appreciated the support bars 160 may thus each be perpendicular to two lower horizontal members 142*l* and parallel to two lower horizontal members. In the lifting position, the support bars 160 may each be positioned a distance (d) away from a closest, parallel upper horizontal member 142*u*. In some embodiments, distance (d) may generally be the distance between a hinged connection 152 of the bar and a closest, parallel upper horizontal member 142*u*. In the lifting position, the hinged connections 162 may position each support bar 160 vertically lower than the upper horizontal members 142*u*, as shown in FIG. 2A. In the lifting position, the support bars 160 may be positioned below the upper horizontal members 142*u* with enough clearance such that the jacking system 150 may suitably couple to the bars. To move to a clearance position, the support bars 160 may swing upward and outward from the lifting position, each bar moving toward its closest, parallel upper horizontal member 142*u*. As shown in FIGS. 3A and 3B, each support bar 160 may be positioned adjacent to its closest, parallel upper horizontal member 142*u* in the clearance position. The hinged mechanisms 162 and swing arms 161 may move the support bars 160 automatically or manually between the lifting and clearance positions. In some embodiments, for example, the hinged mechanisms 162, swing arms 161, and/or support bars 160 may be hydraulically actuated and/or locked into position. It may be appreciated that in other embodiments, the support bars 160 may be fixed in a lifting position, clearance position, or other configuration.

Figure 5:
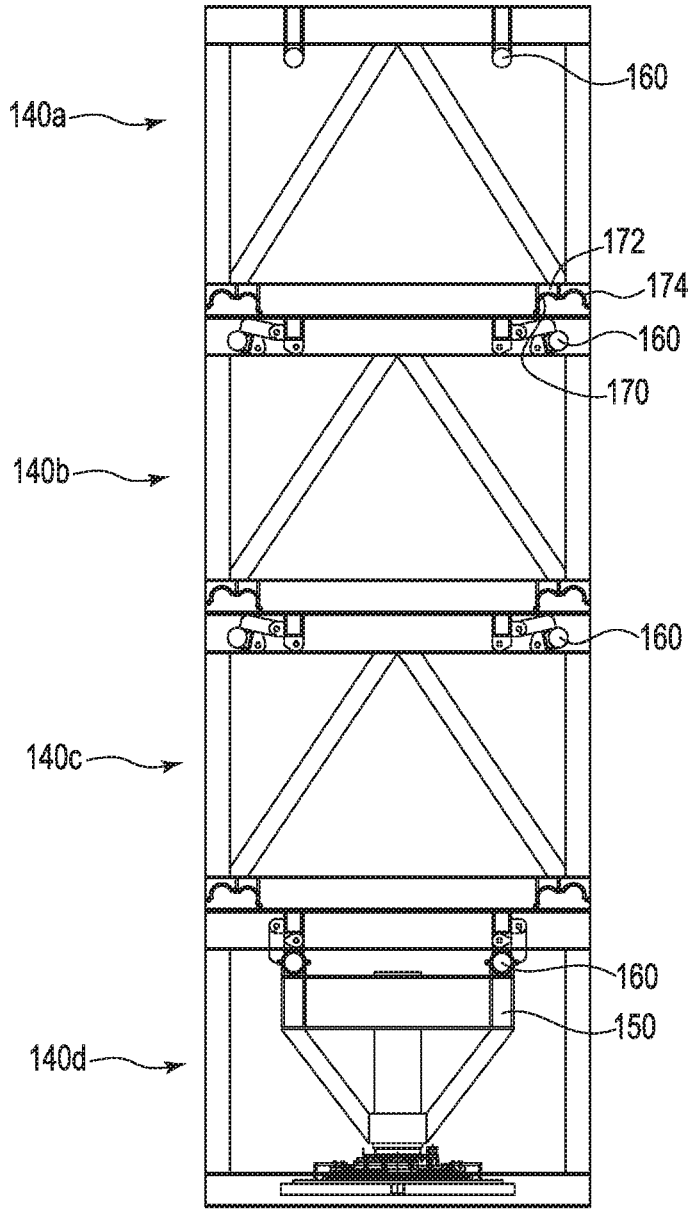
FIG. 5 is a side view of a vertical stack of substructure boxes, according to one or more embodiments.

In some embodiments, a support bar 160, hinged mechanism 162, and swing arm 161 may additionally or alternatively be configured to couple stacked substructure boxes 140 together. For example, FIG. 5 illustrates a vertical stacks of substructure boxes 140 housing a lifting cylinder 150. The first substructure box 140*a* of the stack is shown with fixed support bars 160. The second 140*b* and third 140*c* substructure boxes are shown with support bars 160 in a clearance position. The fourth substructure box 140*d* is shown with support bars 160 in a lifting position. As shown, some substructure boxes 140 may have a coupling saddle 170 affixed to a coupling support 172 near a surface or face of the substructure box, such as a lower face defined by lower horizontal members 142*l*. The coupling support 172 may extend from a lower horizontal member 142*l* in some embodiments. In other embodiments, the coupling support 172 may extend from an intermediate member or other element coupled to or near the lower face of the box 140. The coupling support 172 may extend perpendicular to the lower horizontal members 142*l*. The coupling support 172 may have a coupling saddle 170. The coupling saddle 170 may be configured to couple to an object such as a support bar 160 of a substructure box 140. That is, each saddle 170 may generally be configured to receive a support bar 160, such that the support bar may be positioned within the saddle. In some embodiments, the saddle 170 may have a circular or semi-circular shape for receiving the support bar 160. In other embodiments, the saddle 170 may have any suitable shape. Each saddle 170 may have a cover or clamp 174 in some embodiments. The cover or clamp 172 may be configured to close over the support bar 160 or other object in order to secure the support bar to the saddle 170. The cover or clamp 174 may secure or help to secure a support bar 160 in place within the saddle 170. The cover or clamp 174 may prevent or mitigate movement of the support bar 160 within the saddle 170. In some embodiments, the cover or clamp 174 may be connected to the saddle 170 via a hinged connection, for example. The cover or clamp 174 may by controlled manually or automatically. For example, in some embodiments, the covers or clamps 174 may be hydraulically actuated and/or locked into place. In some embodiments, a substructure box 140 may have four coupling saddles 170 to correspond with four support bars 160 of an adjacent box. In other embodiments, a substructure box 140 may have any suitable number of coupling saddles 170.

Figure 6:
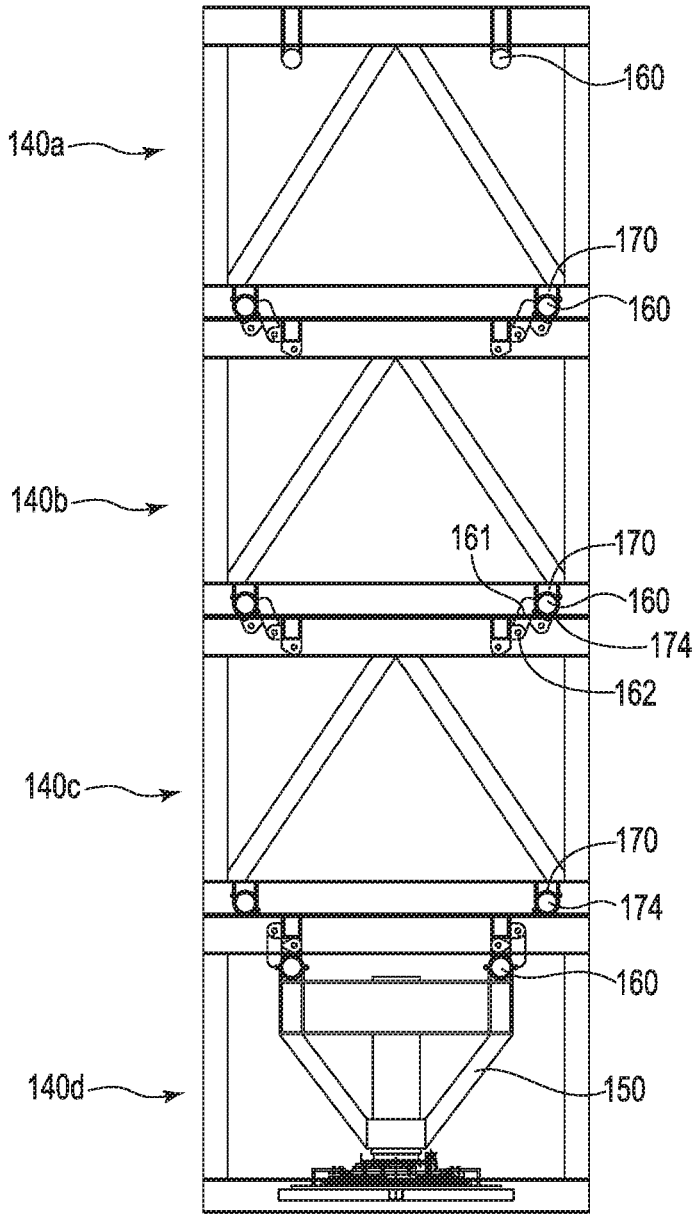
FIG. 6 is a side view of the vertical stack of substructure boxes of FIG. 5, with the first, second, and third layer of boxes coupled together, according to one or more embodiments.

With continue reference to FIG. 5, in some embodiments, support bar 160 and swing arm 161 may be configured to rotate upward and outward past the clearance position via the hinged mechanism 162. That is, the hinged mechanism 162 may have a range of rotation that allows the support bar 160 to swing upward into a coupling position, as shown in FIG. 6. The coupling position may position the support bar 160 above, or partially above, the upper face of the substructure box 140 defined by upper horizontal members 142*u*. In the coupling position, the support bar 160 may be configured to be positioned within the coupling saddle 170 of an adjacent box 140. FIG. 6 illustrates support bars 160 in coupling positions and arranged within coupling saddles 170. For example, the support bars 160 of the third substructure box 140*c* may swing upward into the coupling position to couple to the saddles 170 of the second substructure box 140*b*. As shown in FIG. 6, the covers or clamps 174 may close to lock the support bars 160 into place within the saddles 170.

Figure 7C:
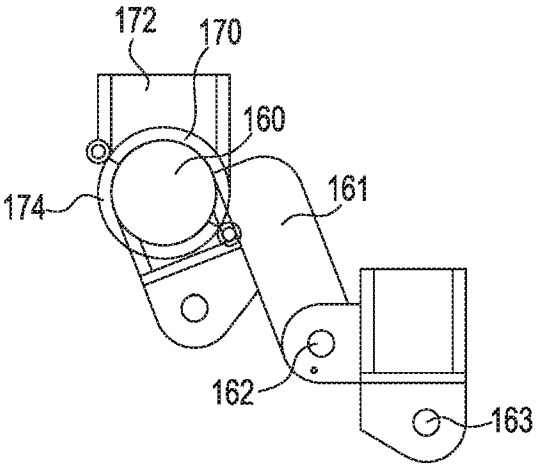
FIG. 7C is a side view of a support bar and swing arm in a coupling position, according to one or more embodiments.
Figure 7B:
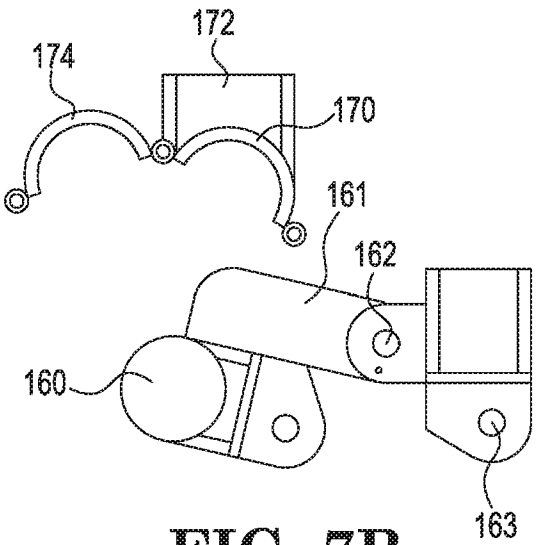
FIG. 7B is a side view of a support bar and swing arm in a clearance position, according to one or more embodiments.
Figure 7A:
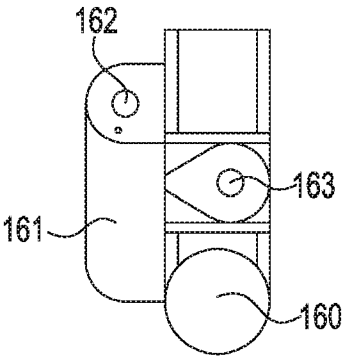
FIG. 7A is a side view of a support bar and swing arm in a lifting position, according to one or more embodiments.

Turning now to FIGS. 7A, 7B, and 7C, a support bar 160 and swing arm 161, and hinged mechanism 162 are shown in each of a lifting position, clearance position, and coupling position, respectively. FIG. 7B additionally shows a coupling saddle 170, coupling member 172, and clamp 174 positioned above the support bar 160. As shown in FIG. 7C, in the coupling position, the coupling saddle 170 may be engaged by the support bar 160, and the cover or clamp 174 may close over the support bar to secure it in place. In this way, an upper box having the coupling saddle 170 may be coupled to a lower box having the support bar 160. In other embodiments, other coupling mechanisms may be used to join adjacent substructure boxes 140. For example, substructure boxes 140 may be pinned together using lugs and pins in some embodiments. In other embodiments, adjacent boxes 140 may be clamped together using locks such as International Standards Organization (ISO) shipping container locks.

Figure 8B:
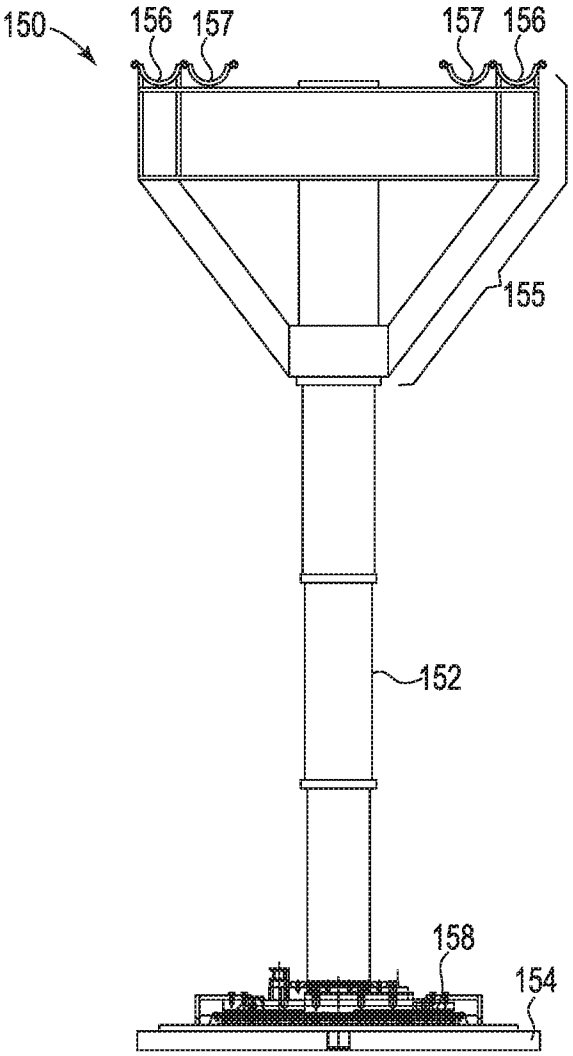
FIG. 8B is a side view of a jacking system in a raised position, according to one or more embodiments.
Figure 8A:
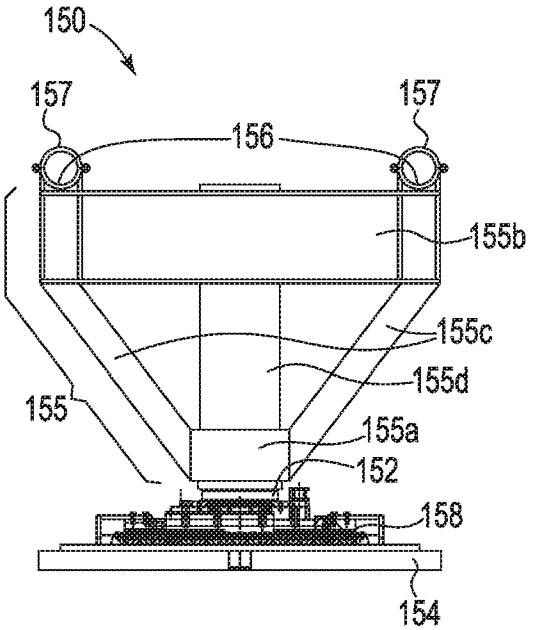
FIG. 8A is a side view of a jacking system in a lowered position, according to one or more embodiments.

A substructure box 140 may be configured to house a jacking system 150. A jacking system 150 may be or include a telescoping hydraulic and/or pneumatic lifting system having cylinders, screw and/or gear mechanisms, chain and sprocket mechanisms, cable and pulley/roller mechanisms, and/or other lifting mechanisms. FIG. 8A shows a jacking system 150 in a lowered position, and FIG. 8B shows a jacking system in a raised position. As shown in FIGS. 8A and 8B, the jacking system 150 may have a telescoping cylinder 152, a bearing plate 154, a head 155, and one or more saddles 156. The telescoping cylinder 152 may be configured to automatically lengthen or shorten. The bearing late 154 may be configured to bear a load, such as the load of the dead load of the drill rig 100, for example.

The telescoping cylinder 152 may be a hydraulic, pneumatic, or other extendable cylinder. In some embodiments, for example, the telescoping cylinder 152 may have a series of cylinders that progressively decrease in diameter, such that each cylinder may be configured to receive the next cylinder. In other embodiments, the telescoping cylinder 152 may use other mechanisms to lengthen and shorten. The telescoping cylinder 152 may generally facilitate raising and lowering of the head 155. The telescoping cylinder 152 may be comprised of steel or other materials. In some embodiments, the telescoping cylinder 152 may be a relatively large diameter and low pressure cylinder. In other embodiments, the telescoping cylinder 152 may have any suitable diameter and pressure.

The bearing plate 154 may be a steel or other plate configured to transfer the weight of the substructure 130 or drill rig 100 to the ground surface, drilling pad, or other surface. The bearing plate 154 may generally have any size and shape. The bearing plate 154 may generally be sized to provide a stable base when the telescoping cylinder 152 is extended. In some embodiments, the bearing plate 154 may be sized to facilitate lateral movement of the plate with respect to the telescoping cylinder 152, as described more fully below with respect to the walking apparatus.

The head 155 may be positioned on the telescoping cylinder 152 and may be configured with one or more attachment means, such as saddles 156. The head 155 may generally have any suitable shape configured to position the saddles 156. The head 155 may generally raise and lower as a unit coupled to the telescoping cylinder 152. In some embodiments, as shown in FIGS. 8A-8B, the head 155 may have a collar portion 155*a*, an upper portion 155*b*, one or more angled portions 155*c*, and a center portion 155*d*. The collar portion 155*a* may couple the head 155 to the telescoping cylinder 152. The collar portion 155*a* may generally have any shape, and in some embodiments, may be a circular ring shape that encircles the telescoping cylinder 152 and/or center portion 155*d*. The collar portion 155*a* may generally have any suitable thickness. One or more angled portions 155*c* may extend from the collar 155*a*. In some embodiments, four angled portions 155*c* may extend from the collar portion 155*a*. In some embodiments, the angled portions 155*c* may additionally or alternatively couple to or extend from the center portion 155*d*. The angled portions 155*c* may be configured to support the upper portion 155*b*. The angled portions 155*c* may have any suitable size and shape. The center portion 155*d* may generally be an extension of the telescoping cylinder 152 in some embodiments, and may provide a base for the head 155. For example, in some embodiments, the center portion 155*d* may be configured to receive or house the telescoping cylinder 152 when in a lowered position. The center portion 155*d* may have a cylindrical shape in some embodiments. In other embodiments, the center portion 155*d* may have any suitable shape. The center portion may extend to height higher than that of the upper portion 155*d*, as shown in FIGS. 8A-8B. The upper portion 155*b* may hold the saddles 156 or other attachment mechanisms. The upper portion 155*b* may be rectangular in some embodiments. For example, the upper portion 155*b* may have four straight members arranged in a rectangular configuration. In some embodiments, a saddle 156 may be arranged at each corner of the rectangular upper portion 155*b*. In other embodiments, the upper portion 155*b* may be round or have any suitable shape. In other embodiments, the head 155 may have other shapes or configurations.

Figure 11A:
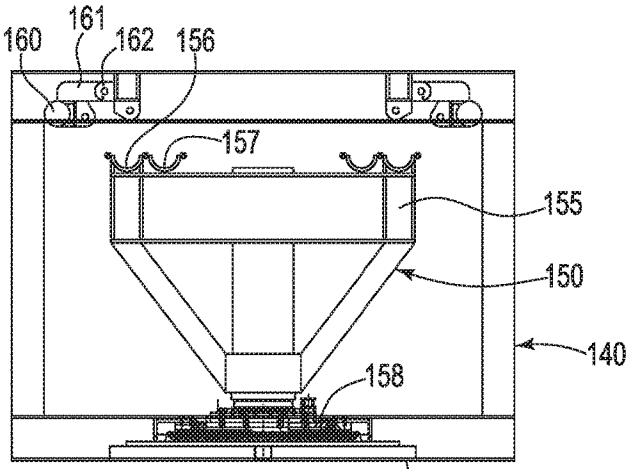
FIG. 11A is a side view of a jacking system arranged in a substructure box with support bars in a clearance position, according to one or more embodiments.
Figure 11B:
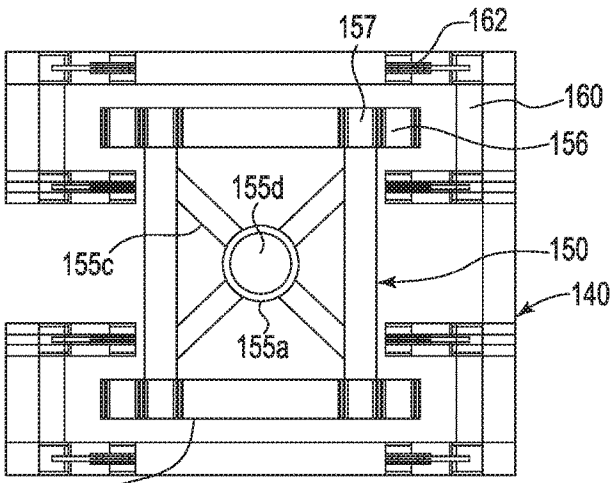
FIG. 11B is a top down view of the jacking system and substructure box of FIG. 11A.
Figure 10A:
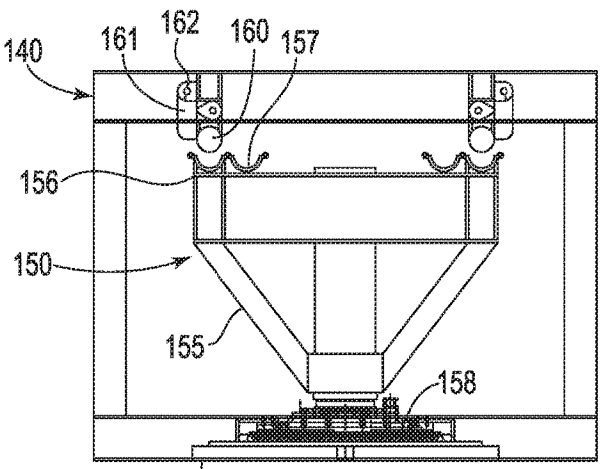
FIG. 10A is a side view of a jacking system arranged in a substructure box with support bars in a lifting position, according to one or more embodiments.
Figure 10B:
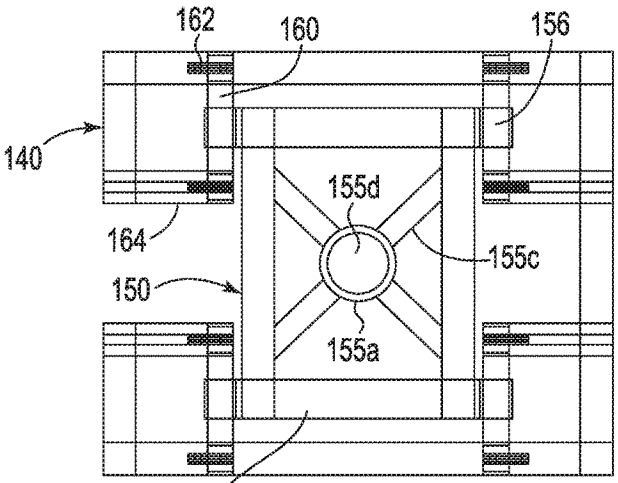
FIG. 10B is a top down view of the jacking system and substructure box of FIG. 10A.

In some embodiments, the head 155 may generally have an H-shape configured for operating within a substructure box 140, for example. Turning to FIGS. 10B and 11B, top down views of a jacking system 150 arranged within a substructure box 140 are shown with support bars 160 in a lifting position and in a clearance position, respectively. As shown in FIG. 11B, the head 155 may generally have an H-shaped configuration. For example, the upper portion 155*b* may have a rectangular shape. The saddles 156 may extend from each of four corners of the upper portion 155*b*, thus creating the H-shape. As shown in FIG. 11B, such an H-shape configuration may allow the jacking system 150 to raise and lower through the substructure box 140 when the support bars 160 of the box are in a clearance position, without disturbing the intermediate members 164, for example. As shown in FIG. 10B, the H-shape may additionally allow the jacking system 150 to couple to the support bars 160 without disturbing the intermediate members 164 or other components. That is, the four saddles 156 extending from the upper portion 155*b* may couple to each of the support bars 160 outside the rectangular frame of the upper portion. In other embodiments, the jacking system 150, head 155, and/or upper portion 155*b* may have any suitable shape or configuration.

With continued reference to FIGS. 8A-8B, the one or more saddles 156 may be configured to couple to an object such as a support bar 160 of a substructure box 140. That is, each saddle 156 may generally be configured to receive a support bar 160, such that the support bar may be positioned within the saddle. In some embodiments, the saddle 156 may have a circular or semi-circular shape for receiving the support bar 160. In other embodiments, the saddle 156 may have any suitable shape. Each saddle may have a cover or clamp 157 in some embodiments. The cover or clamp 157 may be configured to close over the support bar 160 or other object in order to secure the support bar to the saddle 156. The cover or clamp 157 may secure or help to secure a support bar 160 in place within the saddle 156. The cover or clamp 157 may prevent or mitigate movement of the support bar 160 during raising, lowering, or other movement of the substructure box 140 by the jacking system 150. In some embodiments, the cover or clamp 157 may be connected to the saddle 156 via a hinged connection, for example. The cover or clamp 157 may by controlled manually or automatically. For example, in some embodiments, the covers or clamps 157 may be hydraulically actuated and/or locked into place. In other embodiments, other coupling mechanisms may be used to couple a support bar 160 or other object to the jacking system 150. In some embodiments, a jacking system 150 may have four saddles 156 or other coupling mechanisms. In other embodiments, a jacking system 150 may have more or fewer saddles 156 or other coupling mechanisms.

Figure 9:
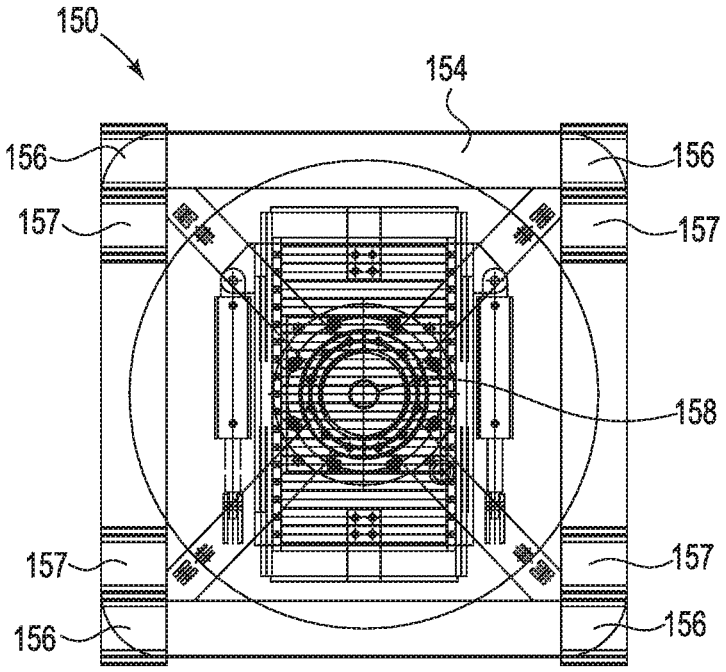
FIG. 9 is a top down view of a jacking system according to one or more embodiments.

In some embodiments, a jacking system 150 may additionally be or include a means for moving the drilling rig 100. For example, in some embodiments, a skid foot movement, or walking, apparatus 158 having one or more bearings may be positioned between and operatively coupled to each telescoping cylinder 152 and its respective bearing plate 154 so as to facilitate skid, or walking, movement of the drilling rig 100. That is, each bearing plate 154 may additionally operate as a skid foot for the walking apparatus 158. In this way, the bearing plate 154 may be wide enough to accommodate lateral movement along the bearings of the walking apparatus 158. FIG. 9 shows a top down view of a jacking system 150 with skid foot movement apparatus 158. In some embodiments, the skid foot movement or walking apparatus 158 may facilitate movement of the assembled drilling rig 100 between wellbore locations on a pad drilling site. A walking apparatus 158 may be configured to operate by way of a hydraulic pump, for example. In some embodiments, such a hydraulic pump may operate one or more walking apparatuses 158 on a drilling rig 100.

Figure 12B:
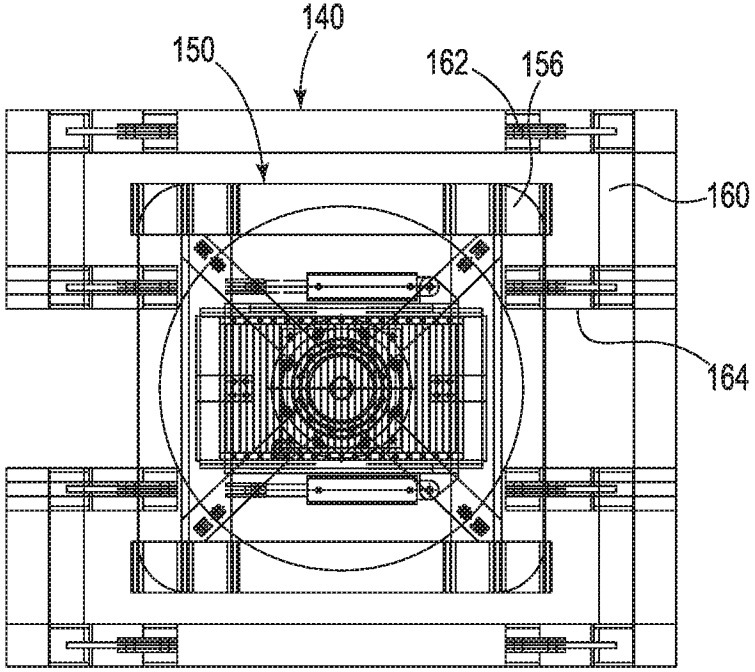
FIG. 12B is a top down view of a jacking system arranged in a substructure box with support bars in a clearance position, according to one or more embodiments.
Figure 12A:
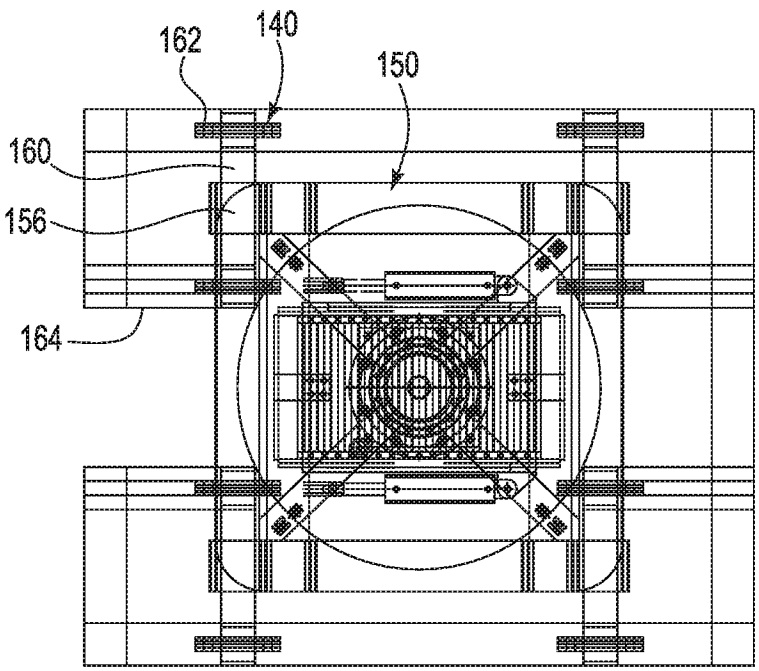
FIG. 12A is a top down view of a jacking system arranged in a substructure box with support bars in a lifting position, according to one or more embodiments.

The jacking system 150 may be configured to operate within one or more substructure boxes 140 in some embodiments. FIGS. 10-11 show side and top views of a jacking system 150 arranged within a substructure box 140. Each jacking system 150 may generally be configured to raise the substructure box 140 by attaching to the support bars 160 and operating the telescoping cylinder 152. As shown in FIG. 10A, the support bars 160 may generally be configured to be positioned within the saddles 156 of the jacking system 150. The jacking system 150 may raise slightly to attach to the support bars 160. When attached to the support bars 160, the jacking system 150 may operate to raise or lower on its telescoping cylinder 152 to raise or lower the substructure box 140. FIG. 10B shows a top down view of the jacking system 150 and substructure box 140 of FIG. 10A. FIGS. 11A-11B illustrate side and top views of the jacking system 150 within the substructure box 140 with the support bars 160 in a clearance position. As shown discussed above, the jacking system 150, including for example the head 155 of the jacking system, may generally have an H-shape configured to couple to the support bars 160 in a lifting position and/or clear the support bars in a clearance position, while also clearing the intermediate members 164, as shown in in FIGS. 10B and 11B. In some embodiments, a substructure box 140 may have limited or no cross members 146 or siding on a face, such as a top face shown in FIG. 11B, in order for a jacking system 150 to telescope through the box. FIGS. 12A and 12B show more detailed top down views of the jacking system 150 within a substructure box 140, wherein the bearing plate 152 and walking apparatus 158 may be seen.

Figure 13A:
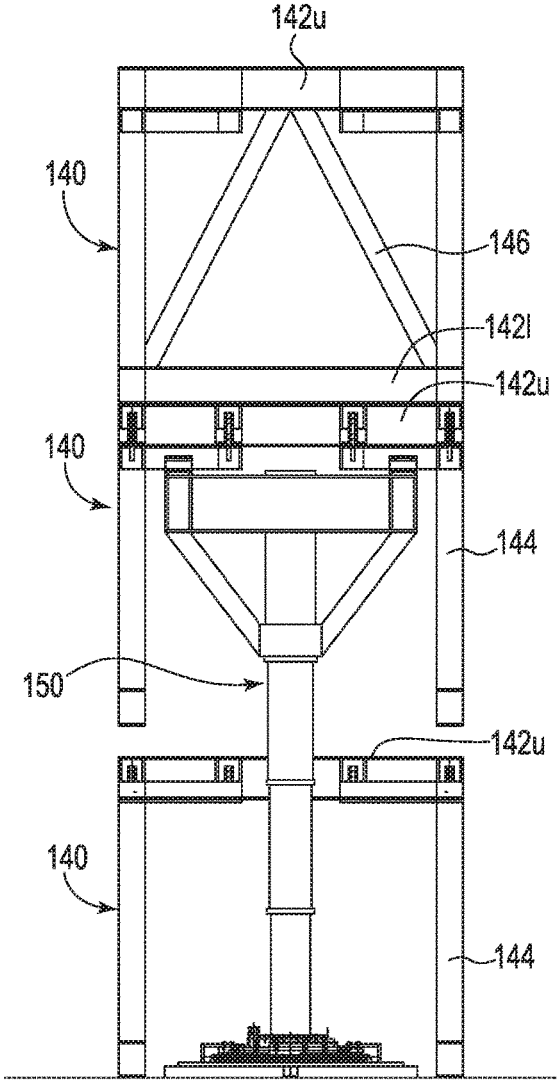
FIG. 13A is a side view of a vertical stack of two substructure boxes raised by a jacking system such that a third substructure box may be positioned beneath the stack, according to one or more embodiments.
Figure 13B:
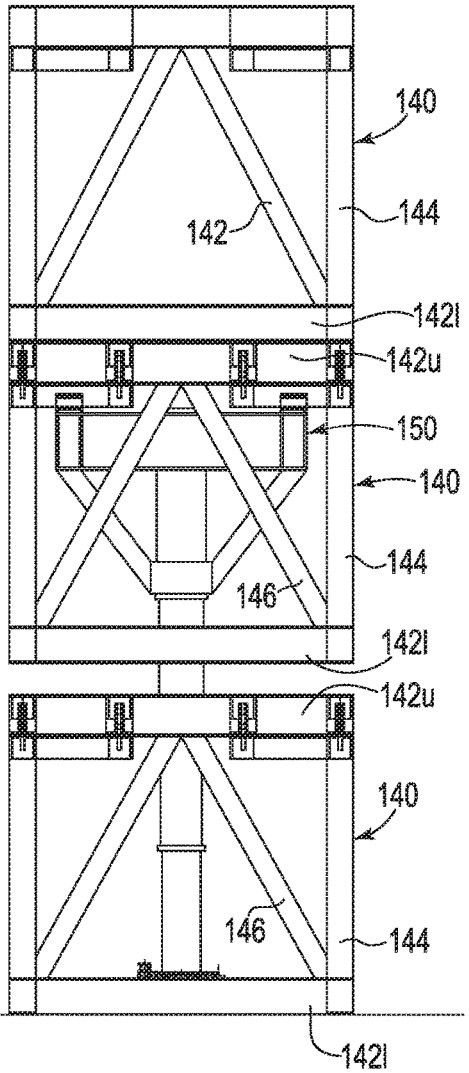
FIG. 13B is a side view of an opposing side of the vertical stack of boxes and jacking system of FIG. 13A, according to one or more embodiments.

It may be appreciated that the squared C-shape of the substructure box 140 may allow the box to receive the jacking system 150 such that the box may be slid or wrapped around the jacking system from the side. FIGS. 13A and 13B illustrate opposing side views of a jacking system 150 lifting a vertical stack of two substructure boxes 140 such that a third substructure box may be placed at the bottom of the vertical stack. FIG. 13A illustrates an uppermost substructure box 140 having a closed box shape, and a second and third lower boxes having a squared C-shape, as discussed above. That is, some substructure boxes 140 may at least one vertical side face with limited cross 146 and horizontal 142 members. In this way, the C-shaped substructure box 140 may be positioned around the lifted jacking system 150. The open vertical side face of the box 140 may accommodate the telescoping cylinder 154 and bearing plate 152 such that the box may be positioned about the jacking system 150 and beneath the vertical stack of boxes. FIG. 13B illustrates an opposing side view of the vertical stack of boxes 140 lifted by the jacking system 150 such that a third box may be positioned beneath the stack. The opposing vertical side face shown in FIG. 13B may have horizontal members 142 extending between vertical members 144, and cross members 146 extending between horizontal members.

When raising or lowering a substructure box 140, the jacking system 150 may generally exert a pushing or pulling force on the substructure bars 160. It may be appreciated that the hinged mechanisms 162 may be configured so as to prevent or mitigate the hinging motion during movement of the jacking system 150. Specifically, opposing sets of hinged mechanisms 162, swing arms 161, and stopping elements 163 may have opposite directional configurations. As shown for example in FIGS. 10A and 11A, two opposing hinged mechanisms 162 may be aligned with one another and may couple to opposing support bars 160. The two opposing hinged mechanisms 162 may be configured to rotate in opposing directions, such that for example, one support bar 160 is configured to rotate from the clearance position to the lifting position in a clockwise direction, while the opposing support bar is configured to rotate from the clearance position to the lifting position in a counterclockwise direction. In this way, opposing swing arms 161 and stopping elements 163 may likewise rotate in opposing directions. The opposing rotation directions, combined with the stopping elements 163, may generally prevent or mitigate rotation at the hinged mechanisms 162 while the substructure box 140 is raised, lowered, or otherwise moved on the jacking system 150.

While the support bars 160 are described as coupled to the substructure boxes 140, and the saddles 156 coupled to the jacking system 150, it may be appreciated that the positioning of the bars and saddles may be generally reversed. That is, in some embodiments, one or more support bars 160 may extend from a jacking system 150. Further, in some embodiments, one or more saddles 156, optionally having a clamp or cover 157, may extend from a substructure box 140. The one or more saddles 156 may open downward, so as to receive a support bar 160 from below. The one or more saddles 156 may be configured to rotate from a lifting position to a clearance position, and in some embodiments may each rotate on a swing arm 161 coupled to a hinged mechanism 162. In this way, the support bar(s) 160 of the jacking system 150 may be configured to raise upward and into the saddle(s) 156 when the saddle(s) are in a lifting position. The clamp or cover(s) 157 may close around a bottom or lower surface of the support bar(s) 160 to secure the one or more bars in place against the one or more saddles 156. When the saddle(s) 156 are in a clearance position, the jacking system 150 and support bars 160 may operably pass through an upper face of the substructure box 140.

Furthermore, where the saddles 156 are positioned on the substructure boxes 140, a box may also have coupling bars in some embodiments. For example, a saddle 156 that extends from a substructure box 140 may be configured to swing upward into a coupling position. The saddle 156 may be configured to couple to a coupling bar or other member extending from an adjacent substructure box.

Assembly of the drilling rig 100 and substructure 130 will now be described with respect to FIGS. 14-35.

Figure 14:
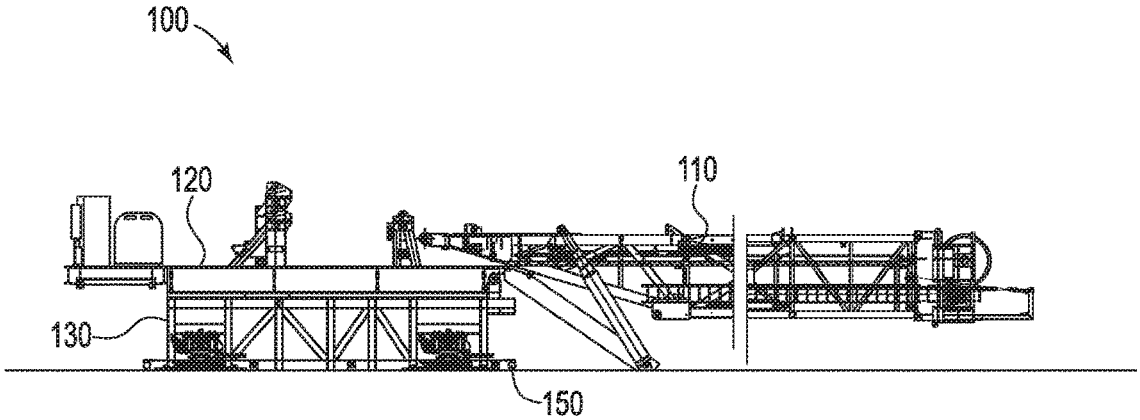
FIG. 14 is a side view of a drill floor, a first layer of a substructure, and a pre-erected mast of a drilling rig, according to one or more embodiments.
Figure 15:
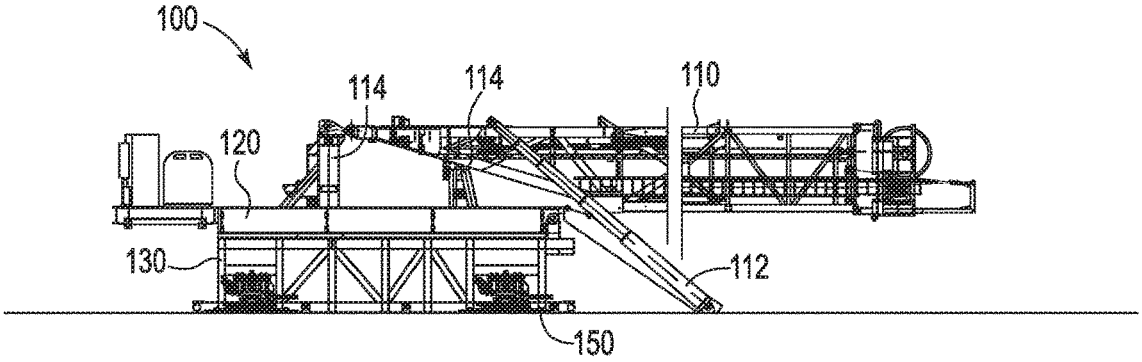
FIG. 15 is a side view of the elements of FIG. 14 with lifting cylinders extended, according to one or more embodiments.
Figure 16:
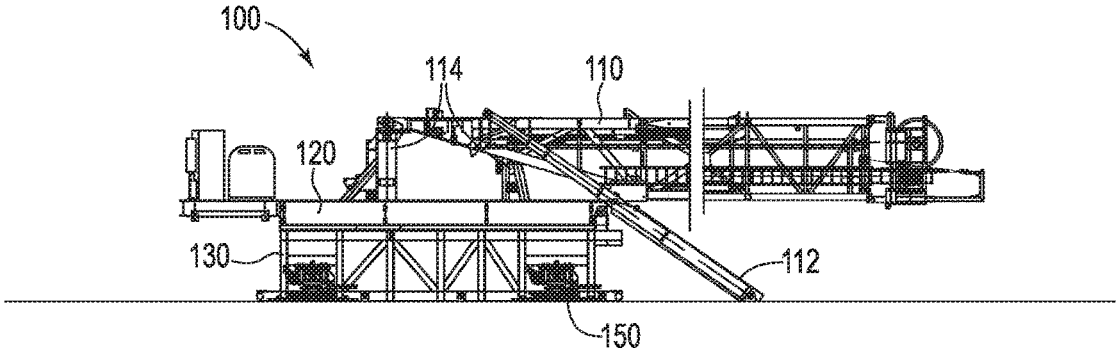
FIG. 16 is a side view of the elements of FIG. 15, with the mast pinned to mast shoes, according to one or more embodiments.
Figure 17:
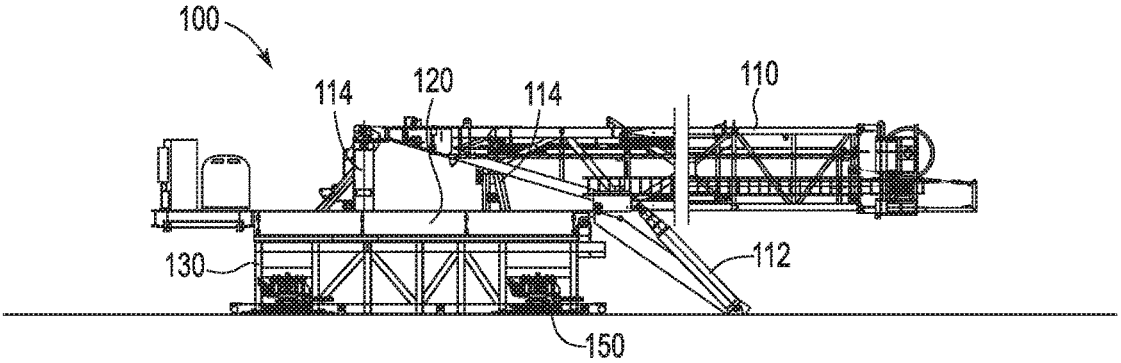
FIG. 17 is a side view of the elements of FIG. 16, with the lifting cylinder in a mast-erecting position, according to one or more embodiments.
Figure 18:
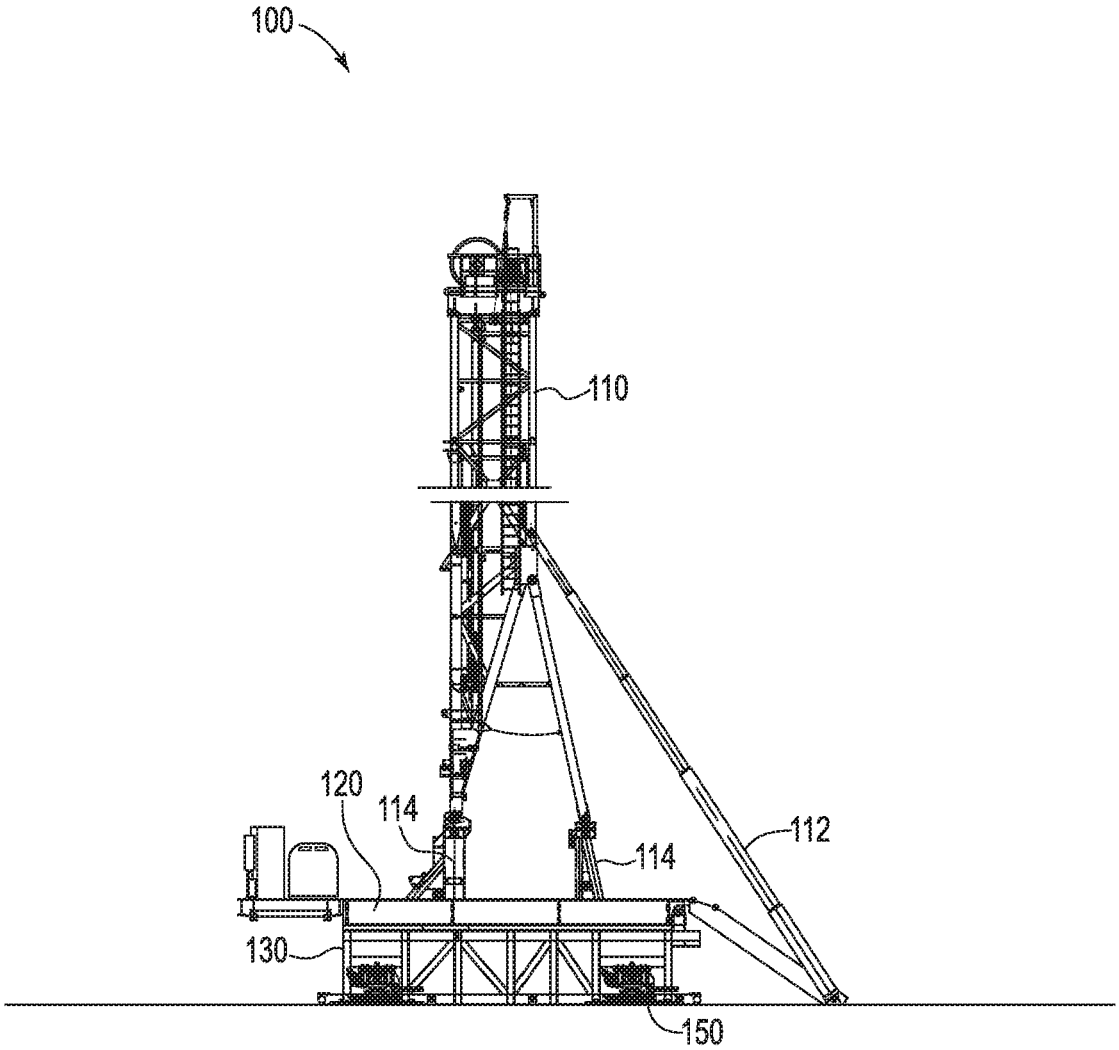
FIG. 18 is a side view of the elements of FIG. 17, with the lifting cylinders extended and the mast in an erected position, according to one or more embodiments.
Figure 19:
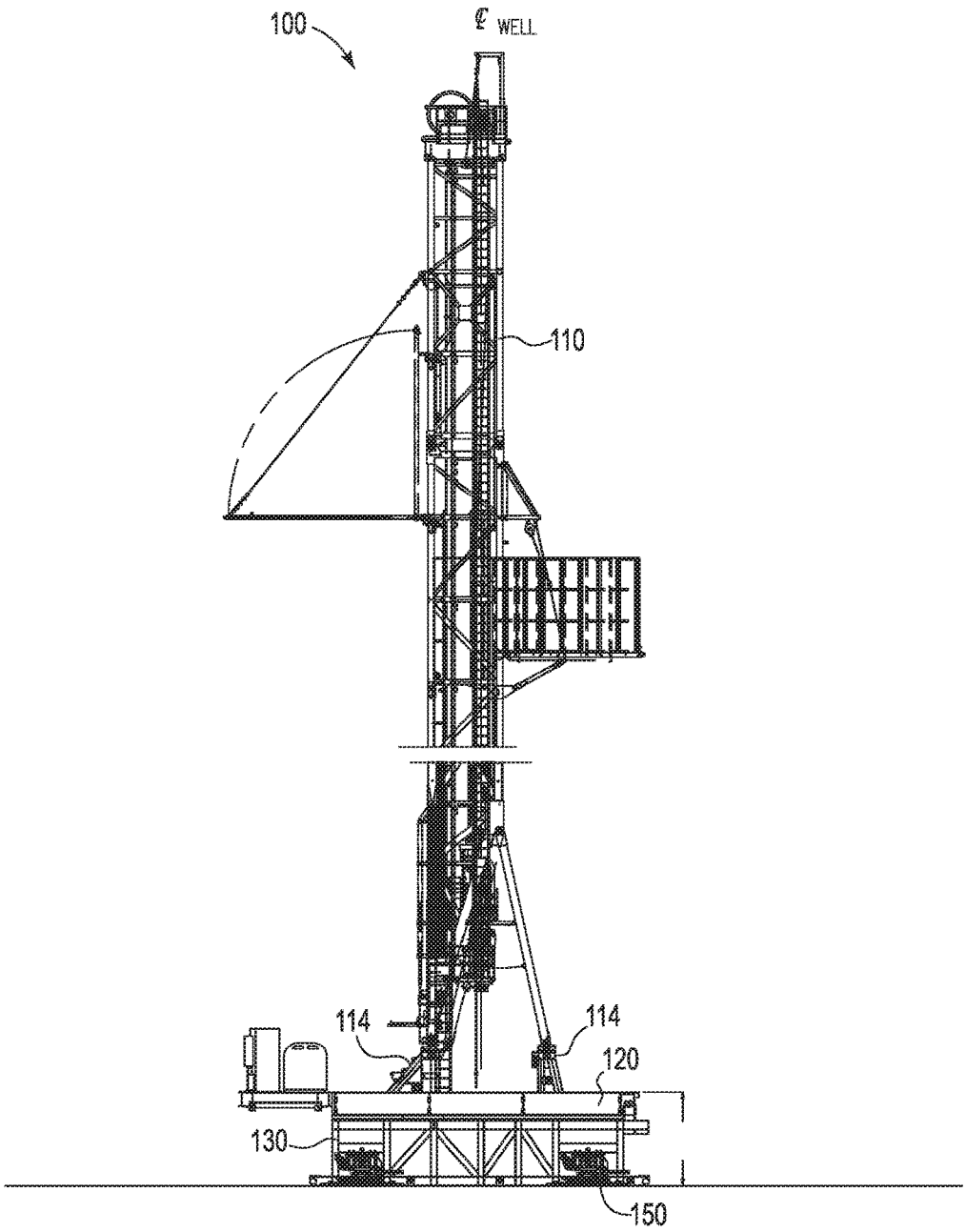
FIG. 19 is a side view of the elements of FIG. 18, with the lifting cylinders detached, according to one or more embodiments.

A drilling rig 100 may generally be transported to a drilling site, such as a pad drilling site, by one or more truck/trailer combinations, rail cars, or other modes of transportation. In this way, the drilling rig 100 may be transported in separate components that may be assembled at the drilling site. The drill floor 120, for example, may be delivered to the drilling site in one or more components. In some embodiments, the mast 110 may be transported to a drilling site, separate from the drilling floor 120 or substructure 130, and assembled on the drill floor at the drilling site. In some embodiments, the mast 110 may be transported in a horizontal position, as shown in FIG. 14, and thus may be erected to a vertical position at the drilling site. Various devices and/or means may be used to erect the mast 110. In some embodiments, hydraulic lifting cylinders 112 may be used to erect the mast 110. For example, while in a horizontal position, the hydraulic lifting cylinders 112 may extend, as shown in FIG. 15, to raise the mast 110 onto mast shoes 114 on the drill floor 120. As shown in FIG. 16, the mast 110 may be pinned to the mast shoes 114. The hydraulic lifting cylinders 112 may be positioned so as to erect the mast, as shown in FIG. 17, and may extend to position the mast upright, as shown in FIG. 18. The lifting cylinders 114 may be detached after the mast has been erected, as shown in FIG. 19. Erection of the mast using hydraulic lifting cylinders is described more fully in U.S. Pat. No. 9,091,126, entitled Mobile Drilling Rig with Telescoping Substructure Boxes, filed Apr. 16, 2013, incorporated herein by reference in its entirety. In other embodiments, other devices or means may be used to erect the mast 110 or otherwise position the mast for drilling operations.

In some embodiments, the substructure 130 may be assembled or completed at the drilling site. Where the substructure 130 includes one or more vertical stacks of substructure boxes 140, for example, the substructure boxes may be assembled and/or stacked at the drilling site. In this way, the substructure boxes 140 may be delivered or otherwise brought to the drilling site separately on trailers, trucks, or by other means.

As shown in FIG. 19, the substructure 130 may have a first layer 140*a* of substructure boxes. The first layer 140*a* of substructure boxes may include one or more boxes coupled to the drilling floor 120 of the rig 100. Substructure boxes 140 for the first layer 140*a* may be placed at various locations beneath the drilling floor 120. For example, in some embodiments, one or more boxes 140 may be placed at each corner of a rectangular drilling floor 120. In other embodiments, substructure boxes 140 may be placed along the full width and/or length of the drill floor 120. In some embodiments, substructure boxes 140 may be placed in one or more rows beneath the drill floor 120. For example, a first row of substructure boxes 140 may be placed on a driller side of the drill rig 100, spanning the width of the drill floor between a setback side 100*a* and a drawworks side 100*b* as shown in FIG. 19. A corresponding row may be placed on an off-driller side of the rig. In some embodiments, each row of substructure boxes 140 may include a substructure box at each end of the row and one or more spreader boxes 145 between the two substructure boxes. In other embodiments, substructure boxes 140 may be placed in other configurations to form a first layer 140*a* beneath the drill floor 120.

In some embodiments, additional layers of substructure boxes 140 may be added to the substructure 130, so as to elevate the drill floor 120. Generally, substructure boxes 140 may be added by raising the drill floor 120 and first layer 140*a* using the one or more jacking systems 150. The jacking systems 150 may raise the drill floor 120 and first layer 140*a* high enough off the ground or other surface to accommodate a second layer of substructure boxes 140. The jacking systems 150 may be delivered or otherwise brought to the drilling site by trucks, trailers, or by other means. FIGS. 20A-F illustrate a process of raising the first layer 140*a* of substructure boxes, according to some embodiments.

Figure 20A:
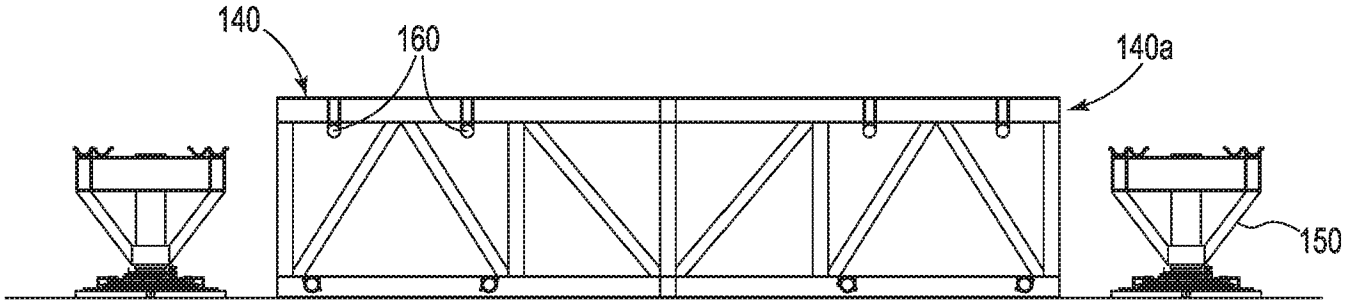
FIG. 20A is a side view of jacking systems and a first layer of substructure boxes, according to one or more embodiments.
Figure 20B:
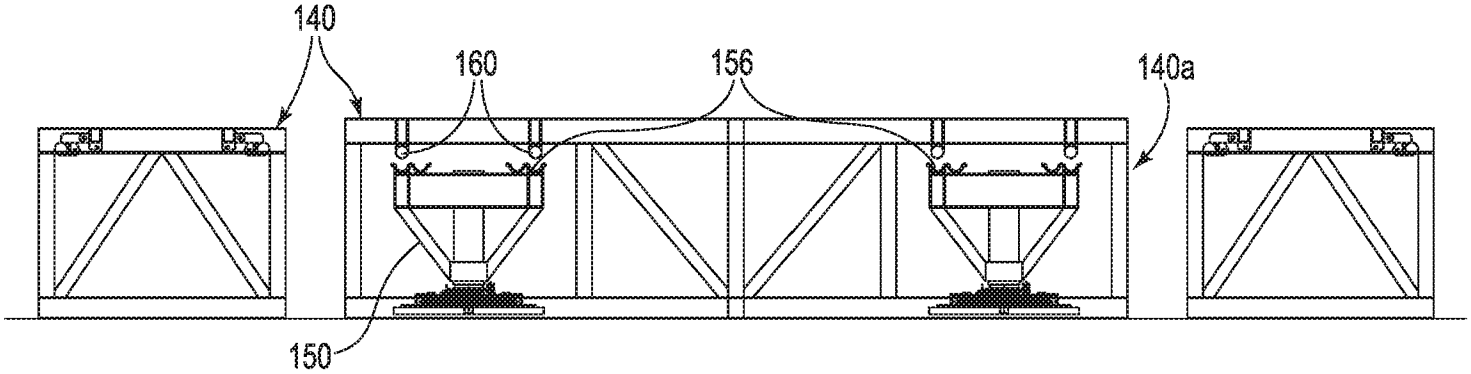
FIG. 20B is a side view of the elements of FIG. 20A, with the jacking systems positioned within the substructure boxes, according to one or more embodiments.
Figure 20C:
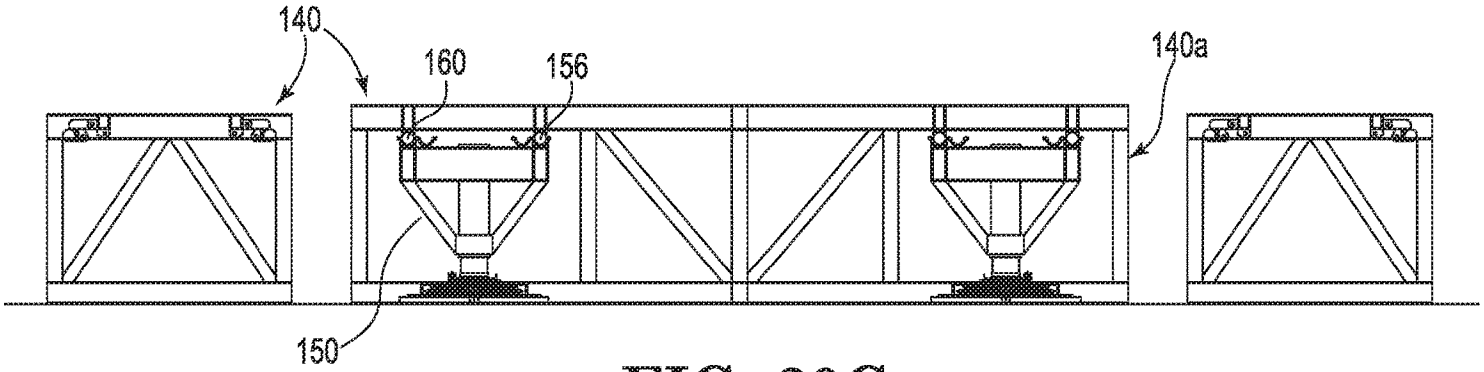
FIG. 20C is a side view of the elements of FIG. 20B, with the jacking systems coupled to the support bars, according to one or more embodiments.

FIG. 20A illustrates a side view of a first layer of substructure boxes 140*a* and two jacking systems 150 outside of the substructure. While only two jacking systems 150 are shown in FIGS. 20A-F, it may be appreciated that a jacking system may be used at each corner of the substructure 130 to raise the drill floor 120 and substructure. In other embodiments, any number of jacking systems 150 may be used to raise the drill floor 120 and substructure 130. As shown in FIG. 20B, the jacking systems 150 may be placed within the first layer 140*a* of substructure boxes. For example, a jacking system 150 may be placed within a substructure box 140 situated at each corner of the first layer 140*a*. In some embodiments, the support bars 160 of the substructure boxes 140 within the first layer 140*a* may have fixed connections to the boxes, as shown in FIG. 20. In other embodiments, the support bars 160 may have a hinged connection 162 or other movable connection, such that the support bars may be lowered to the lifting position to couple with the jacking system 150. As shown in FIG. 20C, each jacking system 150 may be raised a distance within the first layer 140*a* so as to connect with the one or more support bars 160 within the substructure boxes 140. In some embodiments, each jacking system 150 may couple to the one or more support bars 160 within a box 140 by positioning each support bar within a saddle 156 of the jacking system and securing the bar in place with clamp 157. In other embodiments, the jacking systems 150 may couple to the support bars 160, or may generally couple to the substructure boxes 140, using other coupling mechanisms.

Figure 20D:
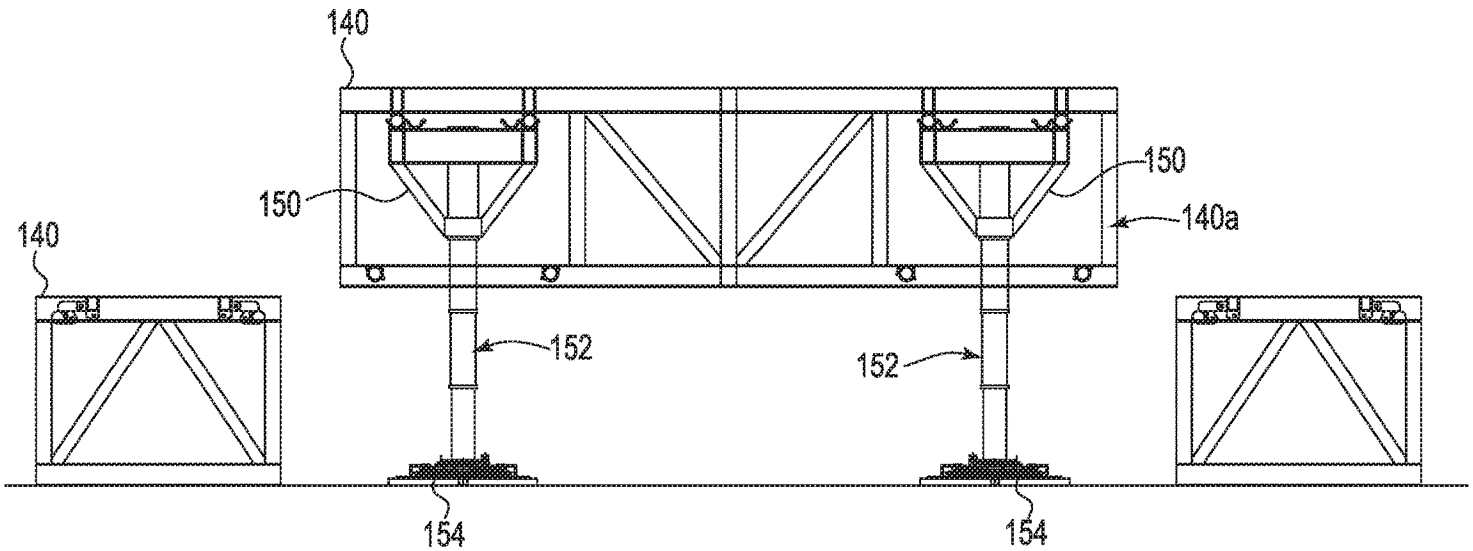
FIG. 20D is a side view of the elements of FIG. 20C, with the jacking systems extended, according to one or more embodiments.

As shown in FIG. 20D, the jacking systems 150 may raise further on their telescoping cylinders 152 to elevate the drill floor 120 and first layer 140*a* off of the ground surface, drilling pad, or other surface. In this way, the dead load of the drill rig 100 may be transferred from substructure boxes 140 onto the jacking systems 150. Particularly, the dead load of the drill rig 100 may be transferred to the bearing plates 154 of the jacking systems 150. The jacking systems 150 may elevate the first layer 140*a* high enough to place additional substructure boxes 140 beneath the first layer. The first layer 140*a* may be elevated such that a lower surface of the first layer is positioned a distance above the ground or other surface that is higher than the height of the substructure boxes 140 to be placed beneath the first layer. For example, where the substructure boxes 140 to be added beneath the first layer 140*a* are six feet in height, the jacking systems 150 may raise the first layer such that the bottom surface is more than six feet off of the ground surface, drilling pad, or other surface, so as to accommodate the additional boxes. In some embodiments, the jacking systems 150 may raise the first layer 140*a* to a height of six feet, six inches off the ground surface, drilling pad, or other surface.

Figure 20E:
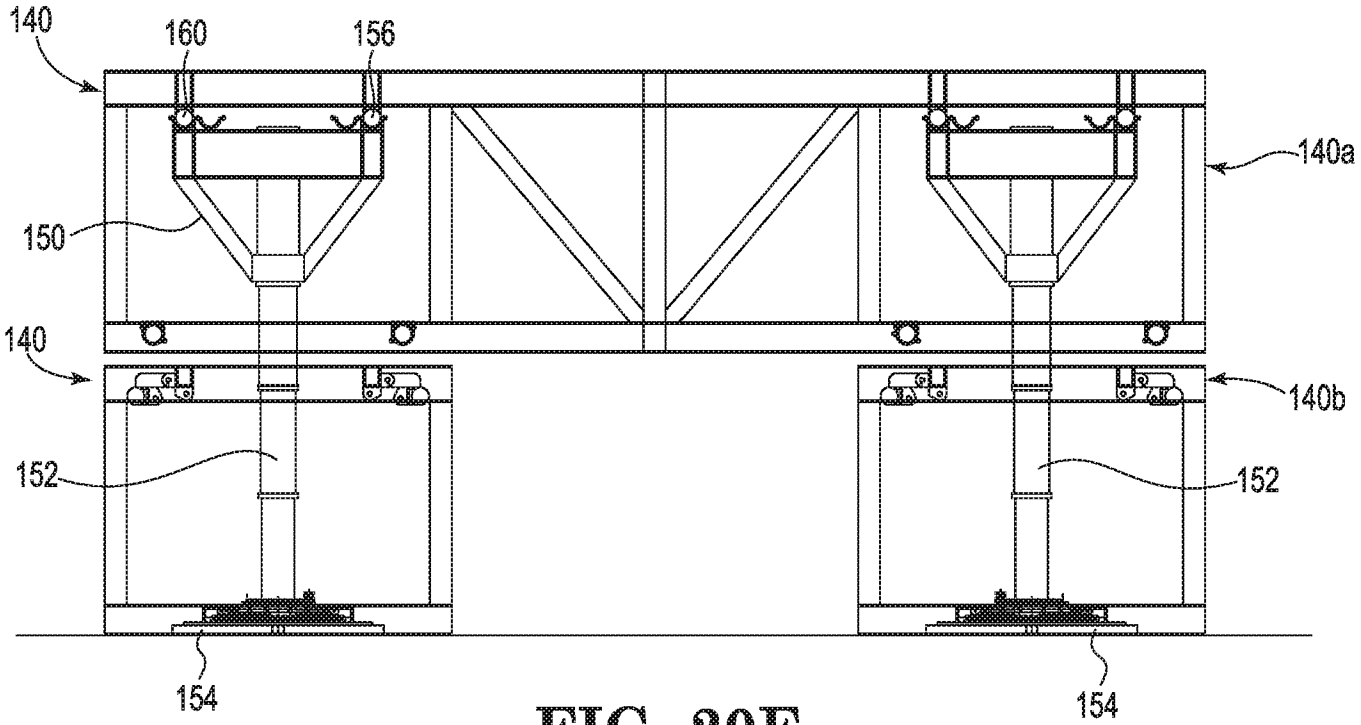
FIG. 20E is a side view of the elements of 20D, with an added second layer of substructure boxes, according to one or more embodiments.
Figure 20F:
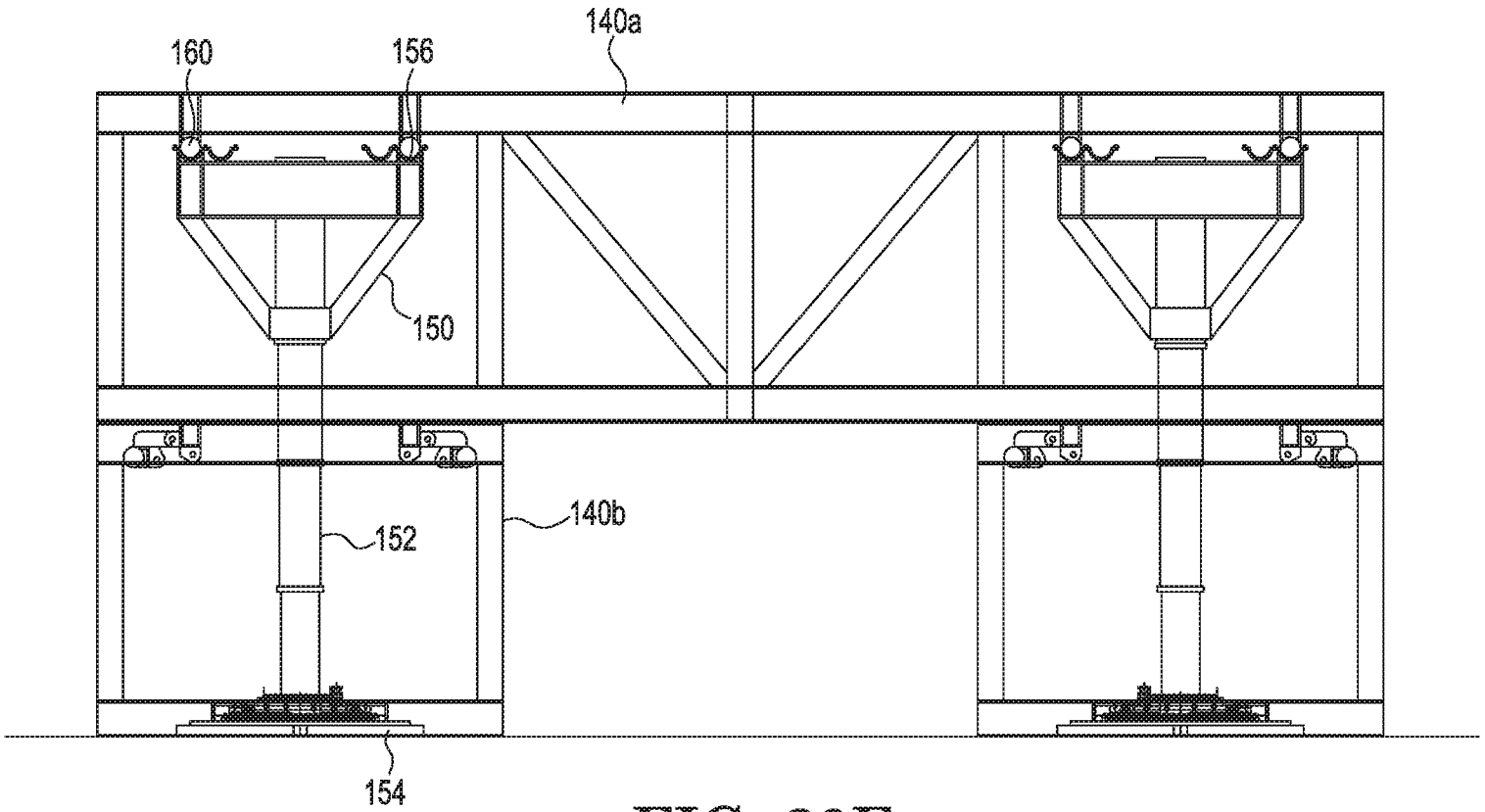
FIG. 20F is a side view of the elements of FIG. 20E, with the first layer of substructure boxes positioned on the second layer of substructure boxes, according to one or more embodiments.

As shown in FIG. 20E, one or more substructure boxes 140 may be inserted beneath the first layer 140*a*, so as to form a second layer 140*b* of substructure boxes. The substructure boxes 140 may be positioned using a forklift, rubber tire crane, bulldozer, or other means. In some embodiments, a substructure box 140 may be placed at each corner of the substructure 130, such that a box is positioned at or about each jacking system 150 in some embodiments. That is, in some embodiments, each box of the second layer 140*b* may be slide beneath the first layer 140*a*, such that each box of the second layer is positioned around or generally surrounding the raised telescoping cylinder 152 a jacking system 150. As described previously, the substructure boxes 140 may have a gap in the horizontal 142, vertical 144, and cross members 146 and/or any siding, and/or may have a generally squared C-shape, in order to accommodate the box being slid around a telescoping cylinder 152. As shown in FIG. 20F, the jacking systems 150 may lower the first layer 140*a* onto the second layer 140*b* of boxes. In some embodiments, the first layer 140*a* and second layer 140*b* of boxes may be coupled together. For example, as described above, the support bars 160 may rotate upward into a coupling position and couple to coupling saddles in order to couple the layers of boxes together in some embodiments. In other embodiments, one or more shear pins may couple each substructure box 140 of the second layer 140*b* to one or more boxes of the first layer 140*a*. In other embodiments, the first 140*a* and second 140*b* layers may be coupled using any suitable mechanism, such as but not limited to clamps or hydraulically actuated pins.

Figure 21:
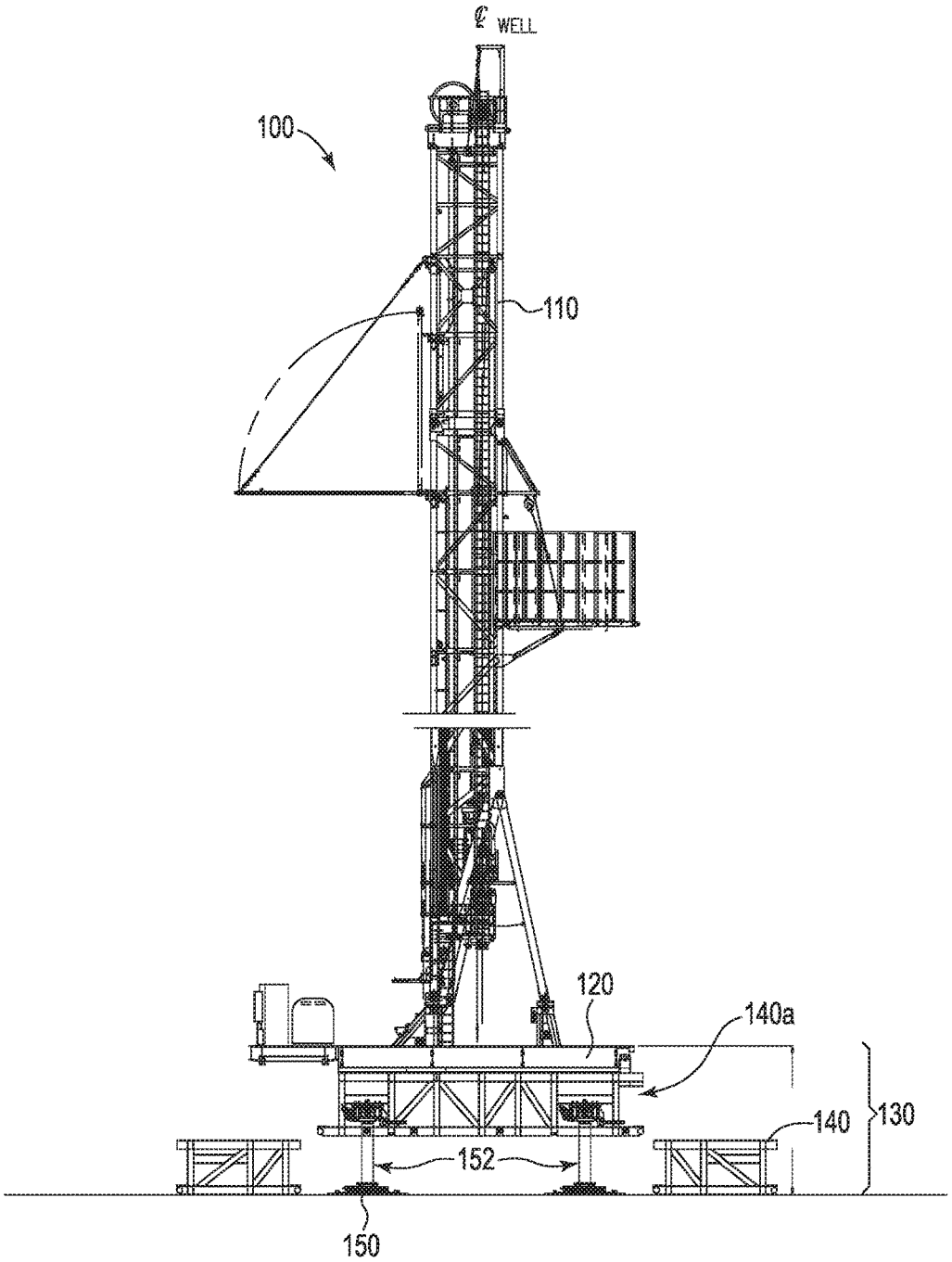
FIG. 21 is a side view of the drilling rig of FIG. 19, with the jacking systems extended, according to one or more embodiments.
Figure 22:
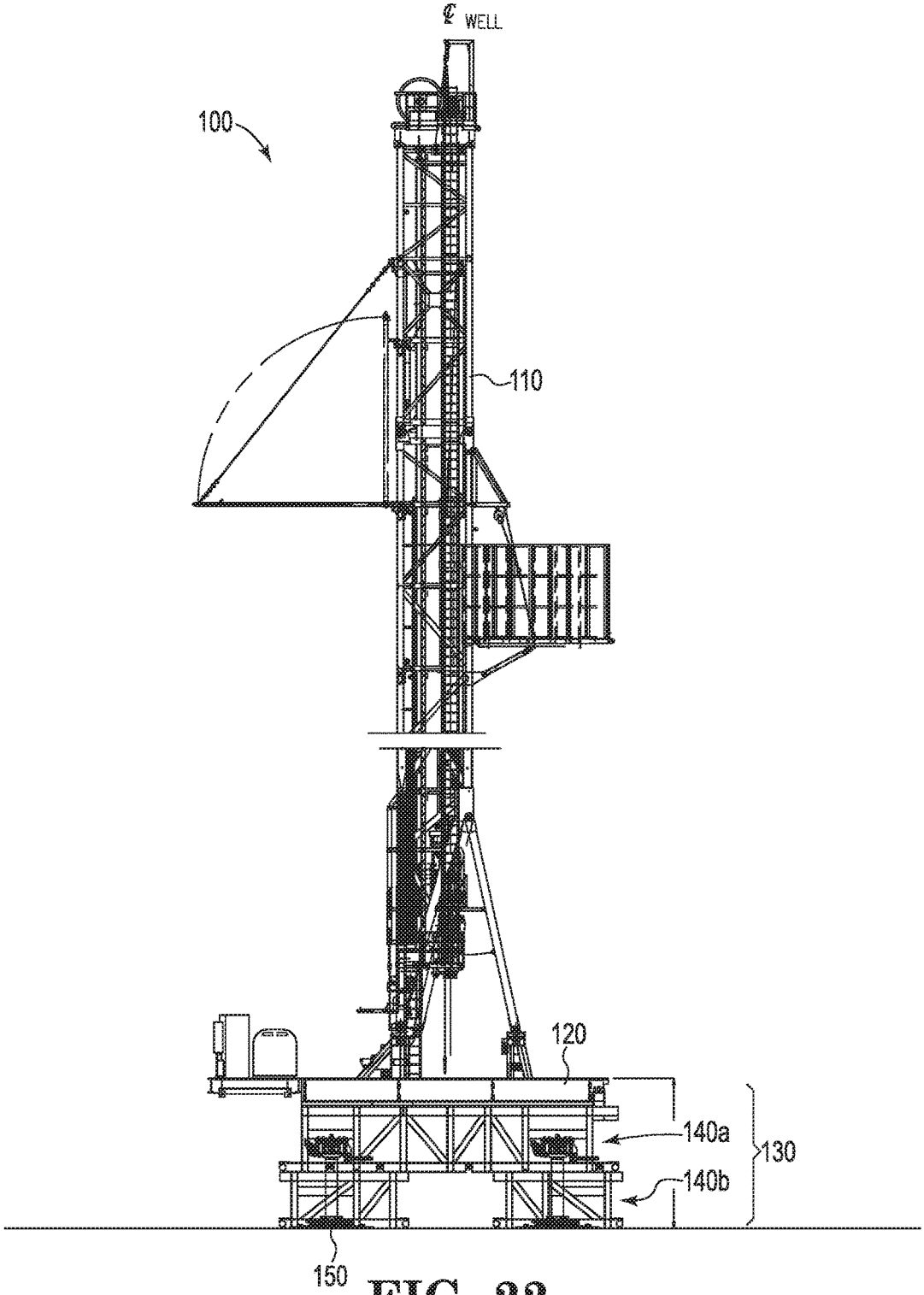
FIG. 22 is a side view of the drilling rig of FIG. 21, with an added second layer of substructure boxes, according to one or more embodiments.
Figure 23:
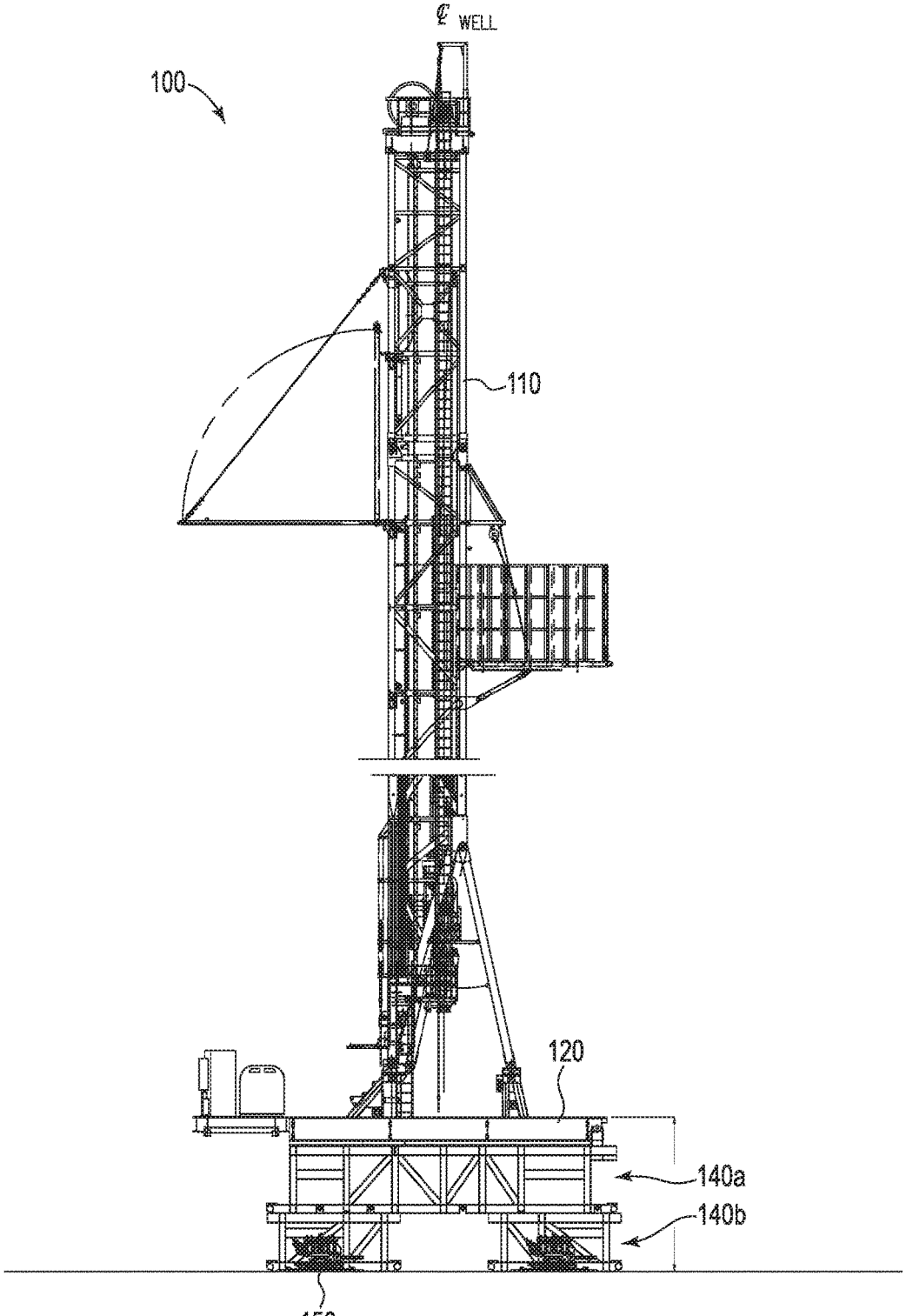
FIG. 23 is a side view of the drilling rig of FIG. 22 with the jacking systems lowered, according to one or more embodiments.

FIG. 21 shows the first layer 140*a*, drill floor 120, and mast 110 elevated by the jacking systems 150, such that the dead load of the drill rig 100 is sustained by the bearing plates 154 of the jacking systems. As described, with respect to FIG. 20, the rig 100 may be elevated high enough to accommodate additional substructure boxes 140 being slid beneath the first layer 140*a*. FIG. 22 illustrates substructure boxes 140 positioned around each jacking system 150 to form a second layer 140*b*. As shown in FIG. 23, after the second layer 140*b* has been positioned within the substructure 130 and secured to the first layer 140*a* by coupling saddles, shear pins, or other mechanisms, the jacking systems 150 may release the support bars 160 and return to their lowered position. In this way, the dead load of the rig 100 may be transferred off of the bearing plates 154 and onto the first 140*a* and second 140*b* layers of the substructure. Support bars 160 within the first layer 140*a* of substructure boxes may move to a clearance position, in some embodiments, when no longer engaged with the jacking systems 150. It may be appreciated that the procedure just described for adding a layer of substructure boxes 140 to the substructure 130 may generally be repeated until the drill floor 120 reaches a desired height above the ground surface, drilling pad, or other surface.

Figure 24A:
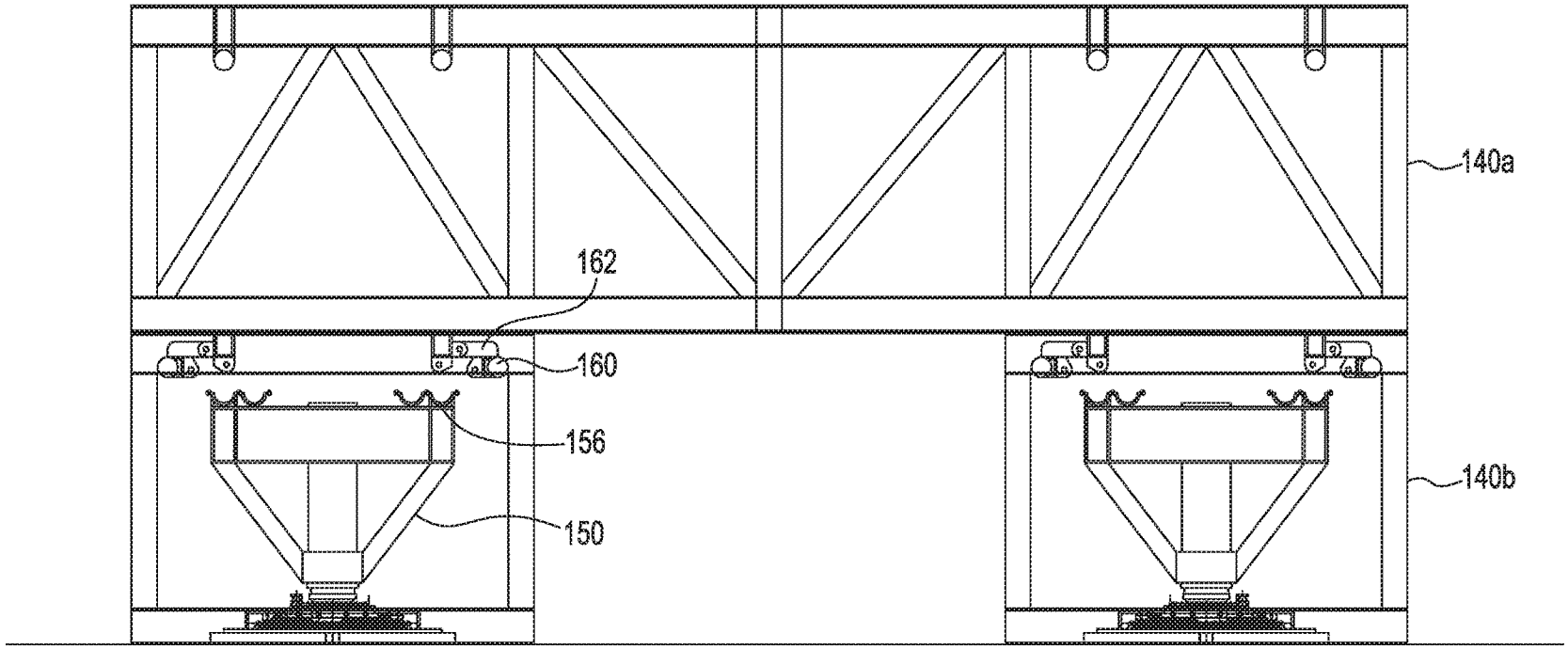
FIG. 24A is a side view of jacking systems and a first layer and second layers of substructure boxes, according to one or more embodiments.
Figure 24B:
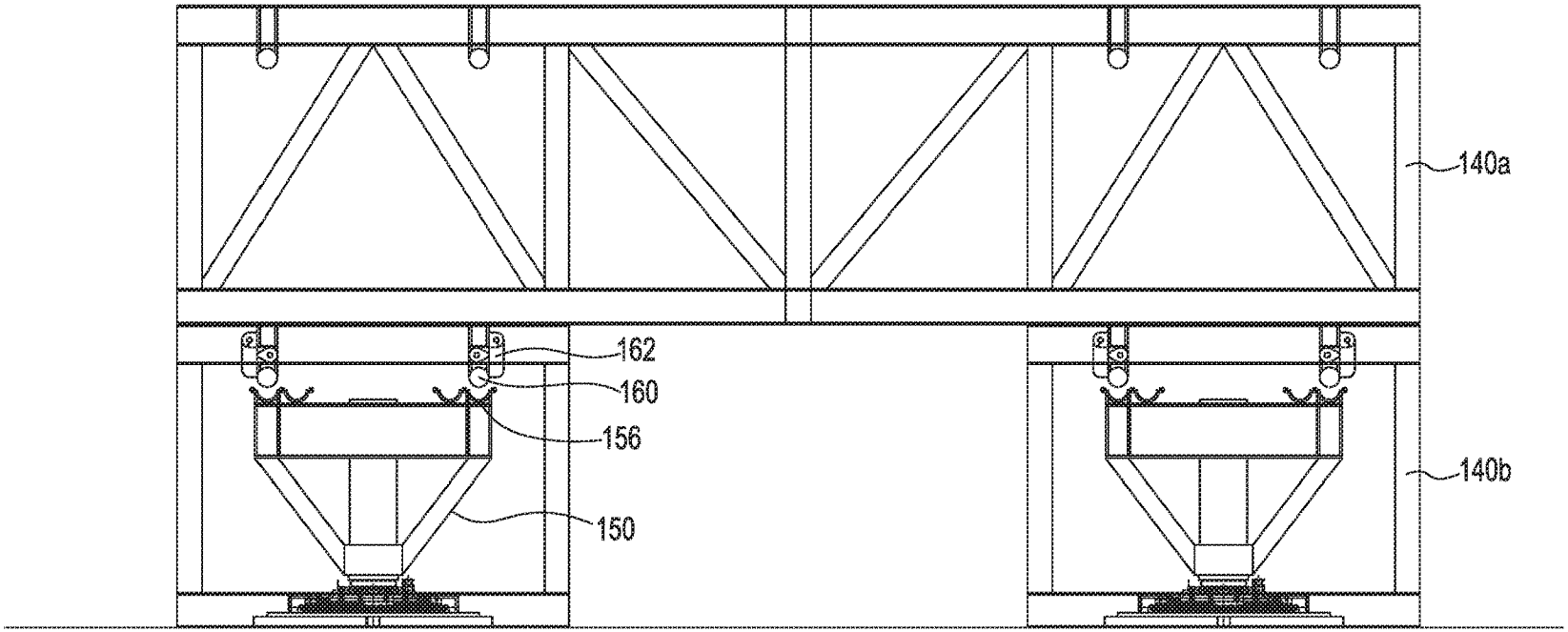
FIG. 24B is a side view of the elements of FIG. 24A, with the support bars of the second layer in a lifting position, according to one or more embodiments.
Figure 24C:
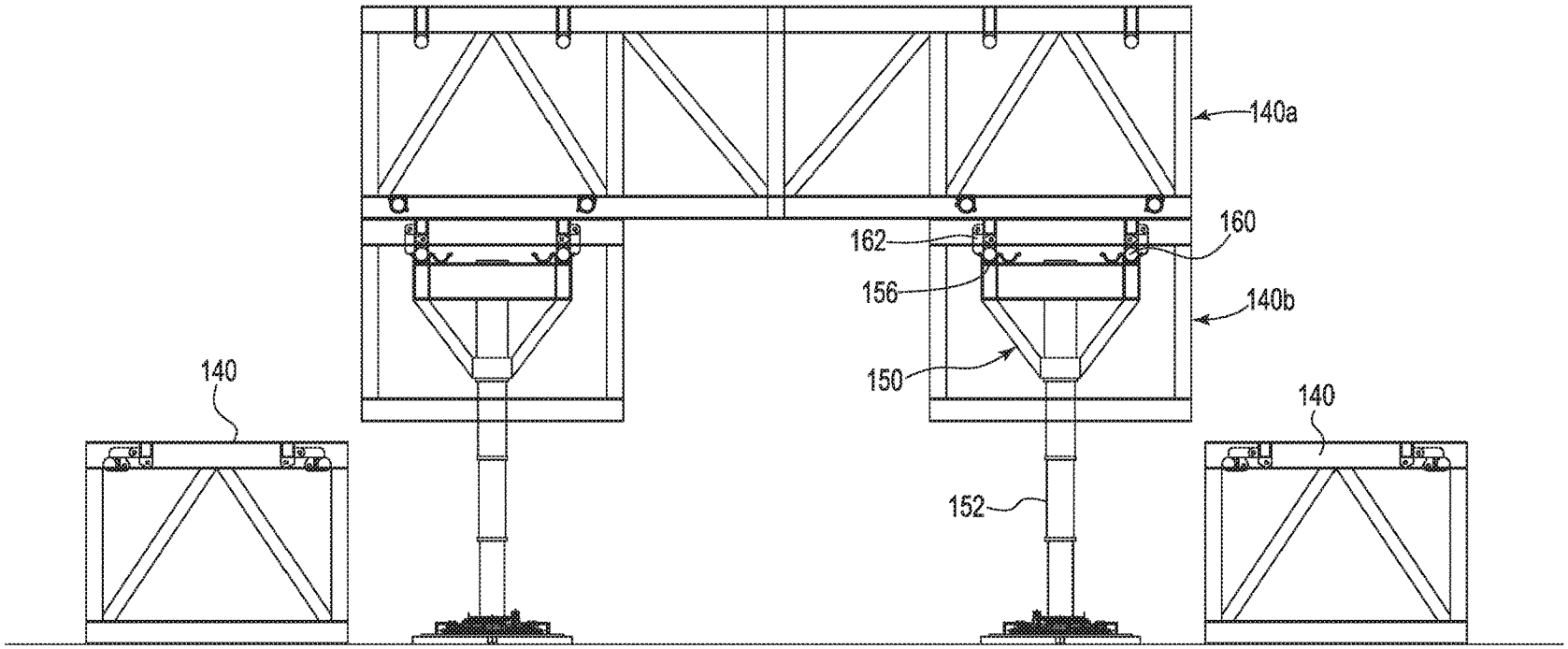
FIG. 24C is a side view of the elements of FIG. 24B, with the jacking systems extended, according to one or more embodiments.
Figure 24D:
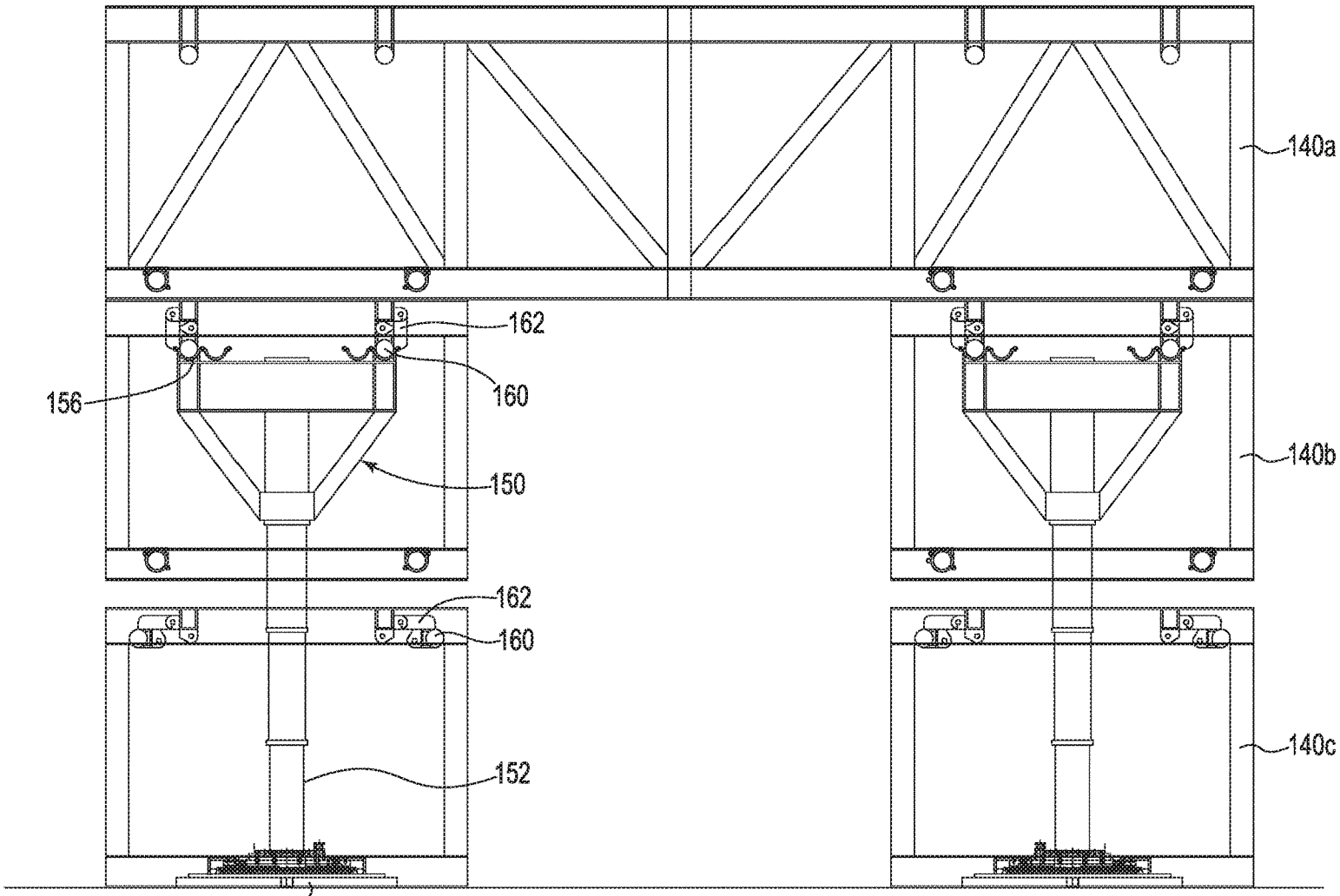
FIG. 24D is a side view of the elements of FIG. 24C, with an added third layer of substructure boxes, according to one or more embodiments.
Figure 24E:
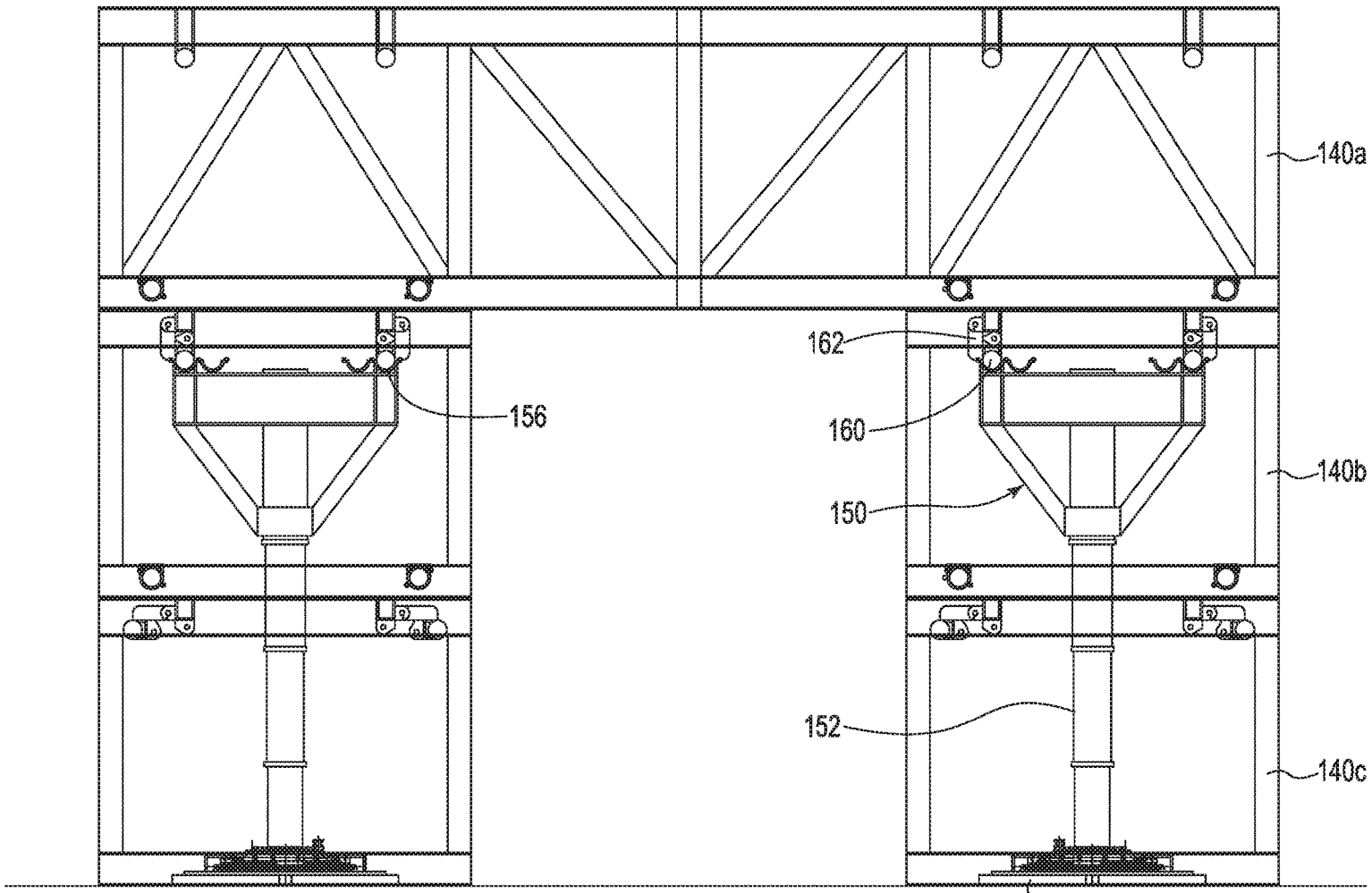
FIG. 24E is a side view of the elements of FIG. 24D, with the second layer of substructure boxes positioned on the third layer of substructure boxes, according to one or more embodiments.

Turning now to FIGS. 24A-E, a third layer of substructure boxes 140 may be added to the substructure 130 in some embodiments. As shown in FIG. 24A, support bars 160 within substructure boxes 140 of the second layer 140*b* may be in a clearance position. Before raising the substructure 130, the support bars 160 may be lowered to a lifting position, as shown in FIG. 24B. The support bars 160 may be lowered using hinged connections 162, as discussed above, in some embodiments. In other embodiments, the support bars 160 may initially be in a lowered position or may be fixed in a lowered position. The jacking systems 150 may be coupled to the support bars 160 via the saddles 156 in some embodiments. In some embodiments, the jacking systems 150 may be raised slightly in order to connect with the support bars 160. As shown in FIG. 24C, the jacking systems 150 may transfer the dead load of the rig 100 from the substructure 130 onto the bearing plates 154 by extending the hydraulic cylinders 152 to elevate the rig. The additional substructure boxes 140 may be slid beneath the second layer 140*b* to form a third layer 140*c* of boxes. Each substructure box 140 of the third layer 140*c* may be positioned around or generally at a jacking system 150 in some embodiments, as shown in FIG. 24D. In some embodiments, a box 140 may be positioned beneath each box of the second layer 140*b*, creating vertical stacks of boxes. As shown in FIG. 24E, the jacking cylinders 150 may be lowered, such that the second layer 140*b* is positioned on top of the third layer 140*c*. The third layer 140*c* may be coupled to the second layer 140*b* via coupling saddles, shear pins, or other coupling mechanisms. The jacking systems 150 may release the support bars 160 or otherwise disconnect from the second layer 140*b* and may lower toward the ground surface, drilling pad, or other surface. Thus, the dead load of the rig 100 may be transferred from the jacking systems 150 to the substructure 130.

Figure 25:
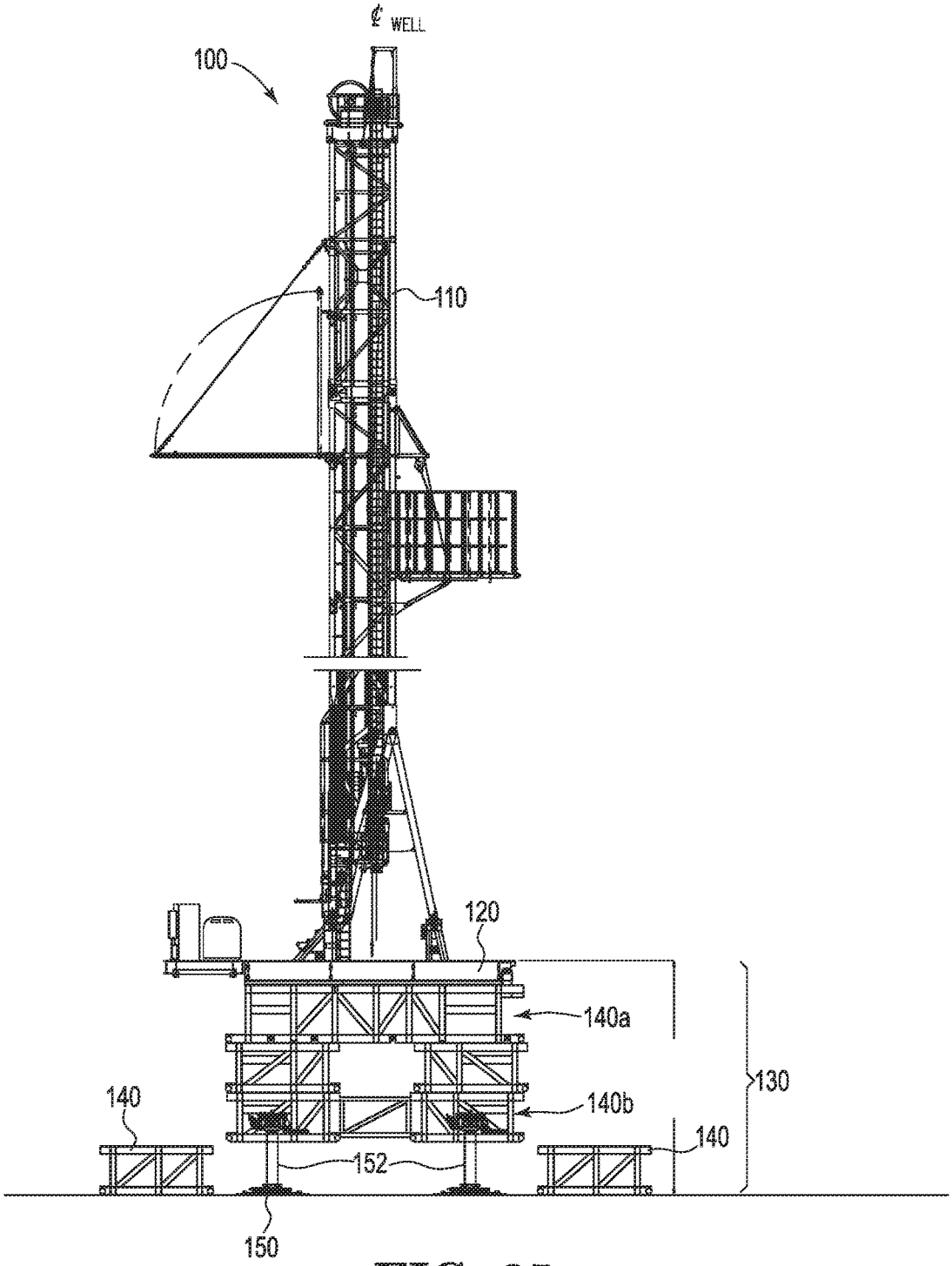
FIG. 25 is a side view of the drilling rig of FIG. 23, with the jacking systems extended, according to one or more embodiments.
Figure 26:
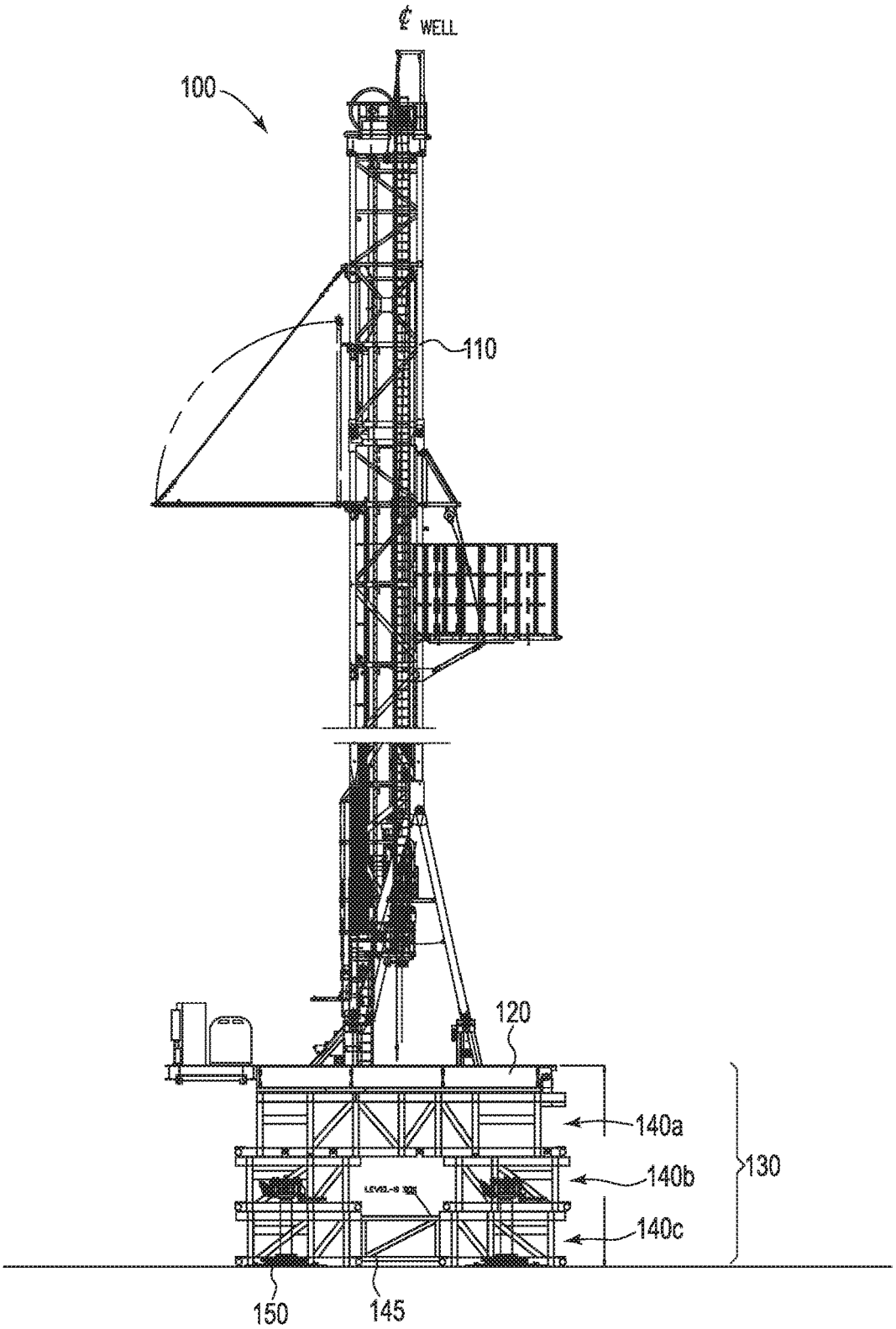
FIG. 26 is a side view of the drilling rig of FIG. 25, with an added third layer of substructure boxes, according to one or more embodiments.

FIG. 25 shows the first layer 140*a*, second layer 140*b*, drill floor 120, and mast 110 elevated by the jacking systems 150, such that the dead load of the drill rig 100 is sustained by the bearing plates 154 of the jacking systems. As described, with respect to FIG. 24, the rig 100 may be elevated high enough to accommodate additional substructure boxes 140 being slid beneath the second layer 140*b*. FIG. 26 illustrates substructure boxes 140 positioned around each jacking system 150 to form a third layer 140*c*. In some embodiments, one or more spreader boxes 145 may be positioned as part of the third layer 140*c*. For example, a spreader box 145 may be placed on each side of the substructure 130, each spreader box positioned between two corner substructure boxes 140 of the third layer 140*c*. In other embodiments, one or more spreader boxes 145 may be positioned at any suitable location within the substructure, include at any substructure level. A spreader box 145 may provide for storage space or work space below the drill floor 120. In some embodiments, access may be provided for reaching one or more spreader boxes 145 beneath the drill floor 120.

Figure 27:
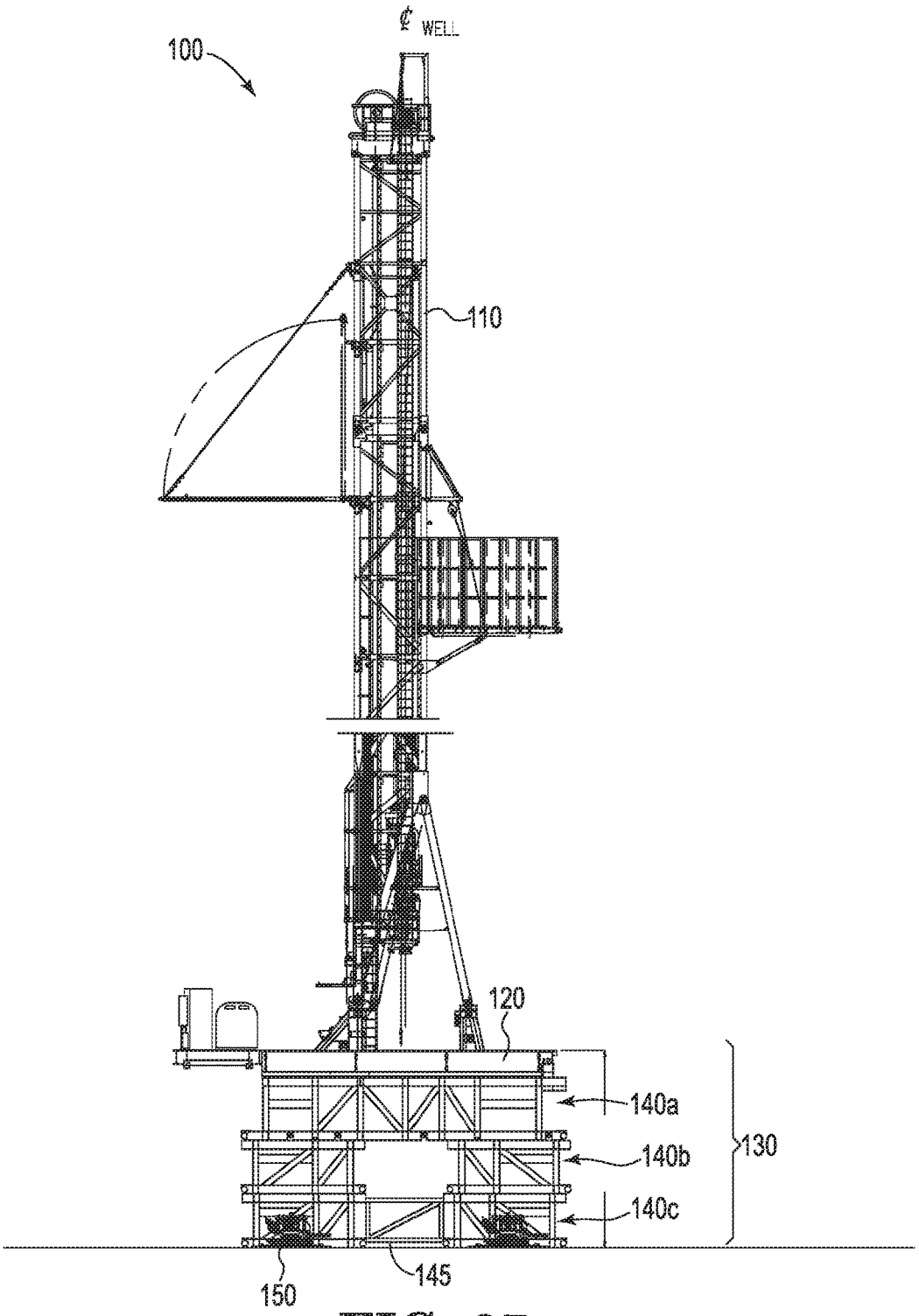
FIG. 27 is a side view of the drilling rig of FIG. 26, with the jacking systems lowered, according to one or more embodiments.

As shown in FIG. 27, after the third layer 140*c* has been positioned within the substructure 130 and secured to the second layer 140*b* by shear pins or other mechanisms, the jacking systems 150 may release the support bars 160 and return to their lowered position. In this way, the dead load of the rig 100 may be transferred off of the bearing plates 154 and onto the first 140*a*, second 140*b*, and third 140*c* layers of the substructure. Support bars 160 within the second layer 140*b* of substructure boxes may move to a clearance position, in some embodiments, when no longer engaged with the jacking systems 150.

Figure 28A:
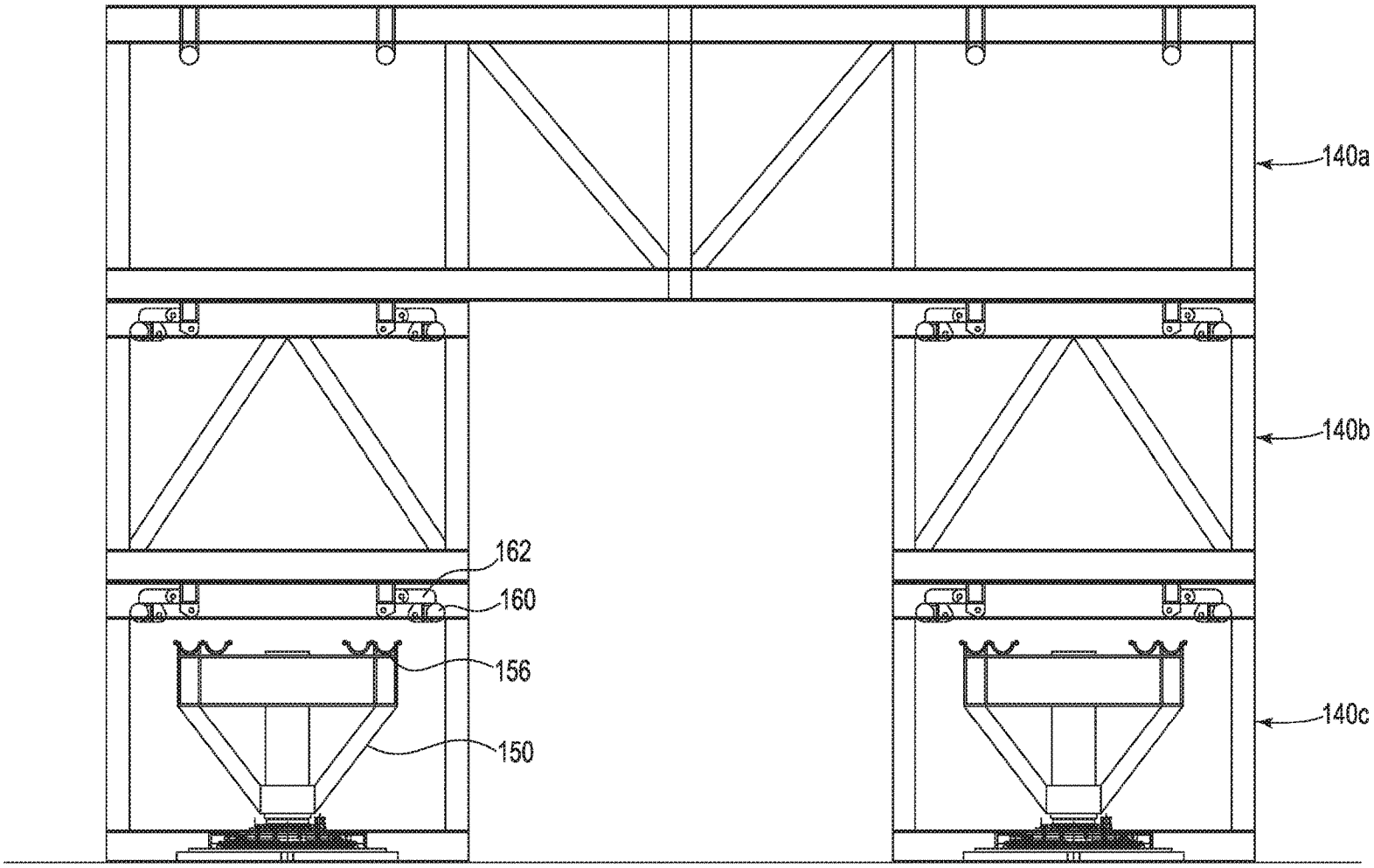
FIG. 28A is a side view of jacking systems and a first layer, second layer, and third layer of substructure boxes, according to one or more embodiments.
Figure 28B:
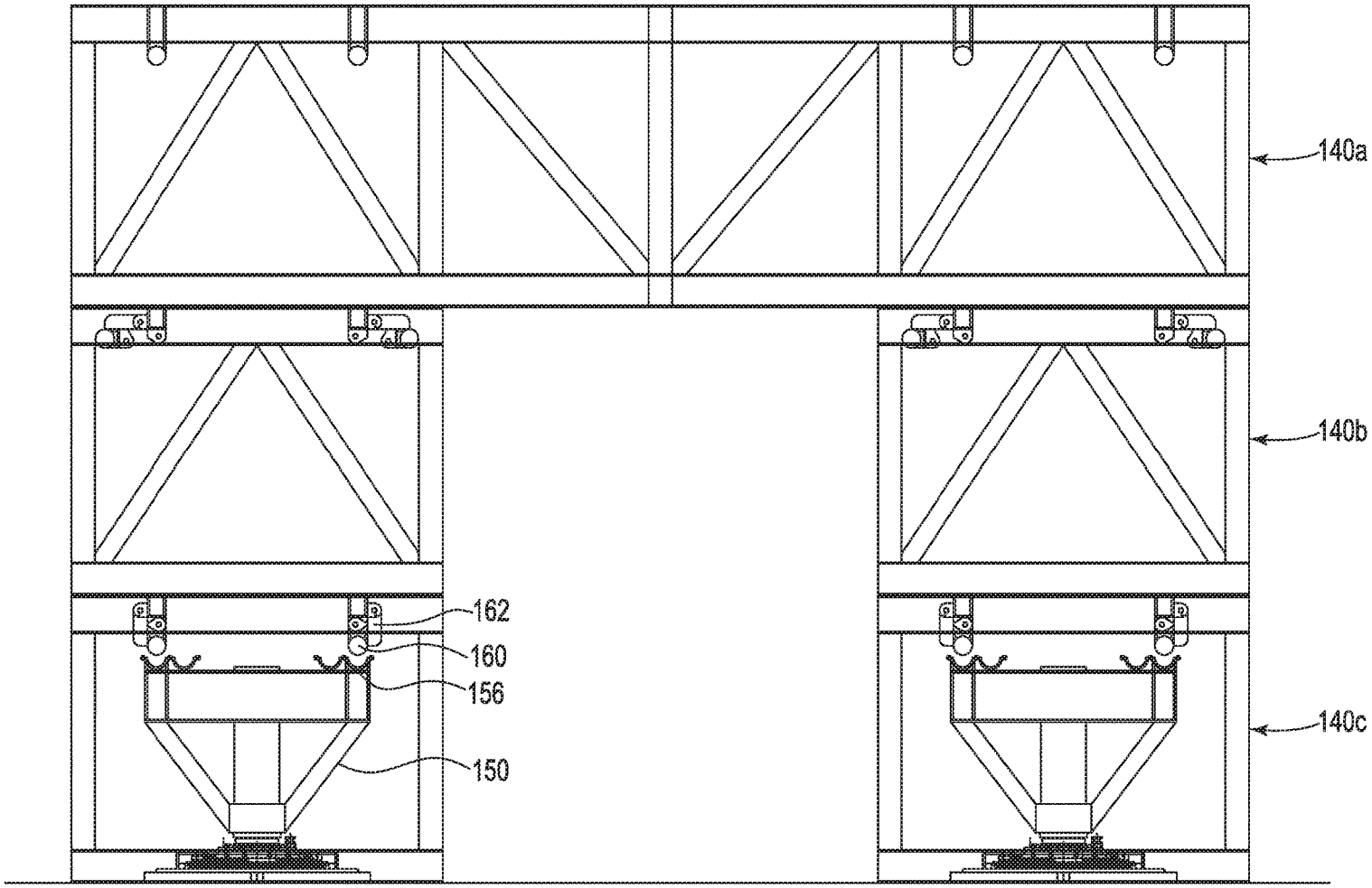
FIG. 28B is a side view of the elements of FIG. 28A, with the support bars of the third layer in a lifting position, according to one or more embodiments.
Figure 28C:
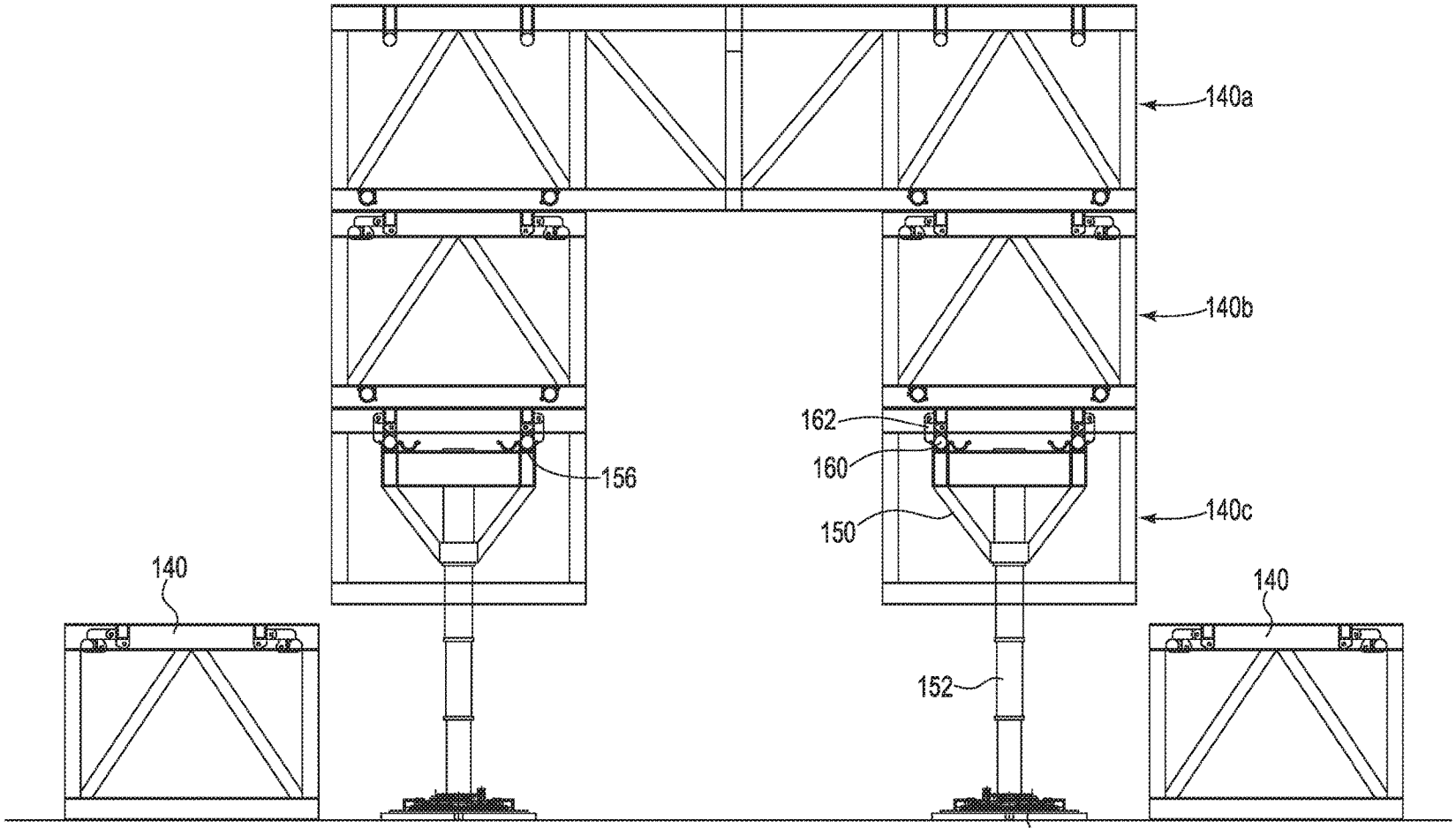
FIG. 28C is a side view of the elements of FIG. 28B, with the jacking systems extended, according to one or more embodiments.
Figure 28D:
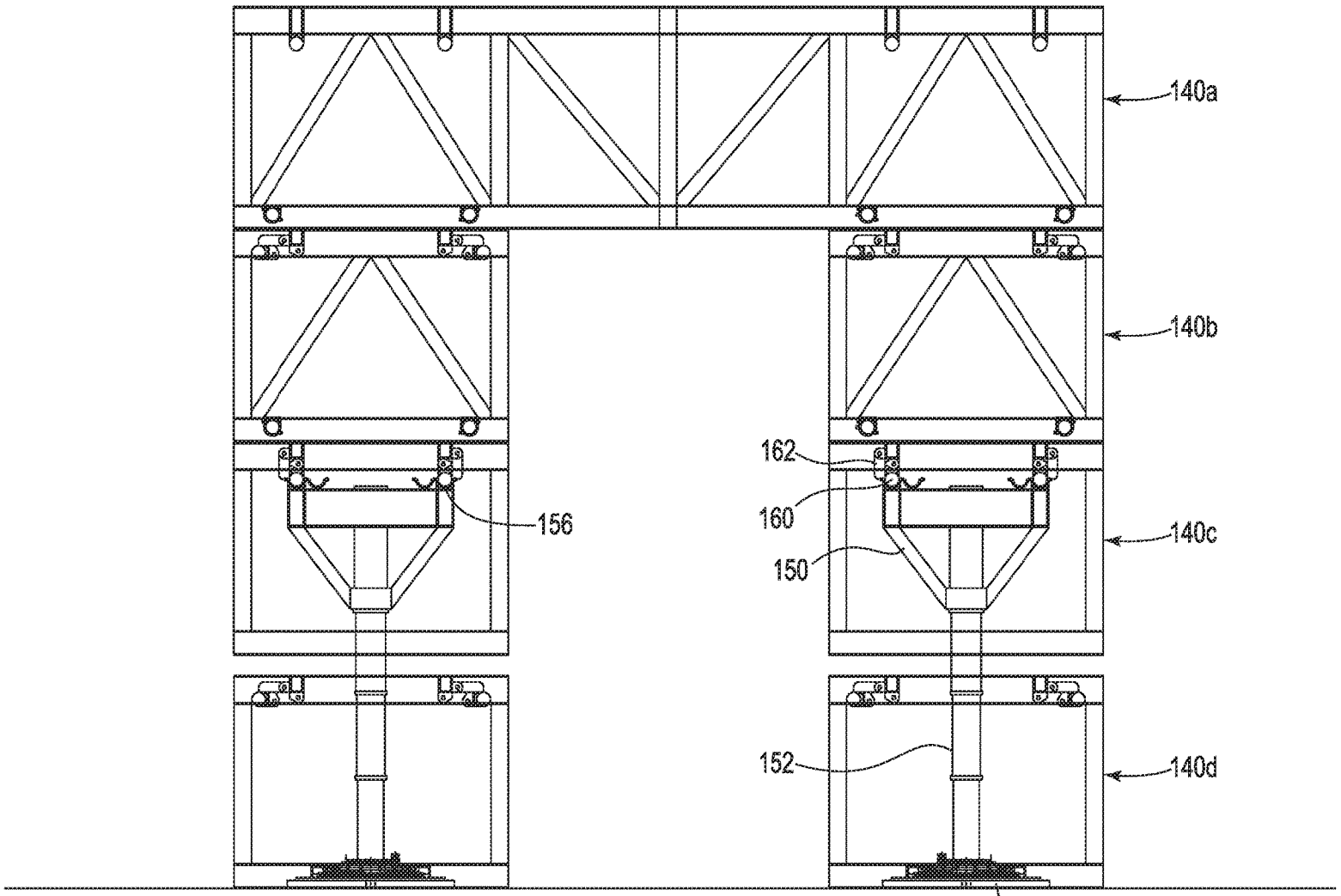
FIG. 28D is a side view of the elements of FIG. 28C, with an added fourth layer of substructure boxes, according to one or more embodiments.
Figure 28E:
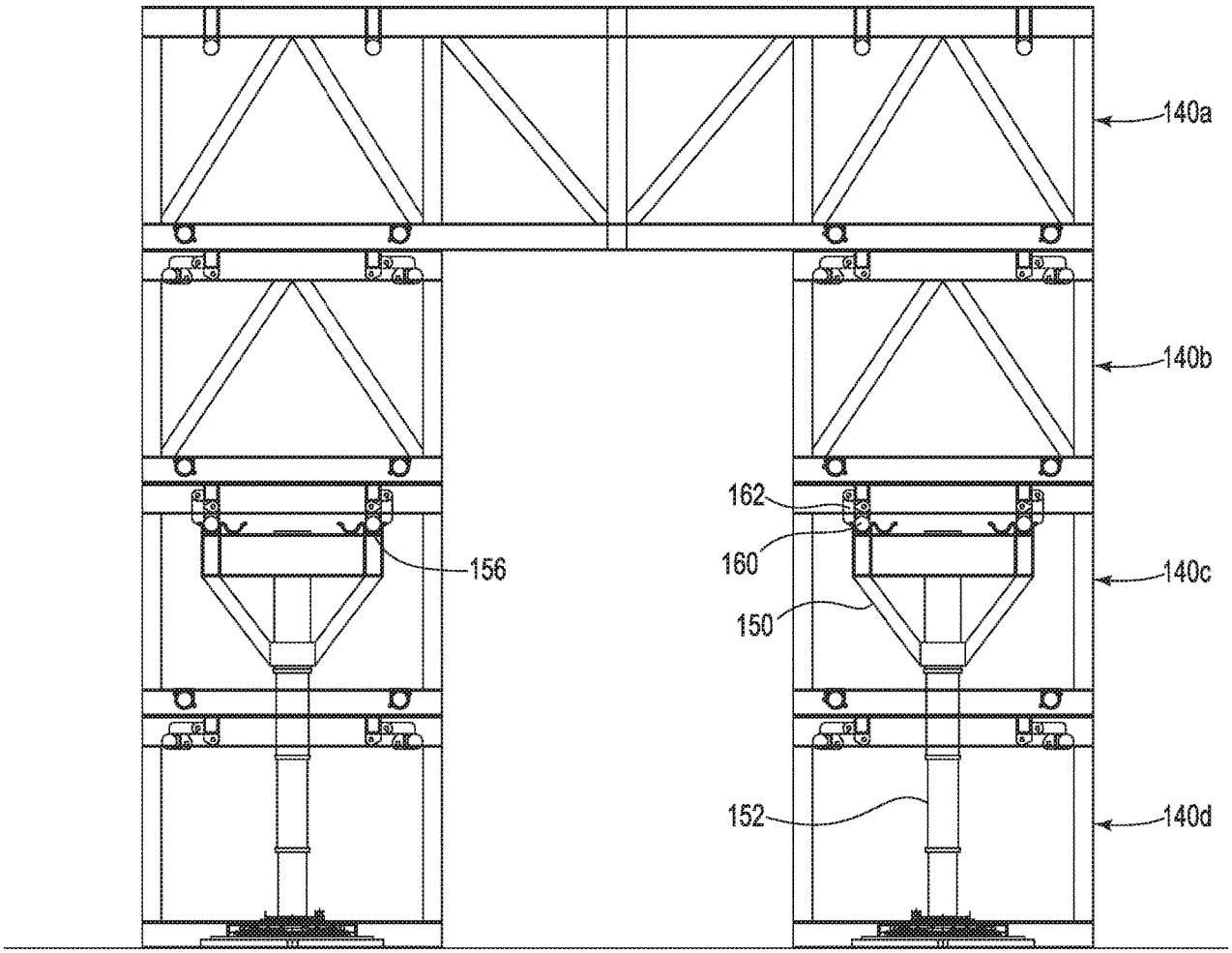
FIG. 28E is a side view of the elements of FIG. 28D, with the third layer of the substructure boxes positioned on the fourth layer of substructure boxes, according to one or more embodiments.

Turning now to FIGS. 28A-E, a fourth layer of substructure boxes 140 may be added to the substructure 130 in some embodiments. As shown in FIG. 28A, support bars 160 within substructure boxes 140 of the third layer 140*c* may be in a clearance position. Before raising the substructure 130, the support bars 160 may be lowered to a lifting position, as shown in FIG. 28B. The support bars 160 may be lowered using hinged connections 162, as discussed above, in some embodiments. In other embodiments, the support bars 160 may initially be in a lowered position or may be fixed in a lowered position. The jacking systems 150 may be coupled to the support bars 160 via the saddles 156 in some embodiments. In some embodiments, the jacking systems 150 may be raised slightly in order to connect with the support bars 160. As shown in FIG. 28C, the jacking systems 150 may transfer the dead load of the rig 100 from the substructure 130 onto the bearing plates 154 by extending the hydraulic cylinders 152 to elevate the rig. The additional substructure boxes 140 may be slid beneath the third layer 140*c* to form a fourth layer 140*d* of boxes. Each substructure box 140 of the fourth layer 140*d* may be positioned around or generally at a jacking system 150 in some embodiments, as shown in FIG. 28D. In some embodiments, a box 140 may be positioned beneath each box of the third layer 140*c*, creating vertical stacks of boxes. As shown in FIG. 28E, the jacking cylinders 150 may be lowered, such that the third layer 140*c* is positioned on top of the fourth layer 140*d*. The fourth layer 140*d* may be coupled to the third layer 140*c* via coupling saddles, shear pins, or other coupling mechanisms. The jacking systems 150 may release the support bars 160 or otherwise disconnect from the third layer 140*c* and may lower toward the ground surface, drilling pad, or other surface. Thus, the dead load of the rig 100 may be transferred from the jacking systems 150 to the substructure 130.

Figure 29:
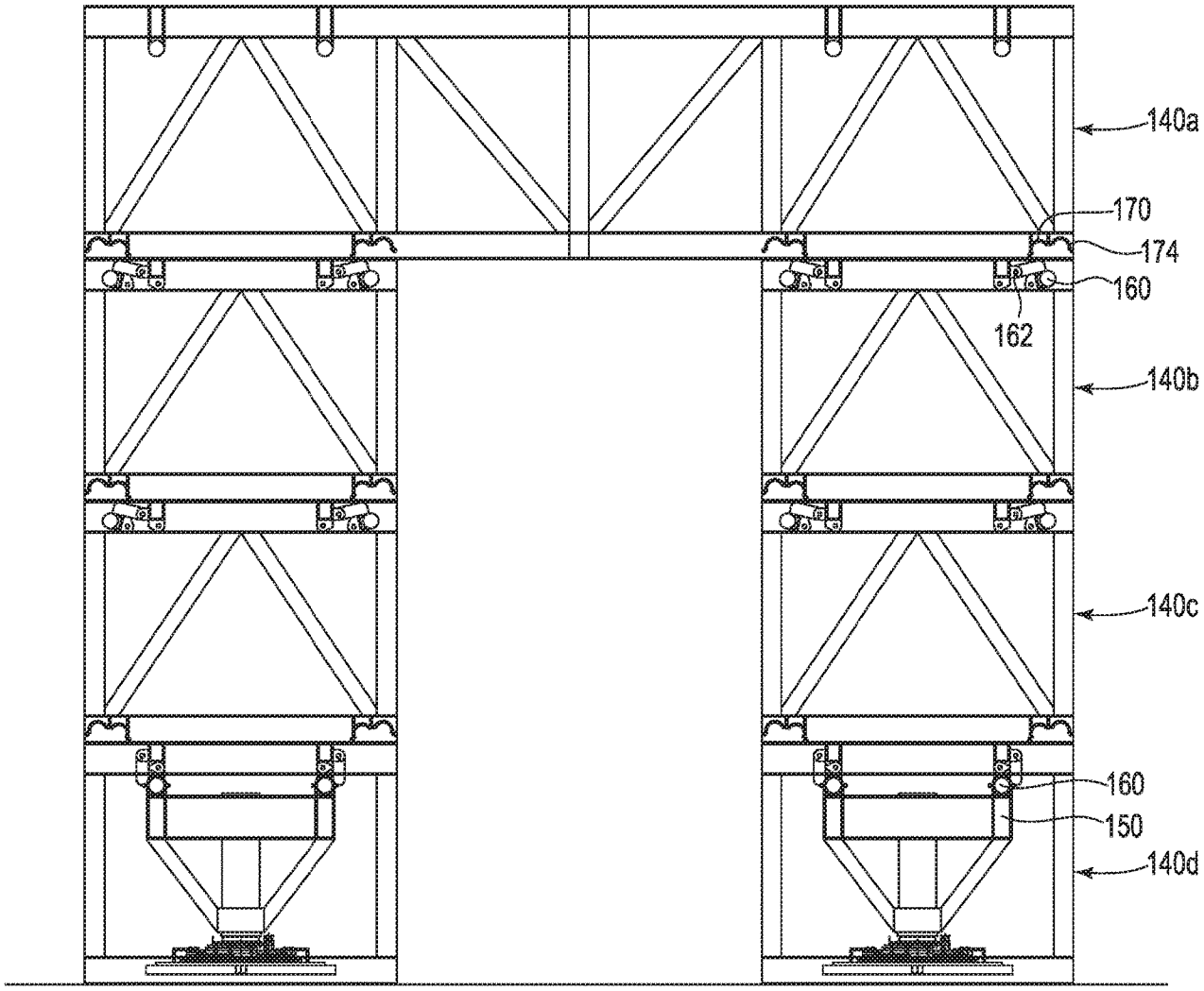
FIG. 29 is a side view of a jacking system and a first layer, second layer, third layer, and fourth layer of substructure boxes, according to one or more embodiments.
Figure 30:
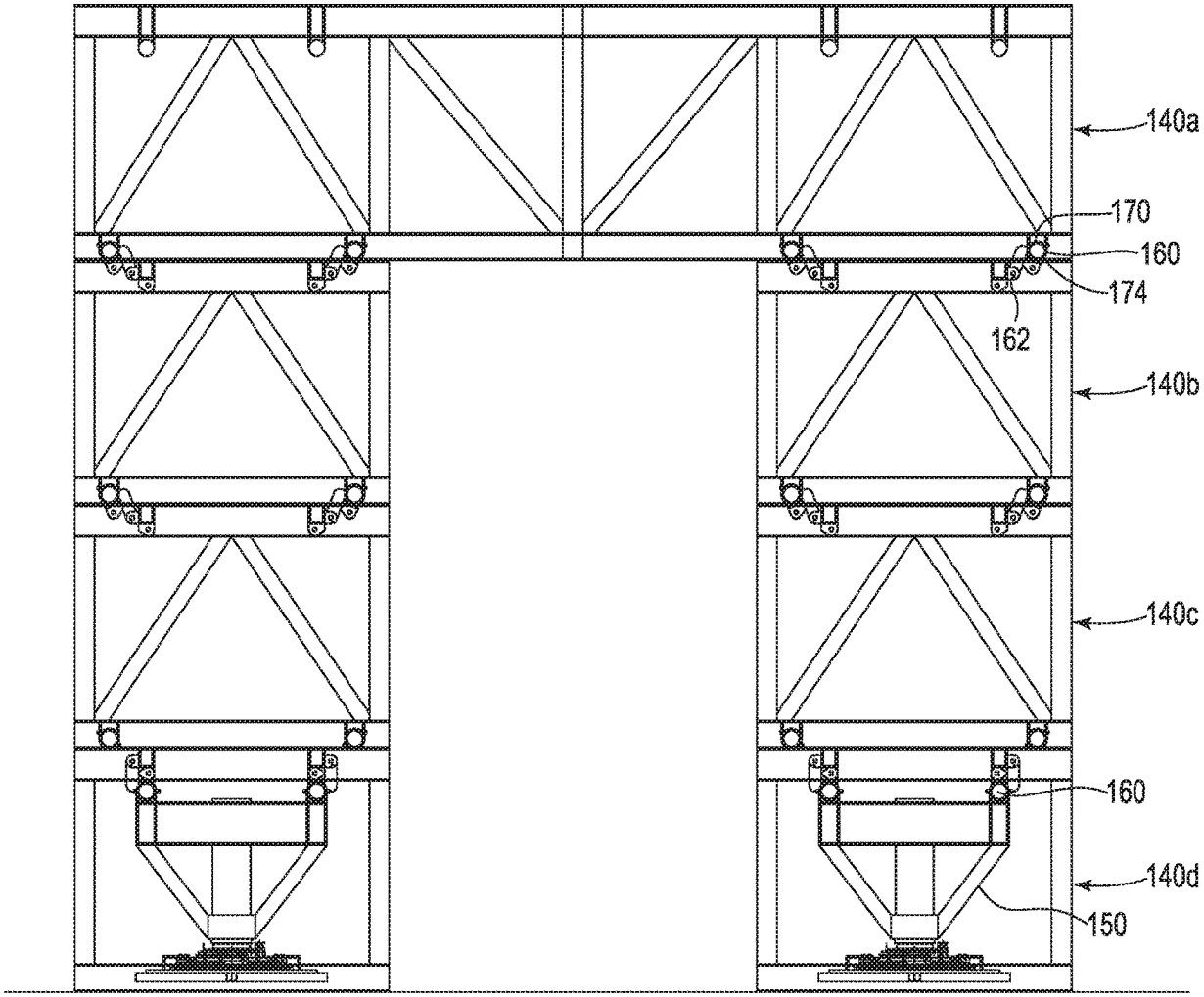
FIG. 30 is a side view of the elements of FIG. 29 with the first second and third layers of substructure boxes coupled together, according to one or more embodiments.

As discussed above, in some embodiments, support bars 160 may be configured to rotate upward into a coupling position. FIG. 29 illustrates a substructure 130 having a first 140*a*, second 140*b*, third 140*c*, and fourth 140*d* layer of substructure boxes, wherein each of the first, second, and third layer of boxes has a coupling saddle 170. As shown in FIG. 30, the coupling saddles 170 and support bars 160 may be used to couple each layer of boxes 140 together. In each of FIGS. 29 and 30, the fourth layer of boxes 140*d* has support bars 160 in a lifting position and coupled to jacking systems 150. In some embodiments, the support bars 160 of the fourth level of boxes 140*d* may be released from the jacking systems 150 and may be rotated upward into the coupling position so as to engage with the coupling saddles 170 of the third layer of boxes 140*c*, thereby coupling the third and fourth layers together.

Figure 31:
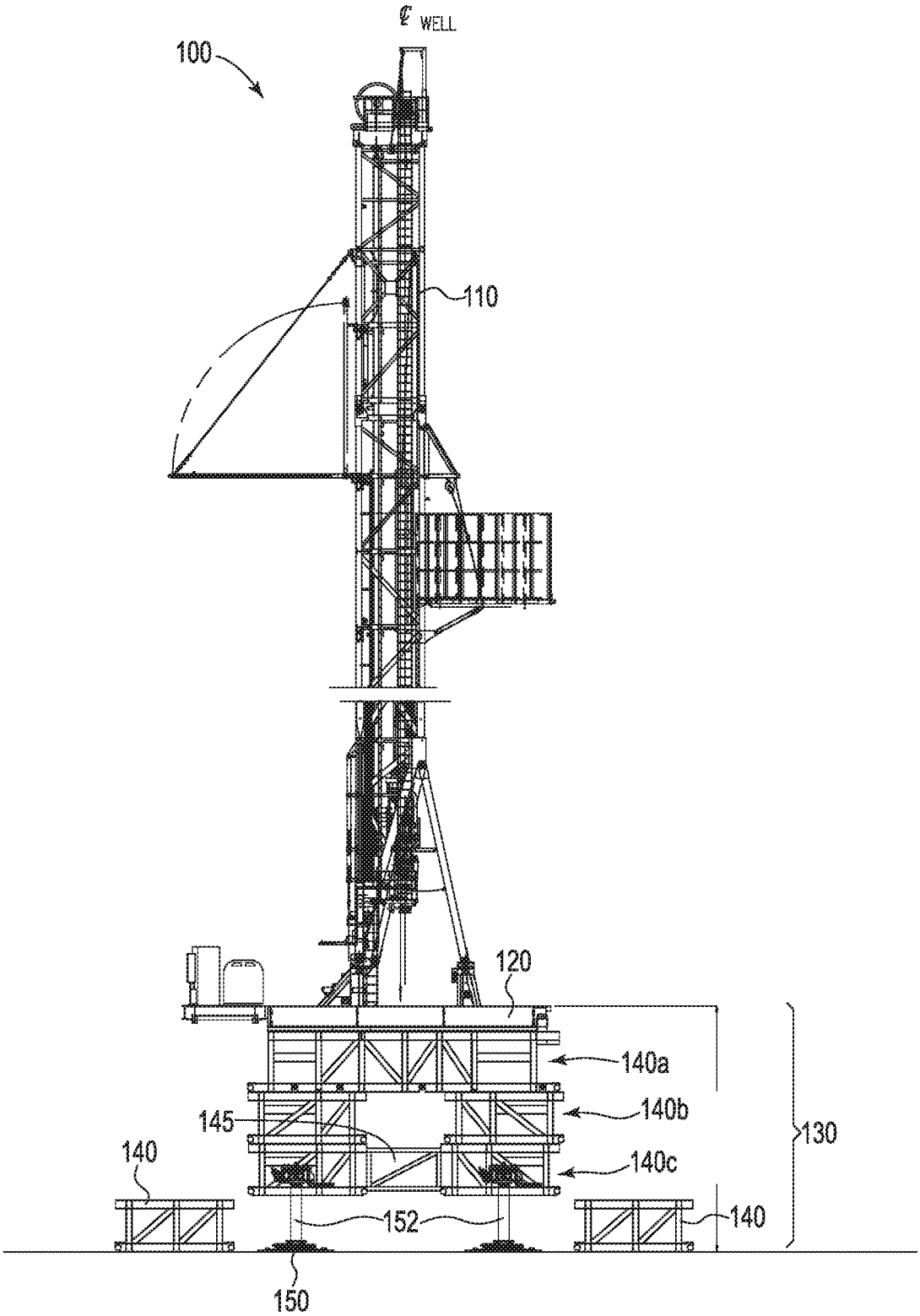
FIG. 31 is a side view of the drilling rig of FIG. 27, with the jacking systems extended, according to one or more embodiments.
Figure 32:
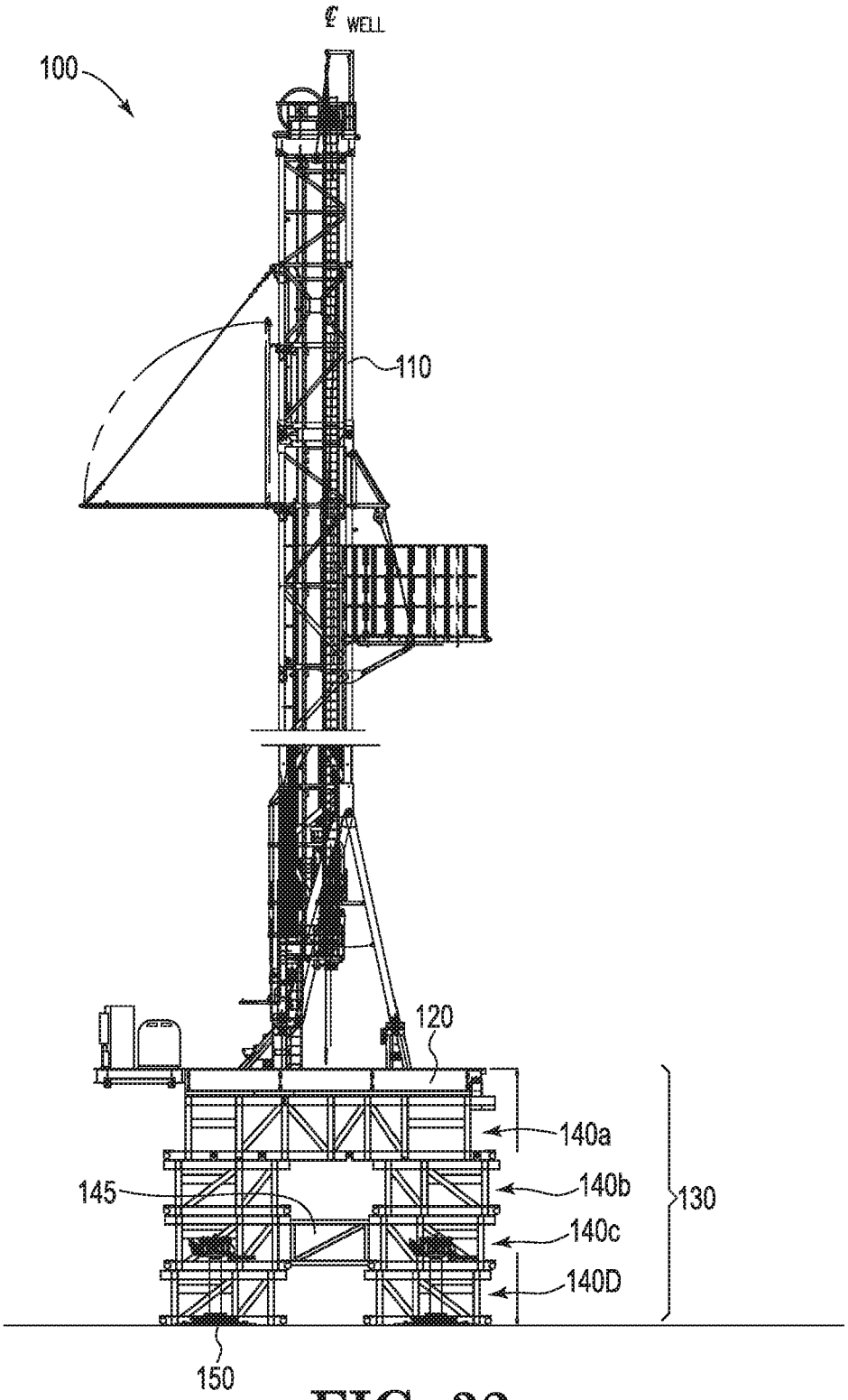
FIG. 32 is a side view of the drilling rig of FIG. 31, with an added fourth layer of substructure boxes, according to one or more embodiments.

FIG. 31 shows the first layer 140*a*, second layer 140*b*, third layer 140*c*, drill floor 120, and mast 110 elevated by the jacking systems 150, such that the dead load of the drill rig 100 is sustained by the bearing plates 154 of the jacking systems. As described, with respect to FIG. 28, the rig 100 may be elevated high enough to accommodate additional substructure boxes 140 being slid beneath the third layer 140*c*. FIG. 32 illustrates substructure boxes 140 positioned around each jacking system 150 to form a fourth layer 140*d*. After the fourth layer 140*d* has been positioned within the substructure 130 and secured to the third layer 140*c* by coupling saddles, shear pins, or other mechanisms, the jacking systems 150 may release the support bars 160 and return to their lowered position. In this way, the dead load of the rig 100 may be transferred off of the bearing plates 154 and onto the first 140*a*, second 140*b*, third 140*c*, and fourth 140*d* layers of the substructure. Support bars 160 within the third layer 140*c* of substructure boxes may move to a clearance position, in some embodiments, when no longer engaged with the jacking systems 150.

Figures 33A, 33B, 33C, 33D, 33E, 33F:
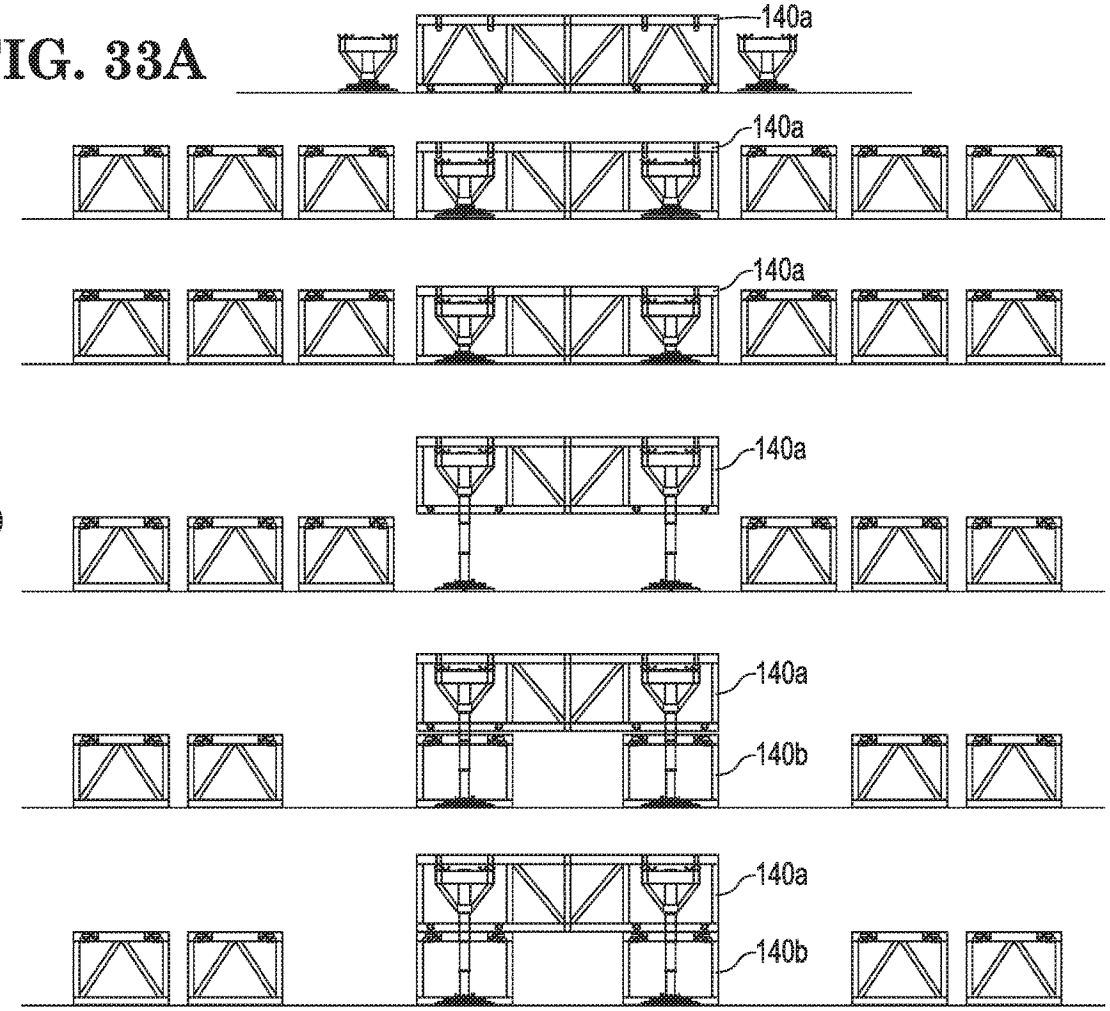
FIGS. 33A-Q each illustrate the steps of FIGS. 20A-F, 24A-E, and 28A-E respectively.
Figure 33G:
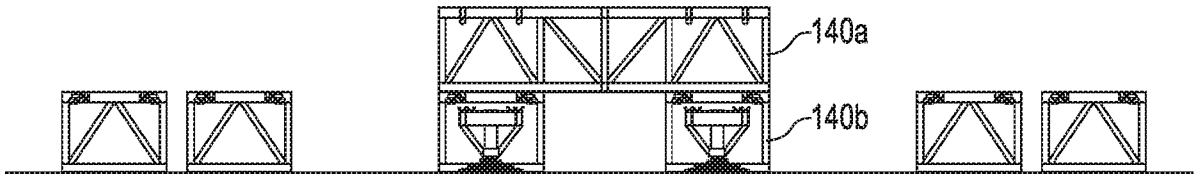
Figure 33H:
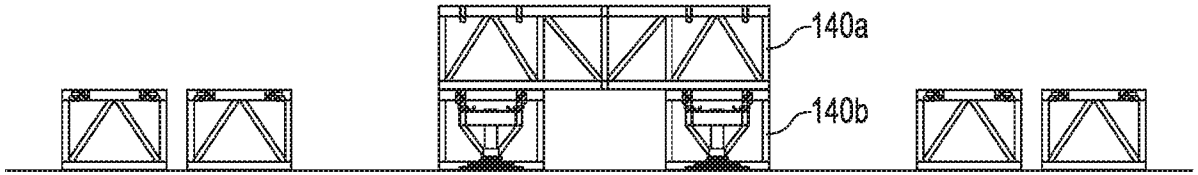
Figure 33I:
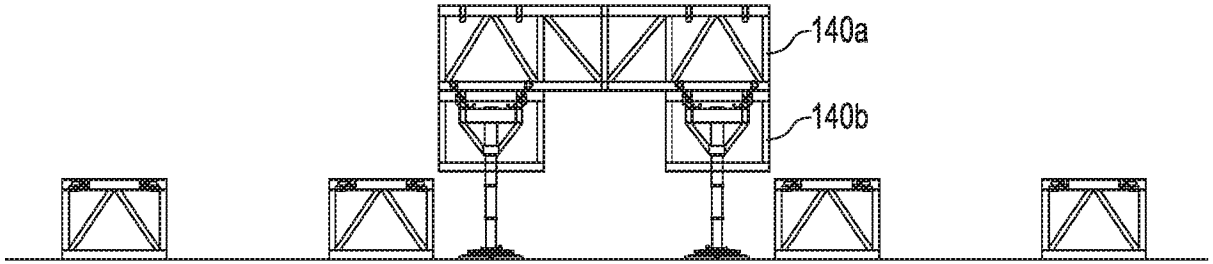
Figure 33J:
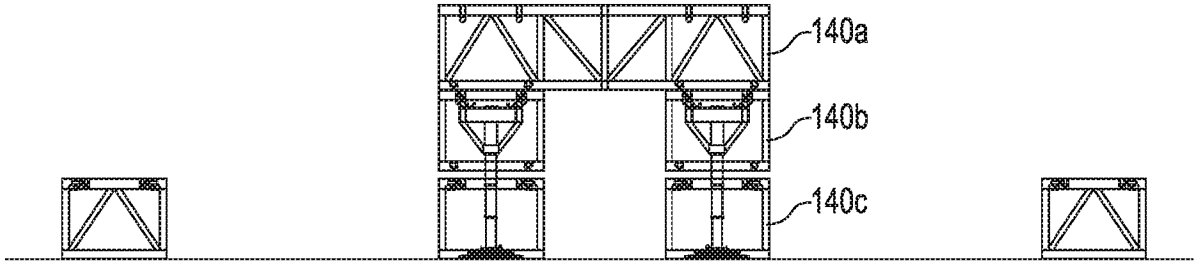
Figure 33K:
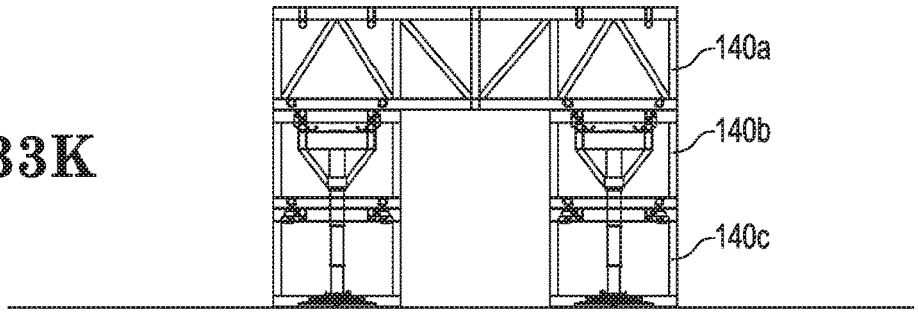
Figure 33L:
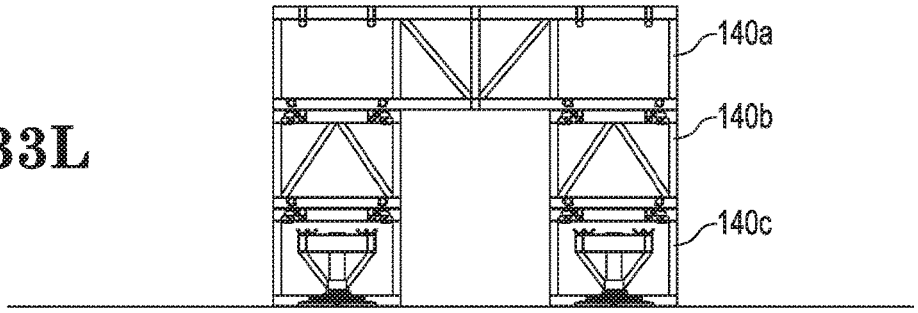
Figure 33M:
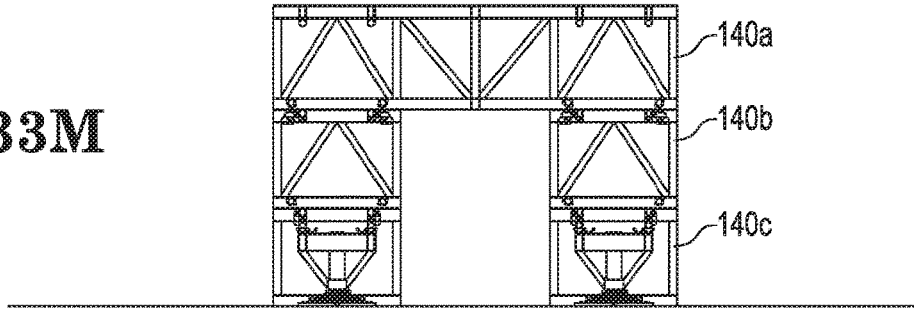
Figure 33N:
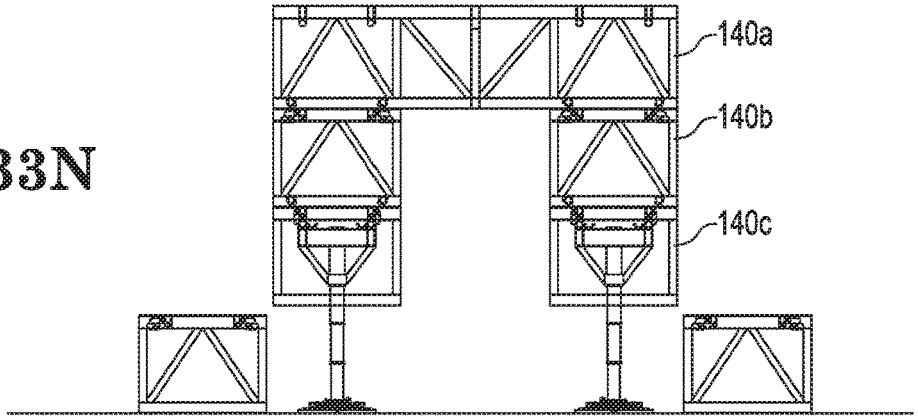
Figure 33O:
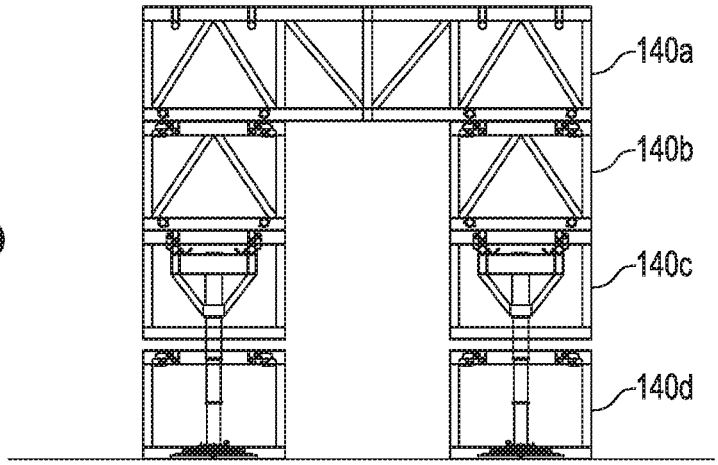
Figure 33P:
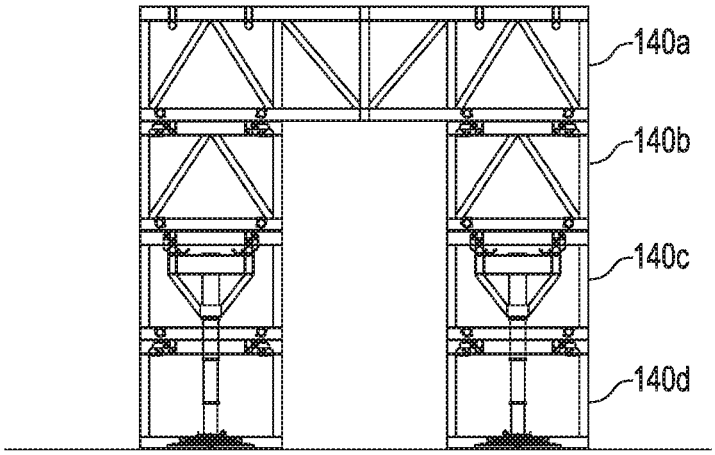
Figure 33Q:
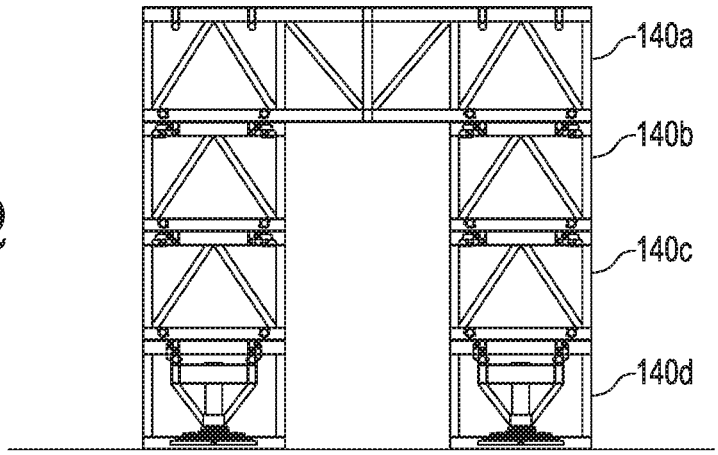

FIGS. 33A-Q illustrate the steps of raising the drill rig 100 to add a second layer 140*b*, third layer 140*c*, and fourth layer 140*d* to the substructure 130, as discussed above with respect to FIGS. 20-32. It may be appreciated that more or fewer layers of substructure boxes 140 may be added to the substructure 130. Generally, the substructure 130 may have enough layers or may generally be elevated to a height to accommodate blow out preventers, Christmas tree assemblies, or other components of the drilling operation. In some embodiments, substructure boxes 140 may be added to bring the drill floor height to between 10 and 100 feet above the ground surface. In particular embodiments, substructure boxes 140 may be added to bring the drill floor height to between 20 and 50 feet above the ground surface. In more particular embodiments, substructure boxes 140 may be added to bring the drill floor height to between 20 and 30 feet above the ground surface. For example, in at least one embodiment, substructure boxes 140 may be added to the substructure 130 to bring the drill floor height to 28 feet above the ground surface. The number of boxes 140 or layers of boxes needed to elevate the drill floor to a desired height above the ground surface may depend in part on the height of the boxes.

Turning now to FIG. 34, a side view of the substructure 130 with four layers of substructure boxes 140 is shown. FIGS. 35A and 35B show opposing side views of one of the vertical stacks of substructure boxes 140 of FIG. 34. As shown in FIG. 35A, boxes 140 of the second 140*b*, third 140*c*, and fourth 140*d* layers may have less bracing, such as fewer cross members 146 and horizontal members 142 on at least one side, so as to accommodate the boxes being positioned around the jacking systems 150. As discussed above, the boxes 140 may have a generally squared C-shape so as to accommodate being placed around the jacking systems 150.

In some embodiments, the drilling rig 100 with assembled substructure 130 may be generally mobile. For example, the drilling rig 100 may be movable between wellbores on a pad drilling site. The drilling rig 100 may use various movement mechanisms, such as walking feet or a skid movement apparatus, tires such as rubber tires, rails, or other movement mechanisms. Generally, any suitable movement mechanism may be used. In some embodiments, the drilling rig 100 may be movable using walking feet. The walking feet may be separate components coupled to the substructure 130 in some embodiments. In other embodiments, the jacking systems 150 may each have a walking or skid foot movement apparatus 158. The movement of the skid foot movement apparatus 158 may generally involve raising the drilling rig 100 a distance off of the ground or other surface using the telescoping cylinder 152, followed by a skidding step, so as to move the drilling rig 100 a distance laterally or longitudinally. The movement of the rig 100 on the walking feet is described more fully in U.S. Pat. No. 9,091,126, entitled Mobile Drilling Rig with Telescoping Substructure Boxes, filed Apr. 16, 2013, incorporated herein by reference in its entirety. It may be appreciated that the vertical stack configuration of the substructure boxes 140 may allow the drilling rig 100 to be moved, using the skid foot movement apparatuses 158 latitudinally and/or longitudinally, allowing more freedom of movement.

In some embodiments, the jacking systems 150 may be clamped or otherwise securely coupled to the substructure 130 prior to initiating the skid foot movement apparatus 158. As shown in FIG. 34, for example, the jacking systems 150 may couple to the fourth layer 140*d*, or otherwise bottom layer, of substructure boxes 140 via the saddles 156 or other attachment mechanism. In some embodiments, the covers or clamps 157 may close over the support bars 160 in order to secure the support bars to the jacking systems 150 during lateral or longitudinal movement. In other embodiments, the jacking systems 150 may secure to the substructure 130 using other mechanisms for lateral or longitudinal skidding movement.

A drilling rig of the present disclosure may generally be disassembled by various methods. As may be appreciated, a drilling rig of the present disclosure may generally be disassembled in an opposite manner from which it was assembled. That is, where assembly of the substructure included the steps of raising the drill floor, inserting a layer of substructure boxes, and pinning the substructure boxes in place, disassembly of the substructure may generally include unpinning a layer of substructure boxes, raising the drill floor above the unpinned boxes, such that the dead load of the drilling rig is transferred to the jacking systems, and removing the unpinned boxes. Once the substructure is disassembled, the mast may be lowered and the remainder of the drilling rig disassembled in some embodiments.

It may further be appreciated that a substructure of the present disclosure may be comprised of relatively small and manageable components, such as the individual substructure boxes. In this way, the substructure components may be shipped or brought to a drilling site using relatively small trailers, trucks, or other means. In addition, a substructure and/or drilling rig of the present disclosure may be assembled using relatively small vehicles, such as rubber tire cranes, bulldozers, and/or other vehicles. Moreover the relatively open box design of the substructure boxes and substructure of the present disclosure may allow for below drill floor access to storage, work spaces, and other components.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

We claim:

1. A drilling rig with a self-elevating drill floor, the drilling rig comprising:

a mast;

a drill floor supporting the mast;

a substructure comprising one or more columns of substructure boxes; and a jacking system comprising a telescoping cylinder and a skid movement mechanism, the jacking system configured to:

using the telescoping cylinder, raise the drill floor such that one or more substructure boxes may be inserted beneath the drill floor; and using the skid movement mechanism, skid the drilling rig in each of a latitudinal and a longitudinal direction.

2. The drilling rig of claim 1, wherein the one or more substructure boxes comprises a C-shaped substructure box configured for placement around the jacking system while the jacking system is in place.

3. The drilling rig of claim 1, wherein the jacking system is configured to raise the drill floor by coupling to a lowermost box of the substructure boxes in a respective column of the one or more columns, and raising the drill floor and substructure a distance off of the ground surface.

4. The drilling rig of claim 1, wherein the jacking system further comprises at least one of a support bar and a saddle, the jacking system configured for coupling to a substructure box to raise the substructure.

5. The drilling rig of claim 1, wherein at least a portion of the substructure boxes comprise a pivotable support bar and the pivotable support bar is hydraulically actuated.

6. The drilling rig of claim 5, wherein the pivotable support bar is configured to pivot between a lifting position for raising the substructure and a coupling position for coupling to a second substructure box.

7. The drilling rig of claim 1, wherein at least a portion of the plurality of substructure boxes comprise a pivotable saddle and the pivotable saddle is hydraulically actuated.

8. The drilling rig of claim 7, wherein the pivotable saddle is configured to pivot between a lifting position for raising the substructure and a coupling position for coupling to a second substructure box.

9. The drilling rig of claim 1, wherein the skid movement mechanism comprises a bearing plate.

10. The drilling rig of claim 9, further comprising a bearing between the bearing plate and the telescoping cylinder providing for relative movement therebetween.

11. The drilling rig of claim 10, wherein the skid movement mechanism is configured to move the rig from one wellbore location to another.

12. The drilling rig of claim 1, wherein the substructure boxes comprise a first engagement system for engaging adjacent substructure boxes and the jacking system comprises a second engagement mechanism for engaging the substructure boxes.

13. The drilling rig of claim 12, wherein the second engagement mechanism is the same as the first engagement mechanism.

14. The drilling rig of claim 13, wherein the first and second engagement mechanisms comprise a support bar and a saddle.

* * * * *